US008408937B2

(12) United States Patent
Lo et al.

(10) Patent No.: US 8,408,937 B2
(45) Date of Patent: Apr. 2, 2013

(54) LIGHTING CONNECTOR DEVICES AND USES THEREOF

(75) Inventors: Paul Chung Wai Lo, Kowloon (CN); Teddy Yeung Man Lo, Kowloon (CN); Eddie Ping Kuen Li, Ma On Shan (CN); Sue-Anne Tean Leung, Hong Kong (CN)

(73) Assignee: Huizhou Light Engine Ltd., Huizhou (CN)

( * ) Notice: Subject to any disclaimer, the term of this patent is extended or adjusted under 35 U.S.C. 154(b) by 0 days.

(21) Appl. No.: 13/481,780

(22) Filed: May 26, 2012

(65) Prior Publication Data

US 2012/0238117 A1 Sep. 20, 2012

Related U.S. Application Data

(62) Division of application No. 12/771,844, filed on Apr. 30, 2010, now Pat. No. 8,187,021.

(60) Provisional application No. 61/174,980, filed on May 1, 2009.

(51) Int. Cl.
*H01R 11/20* (2006.01)
*H01R 4/24* (2006.01)

(52) U.S. Cl. ..... 439/426

(58) Field of Classification Search ..... 439/426, 439/425

See application file for complete search history.

(56) References Cited

U.S. PATENT DOCUMENTS

| | | | | |
|---|---|---|---|---|
| 2,820,843 | A | 1/1958 | Dreher | |
| 4,841,420 | A | 6/1989 | Baggio et al. | |
| 5,041,953 | A | 8/1991 | Dannatt | |
| 5,179,339 | A | 1/1993 | Volk, Jr. | |
| 5,435,747 | A | 7/1995 | Franckx et al. | |
| 7,029,312 | B2 * | 4/2006 | Reid | 439/367 |
| 7,156,686 | B1 | 1/2007 | Sekela et al. | |
| 7,160,140 | B1 | 1/2007 | Mrakovich et al. | |
| 7,988,332 | B2 | 8/2011 | Lo et al. | |
| 2007/0058377 | A1 | 3/2007 | Zampini et al. | |
| 2007/0109710 | A1 | 5/2007 | Milan | |
| 2007/0249204 | A1 | 10/2007 | Petersen et al. | |
| 2008/0081507 | A1 | 4/2008 | Mahajan | |
| 2008/0137332 | A1 | 6/2008 | Lo et al. | |
| 2008/0252234 | A1 | 10/2008 | MacKenzie et al. | |
| 2009/0154156 | A1 | 6/2009 | Lo et al. | |
| 2010/0279539 | A1 | 11/2010 | Lo et al. | |

FOREIGN PATENT DOCUMENTS

| | | | |
|---|---|---|---|
| WO | WO-90/14698 | A1 | 11/1990 |
| WO | WO-2010/082967 | A1 | 7/2010 |

OTHER PUBLICATIONS

PCT Notification of Transmittal of the International Search Report and The Written Opinion of the International Searching Authority, or the Declaration dated Jan. 14, 2001 in connection with PCT International Application No. PCT/US10/56747.

(Continued)

*Primary Examiner* — Javaid Nasri
(74) *Attorney, Agent, or Firm* — Cindy Yang

(57) ABSTRACT

A lighting connector which includes an upper housing having plural connector pins, and one or more interlocking grooves; a lower housing, the lower housing having a plurality of connector pin guide holes, and one or more interlocking tongue portions; a power supply plug; and a flexible connector electrically connecting an inner side of the lower housing with an inner side of the power supply plug, the lower housing being connectable with the upper housing to form the lighting connector by coupling at least one of the one or more interlocking grooves with at least one of the one or more interlocking tongue portions, and by coupling at least one of the plural connector pins with at least one of the connector pin guide holes.

14 Claims, 52 Drawing Sheets

OTHER PUBLICATIONS

PCT Notification of Transmittal of the International Search Report and The Written Opinion of the International Searching Authority, or the Declaration, mailing date Sep. 6, 2010, in connection with PCT International Application No. PCT/EP2010/055909.

Office Action issued by USPTO for U.S. Appl. No. 12/771,844, mail date Nov. 25, 2011.

EPO Communication Pursuant to Article 94(3) EPC issued in European Patent Application No. 10 721 377.9-2208, dated Aug. 10, 2012.

* cited by examiner

LIGHTING CONNECTOR DEVICES AND USES THEREOF

CROSS-REFERENCE TO RELATED APPLICATION

This utility application is a divisional application of U.S. Ser. No. 12/771,844, filed Apr. 30, 2010, now U.S. Pat. No. 8,187,021, which claims benefit under 35 U.S.C. §119(e) of U.S. Provisional Application No. 61/174,980, filed May 1, 2009, which is hereby incorporated by reference.

Throughout this application, several patent applications and references are referenced. Disclosure of these patent applications and references in their entirety is hereby incorporated by reference into this application.

BACKGROUND OF THE INVENTION

The present invention relates generally to connector devices and more particularly to such devices which electrically and mechanically connect, at a variety of angles with respect to each other, segments of a lighting apparatus (such as light wires, cables, bars or tubes which are protected by an encapsulant (e.g., the integrally formed single piece light-emitting diode ("LED") light wire described in U.S. Ser. No. 11/854,145, filed Sep. 12, 2007, and U.S. Ser. No. 12/355,655, filed Jan. 16, 2009) or protective sheath(es), cover(s) or layer(s)), and the uses thereof.

BRIEF SUMMARY OF THE INVENTION

In accordance with a first aspect, the present invention is directed to a lighting connector, the lighting connector comprising: (a) an upper housing having: plural connector pins, and one or more interlocking grooves; and (b) a lower housing, the lower housing having a plurality of connector pin guide holes, and one or more interlocking tongue portions, the lower housing being connectable with the upper housing to form the lighting connector by coupling at least one of the one or more interlocking grooves with at least one of the one or more interlocking tongue portions, and by coupling at least one of the plural connector pins with at least one of the connector pin guide holes.

In another aspect, each of the plural connector pins comprises an embedded portion situated within the upper housing, and plural protruding portions, at least one of the protruding portions being configured to couple with a respective corresponding one of the at least one connector pin guide holes.

In another aspect, the upper and lower housings are shaped so as to interface with at least two lengths of lighting apparatus, so as to mechanically and electrically connect the at least two lengths of lighting apparatus to one another upon coupling of the upper and lower housings to form the lighting connector.

In another aspect, each of the at least two lengths of lighting apparatus interfacing with the connector comprises an encapsulant and at least one conductive bus embedded within the encapsulant, and, upon coupling of the upper and lower housings, the protruding portions of each connector pin penetrate the encapsulant of at least one of the lighting apparatuses so as to contact the at least one conductive bus and to effect an electrical coupling between the at least two lengths of lighting apparatus.

In another aspect, the lower housing further comprises at least one opening for receiving an end portion of a length of lighting apparatus.

In another aspect, a gasket is provided in a lining of the at least one opening.

In another aspect, the upper housing and lower housing are shaped to facilitate interfacing of the connector with end portions of two lighting apparatuses at a right angle, so as to provide, upon coupling of the upper housing and the lower housing, an L-branch lighting connector.

In another aspect, the upper housing and lower housing are shaped to facilitate interfacing of the connector with end portions of two lighting apparatuses in a substantially straight line, so as to provide, upon coupling of the upper housing and the lower housing, an I-branch lighting connector.

In another aspect, the upper housing and lower housing are shaped to facilitate interfacing of the connector with end portions of first and second lengths of lighting apparatus that are oriented in a substantially straight line with respect to one another, and to facilitate interfacing of the connector with a lengthwise portion of a third length of lighting apparatus, oriented substantially perpendicularly to the straight line, so as to provide, upon coupling of the upper housing and the lower housing, an X-branch lighting connector.

In another aspect, the upper housing and lower housing are shaped to facilitate interfacing of the connector with an end portion of a first length of lighting apparatus, and to facilitate interfacing of the connector with a lengthwise portion of a second length of lighting apparatus, oriented substantially perpendicularly to the first length of lighting apparatus, so as to provide, upon coupling of the upper housing and the lower housing, a T-branch lighting connector.

In another aspect, the upper housing and lower housing are shaped to facilitate interfacing of the connector with end portions of two lighting apparatuses in parallel with one another, so as to provide, upon coupling of the upper housing and the lower housing, a U-branch lighting connector.

In another aspect, each of the connector pins are made of an electrically conductive material.

In another aspect, the embedded portion of each of the connector pins is insert-molded into the upper housing.

In another aspect, the protruding portions of each of the connector pins comprise a barbed tip, inverted "V" tip, or a "U" tip.

In another aspect, the upper and lower housings are made of a thermoplastic.

In yet another aspect, the present invention is directed to a method of electrically and mechanically connecting at least two lengths of lighting apparatus, each having at least one conductive bus, using a connector having: an upper housing having one or more interlocking grooves, a lower housing having one or more interlocking tongue portions, connector pins embedded in the upper housing, and one or more openings and/or slots formed in the lower housing. The method comprises: coupling an end portion of a first one of the at least two lengths of lighting apparatus into at least one of the one or more openings and/or slots; coupling a second one of the at least two lengths of lighting apparatus into at least one of the one or more openings and/or slots; and pressing the upper housing and the lower housing so as to couple corresponding ones of the interlocking grooves of the upper housing with interlocking tongue portions of the lower housing, so as to penetrate the connector pins into the at least two lengths of lighting apparatus so as to contact the at least one conductive buses of the respective lighting apparatus.

In another aspect, the at least two lengths of lighting apparatus comprises an encapsulant, and the connector pins penetrate to the encapsulant in the pressing step.

In another aspect, the penetration of the respective at least two lengths of lighting apparatus effects an electrical connection between the at least one conductor buses of the at least two lengths of lighting apparatus.

In yet another aspect, the present invention is directed to a lighting connector comprising: (a) first and second upper housings, each upper housing having: plural connector pins, and one or more interlocking grooves; (b) first and second lower housings, each the lower housing having a plurality of connector pin guide holes, and one or more interlocking tongue portions; and (c) a flexible connector electrically connecting an inner side of the first lower housing with an inner side of the second lower housing. The first lower housing is connectable with the first upper housing, and the second lower housing is connectable with the second upper housing, to form the lighting connector by coupling at least one of the one or more interlocking grooves with at least one of the one or more interlocking tongue portions, and by coupling at least one of the plural connector pins with at least one of the connector pin guide holes.

In another aspect, each of the plural connector pins comprises an embedded portion situated within one of the first and second upper housings, and plural protruding portions, at least one of the protruding portions being configured to couple with a respective corresponding one of the at least one connector pin guide holes.

In another aspect, each of the first and second upper and lower housings are shaped so as to interface with and end portion of a length of lighting apparatus, so as to mechanically and electrically connect at least two lengths of lighting apparatus to one another upon coupling of the upper and lower housings to form the lighting connector.

In another aspect, each of the at least two lengths of lighting apparatus interfacing with the connector comprises an encapsulant and at least one conductive bus embedded within the encapsulant, and, upon coupling of the upper and lower housings, the protruding portions of each connector pin penetrate the encapsulant of at least one of the lengths of lighting apparatus so as to contact the at least one conductive bus and to effect an electrical coupling between the at least two lengths of lighting apparatus.

In yet another aspect, a lighting system comprising at least one lighting connector of claim 1.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

Figure 1:
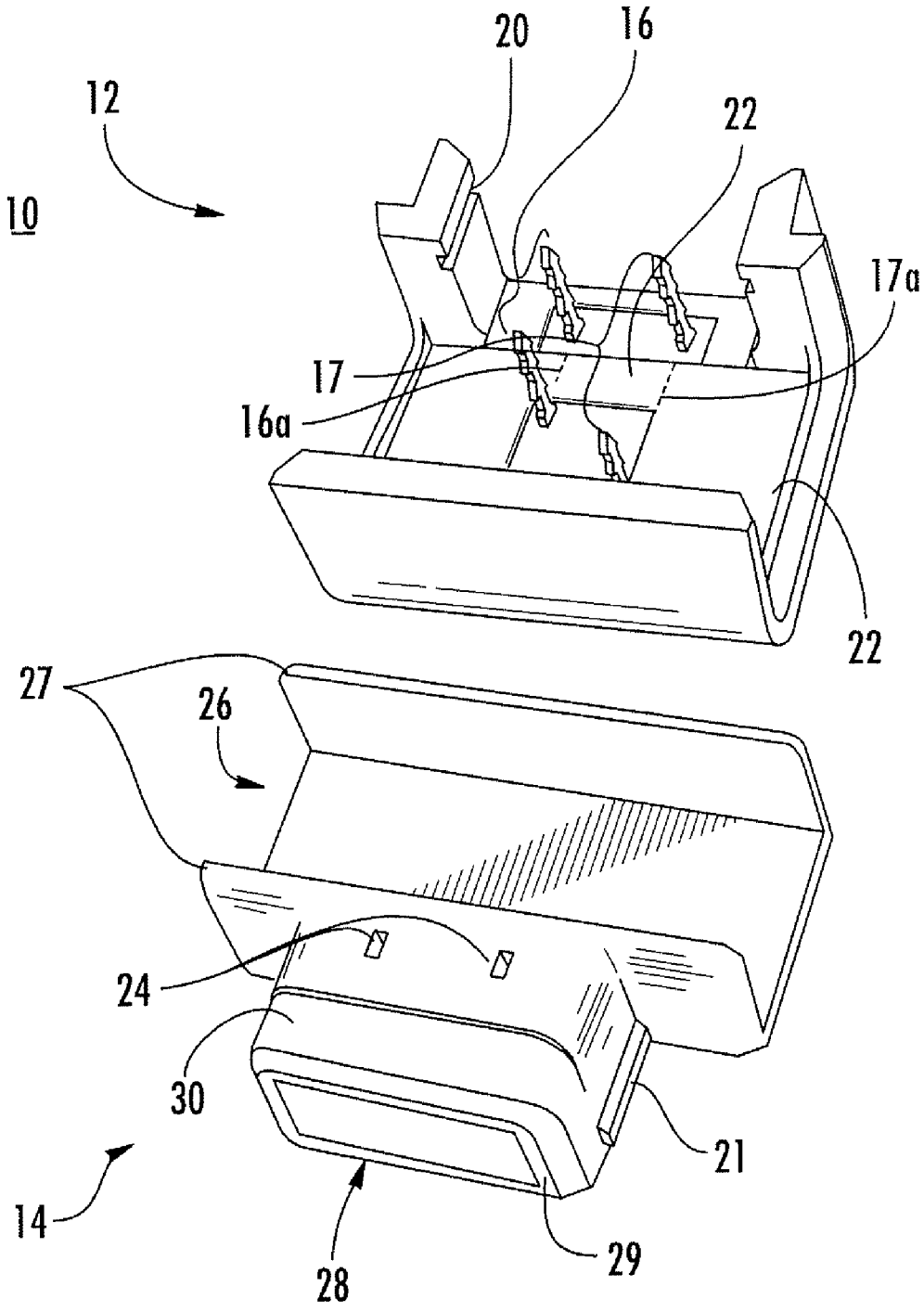
FIG. 1 is a view of a disassembled T-branch lighting connector in accordance with a first embodiment of the present invention.
Figure 2:
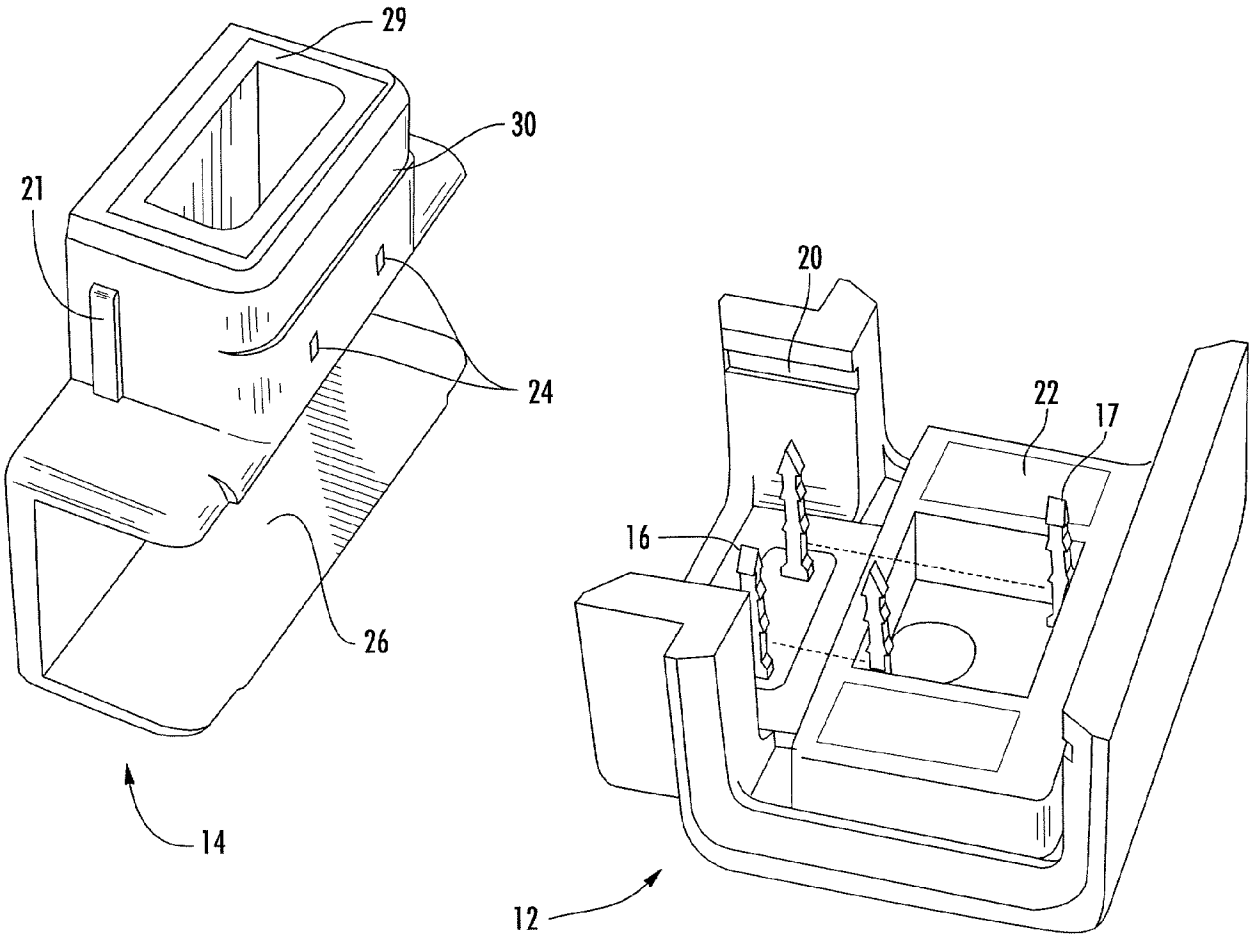
FIG. 2 is another view of a disassembled T-branch lighting connector in accordance with a first embodiment of the present invention.
Figure 3:
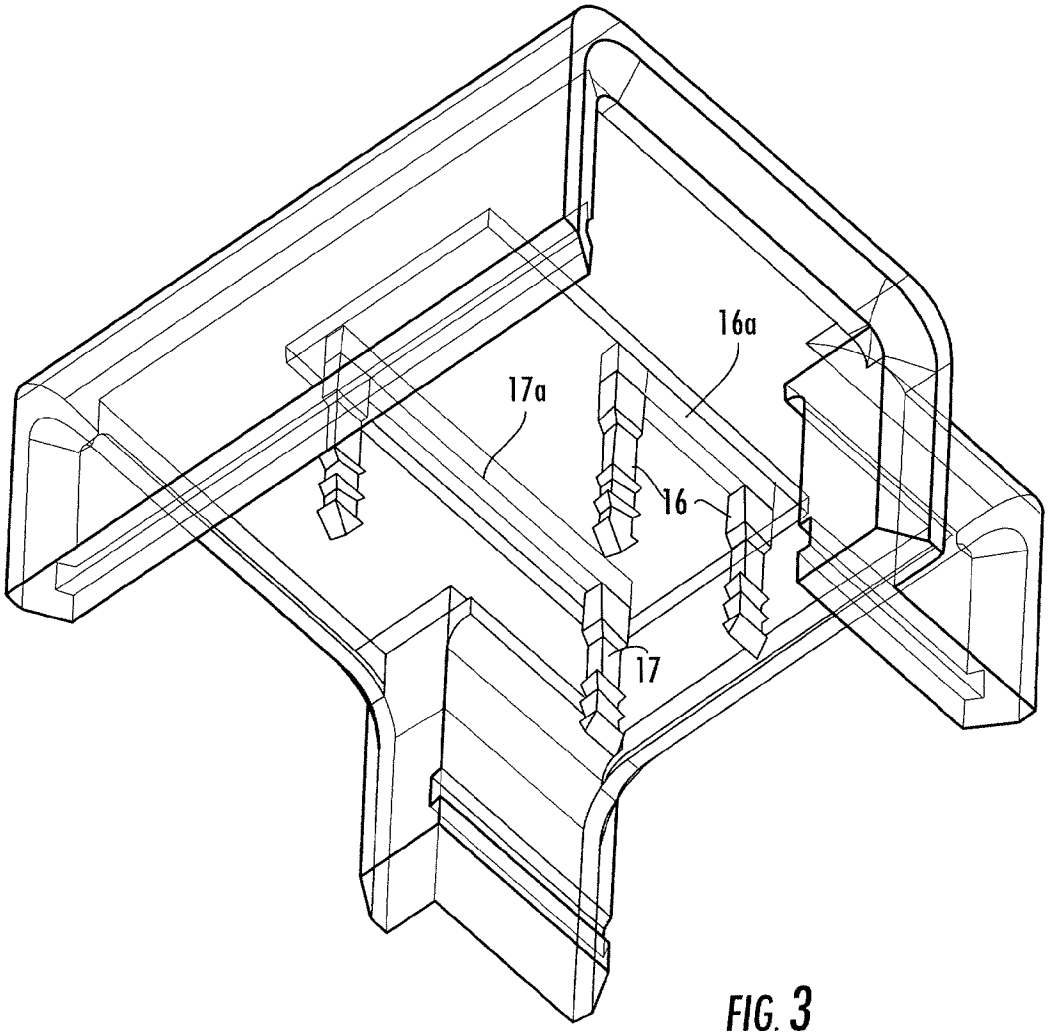
FIG. 3 is an X-ray view of an upper housing in accordance with a first embodiment of the present invention.
Figure 4A:
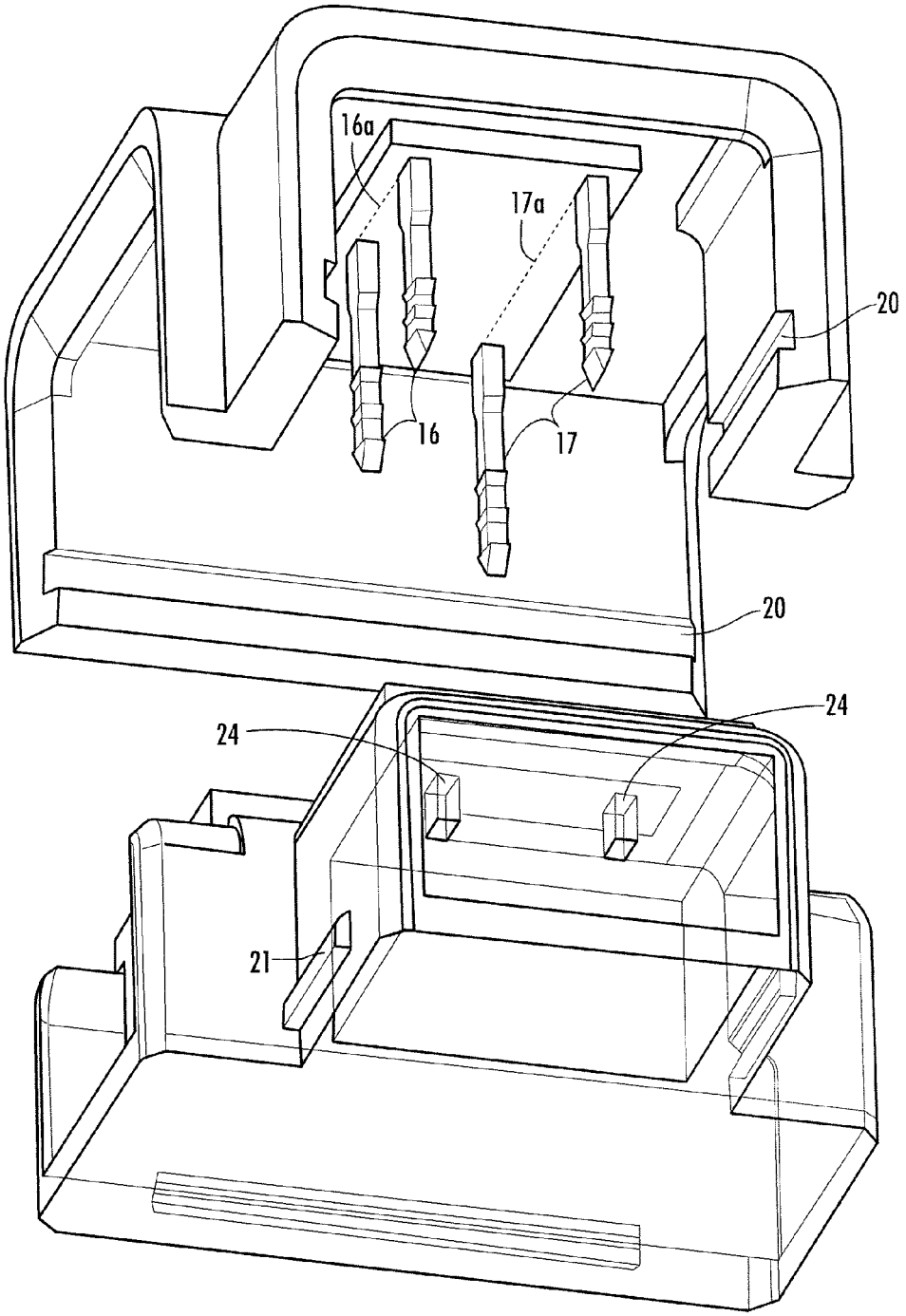
FIGS. 4A-4C, 5A and 5B are exploded and X-ray views of a disassembled T-branch lighting connector in accordance with a first embodiment of the present invention.
Figure 4B:
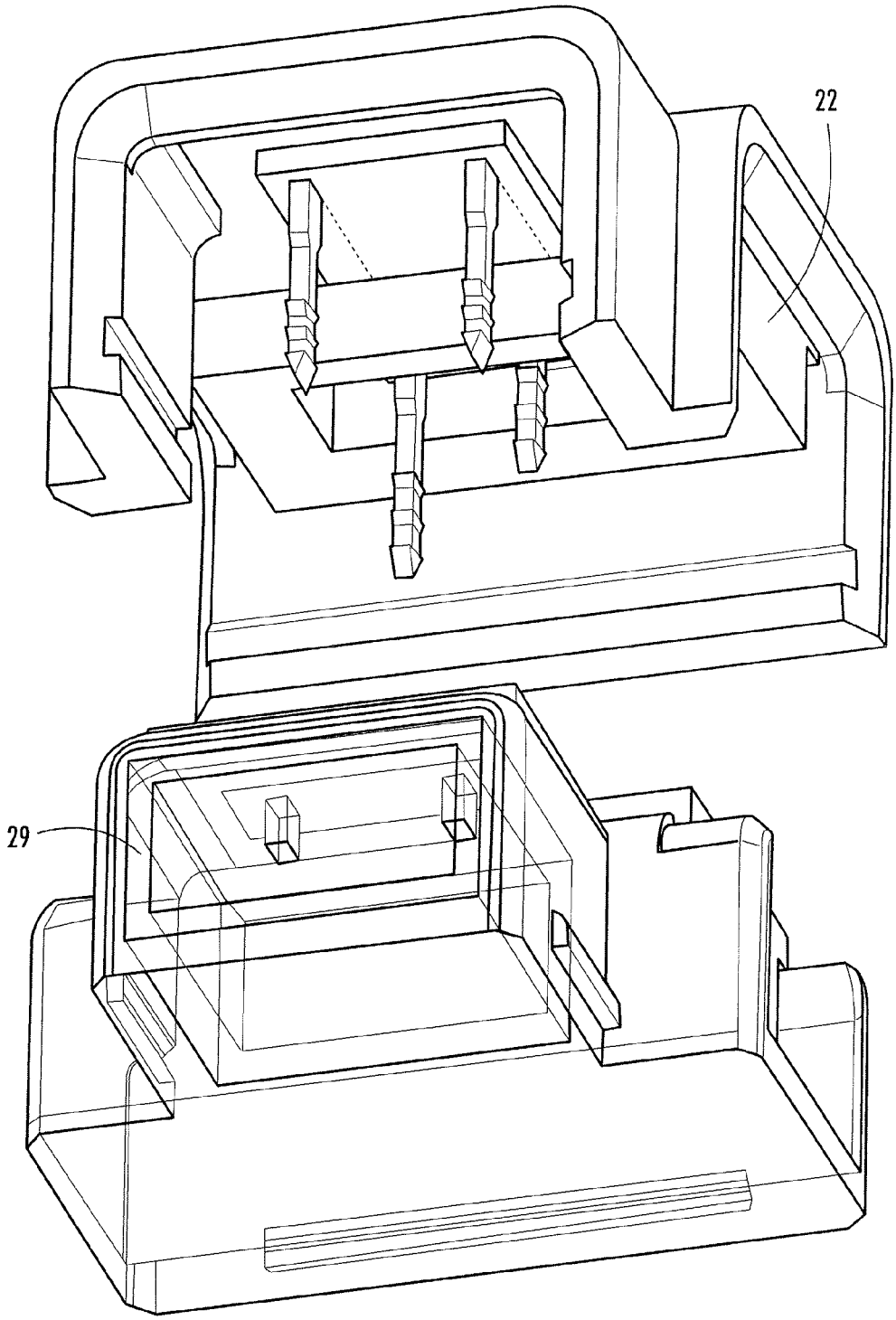
Figure 4C:
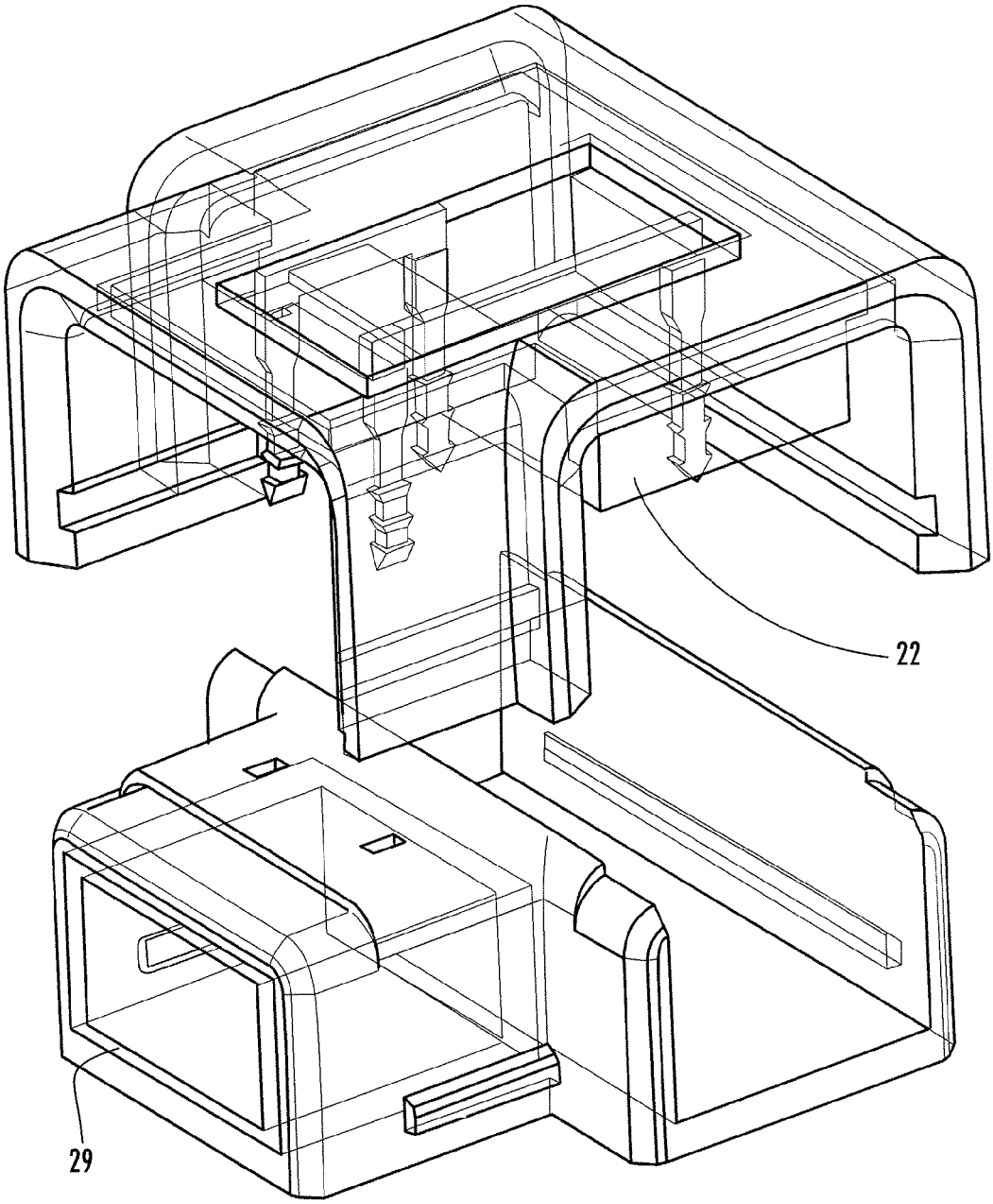

According to the various embodiments, a lighting connector is formed using an upper and lower housing and connector pins. In accordance with the disclosed embodiments, connector pins formed in the upper housing are situated within the upper housing such that, when the upper housing is mated with the lower housing, and plural segments or portions of hard and/or flexible lighting apparatus, such as an LED light wire, cable, bar or tube, are configured therebetween, an electrical and mechanical connection between the portions of lighting apparatus is effected by the connector pins.

As shown in FIGS. 1-7, in accordance with a first preferred embodiment, a T-branch lighting connector 10 is formed from an upper housing 12 and a lower housing 14. The upper housing 12 has connector pins 16 and 17. Connector pin 16 includes protruding portions extending from the upper housing, and an embedded portion 16*a*, shown in phantom, formed within the housing perpendicularly to and connecting the protruding portions. Connector pin 17 similarly includes protruding portions and an embedded portion 17*a*. As will be described in more detail below, each connector pin forms a connection between a first lighting apparatus 31 that connects with the connector from a first direction, and a second lighting apparatus 32 that connects with the connector from a second direction.

Figure 5A:
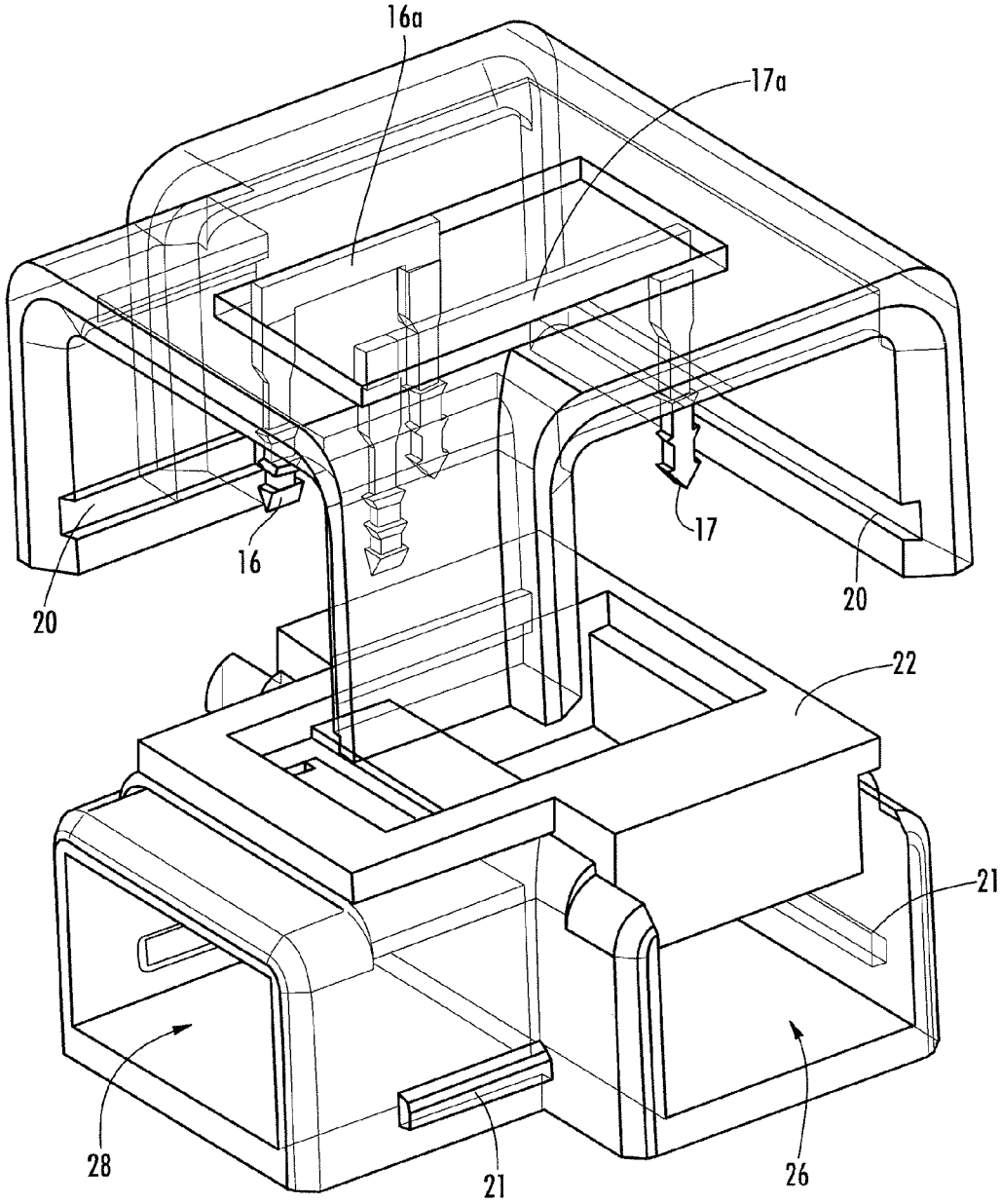
Figure 5B:
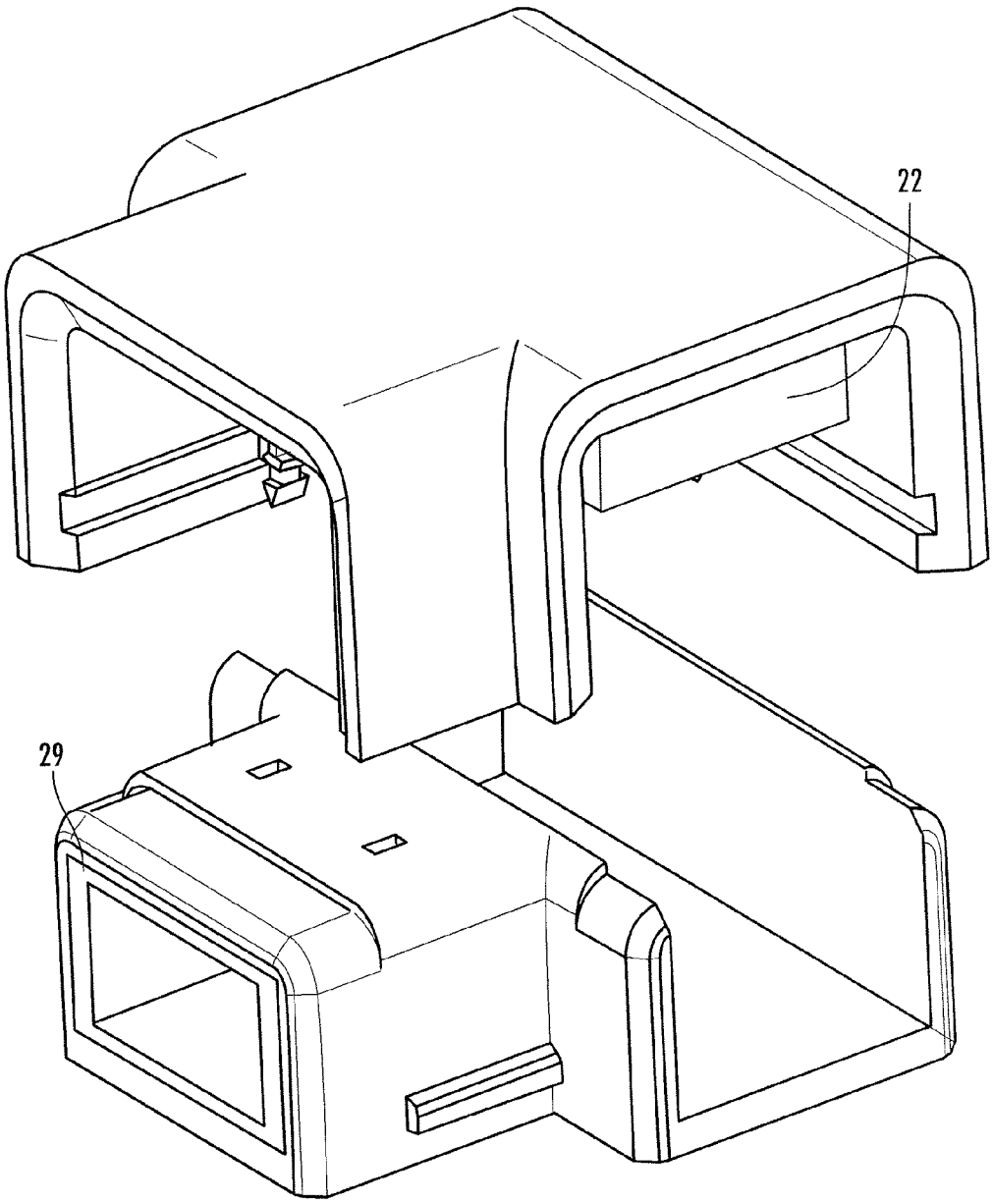

The upper housing includes interlocking groove(s) 20 and a gasket 22. The interlocking groove(s) 20 mate with interlocking tongue(s) 21 in the lower housing 14 to achieve a secure connection, e.g., a snap fit, between the upper and lower housing when the connector is assembled. The gasket 22 is used to ensure a tight fit of the housings and the lighting apparatuses when the connector has been assembled. While shown in the figure as being associated with the upper housing 12, the gasket can be provided separately, and placed between the upper and lower housings during assembly of the connector, for example as shown in FIG. 5A.

The lower housing 14 includes plural connector pin guide holes 24, a slot 26, formed by walls 27, and an opening 28. In the T-branch embodiment, an end portion of a first length of lighting apparatus 31 is inserted into the opening 28 for connection to a second length of lighting apparatus 32 that will be located in a slot 26, perpendicular to the first length of lighting apparatus, as can be seen particularly in FIGS. 6A, 6B and 7. An opening gasket 29 lines the opening 28 in the lower housing, as can be seen, for example, in FIGS. 4B, 4C, 5B and 6B. The lower housing 14 also includes a gasket groove 30. The opening gasket 29, e.g., prevents water leaking between the lower housing 14 and the lighting apparatus inserted into the opening 28.

To assemble the connector 10, the upper housing 12 is coupled with the lower housing 14 via the corresponding interlocking groove(s) 20 and tongue(s) 21. When pressing the upper housing 12 and the lower housing 14 together, one end of each of the connector pins 16 and 17 on the upper housing are matched with their corresponding connector pin guide holes 24 on the lower housing. The connector pins/connector pin guide holes guide the upper housing and lower housing in a manner which permits easy coupling of the corresponding interlocking groove(s) and tongue(s). The other ends of each of the connector pins penetrate into the lighting apparatus 32.

Preferably the tips of each connector pin are configured to increase the contact area between the connector pin and a conductive bus of the lighting apparatus, e.g., conductor bus 31*a* or conductor bus 32*a*, as shown in FIG. 6. To achieve this function, the tip can be in the shape of an inverted "V" or "U."

When assembling the connector 10, the pressure caused by the coupling of the interlocking groove(s) 20 and tongue(s) 21, as well as the penetration of one end of each of the connector pins 16 and 17 through the opening gasket 29 and into an encapsulant or protective sheath(es), cover(s) or layer(s) of a lighting apparatus (such as an LED light wire, cable, bar or tube), creates a waterproof seal between the upper housing 12 and lower housing 14, between the opening gasket 29 and the lighting apparatus 31, and, in the case of the T-branch shaped lighting connector device of the first embodiment, between the upper housing 12 and the lighting apparatus 32. Specifically, the upper housing gasket 22 tightly presses onto the corresponding gasket groove 30 and/or lighting apparatus; thereby creating a tight pressure seal. Further, the opening gasket 29 tightly presses the lighting apparatus via pressure insertion of the lighting apparatus into the opening 28, and the penetration of the connector pins 16 and 17 into the lighting apparatus.

Figure 6A:
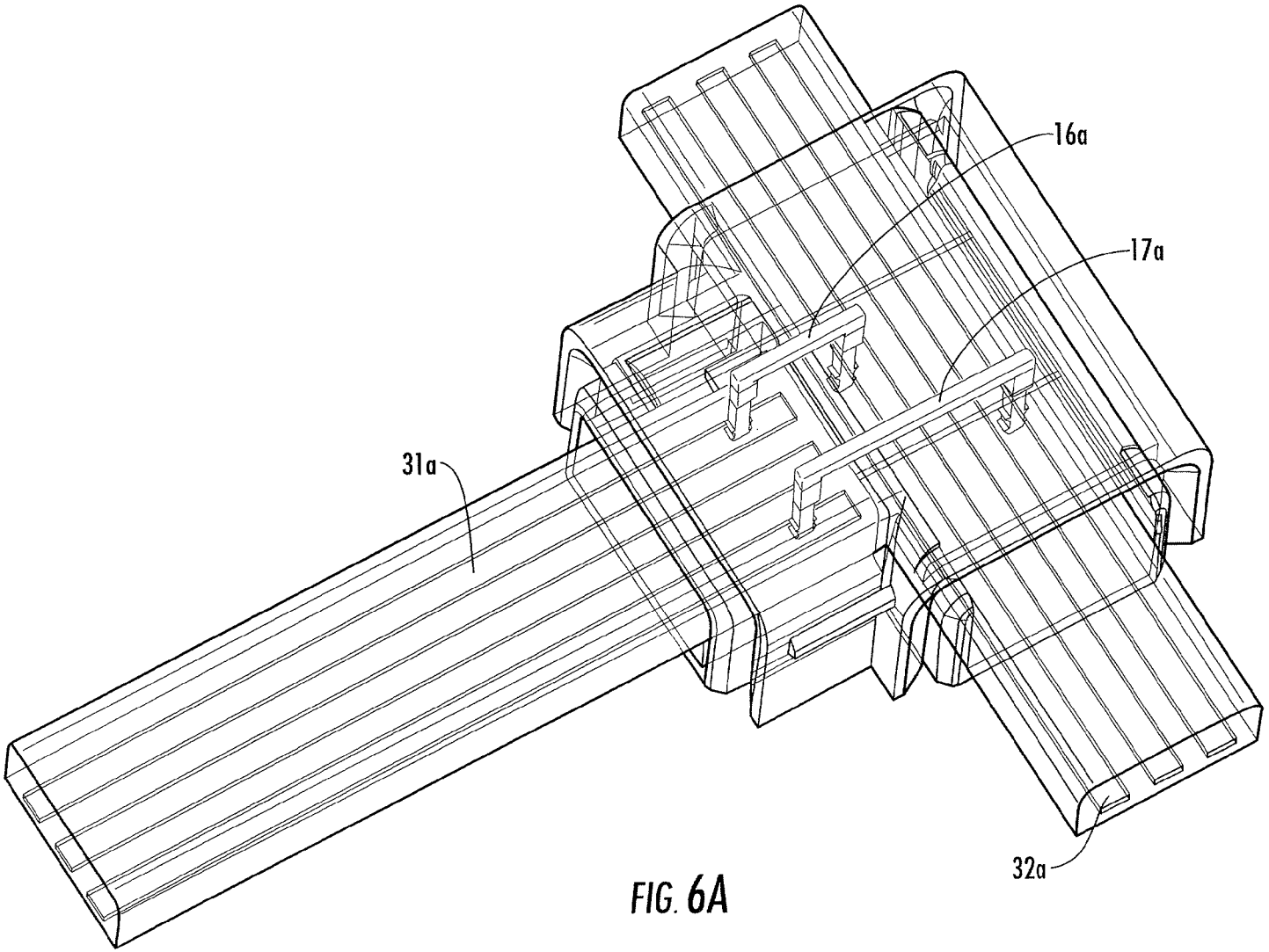
FIGS. 6A and 6B are X-ray views of an assembled T-branch lighting connector in accordance with a first embodiment of the present invention.
Figure 6B:
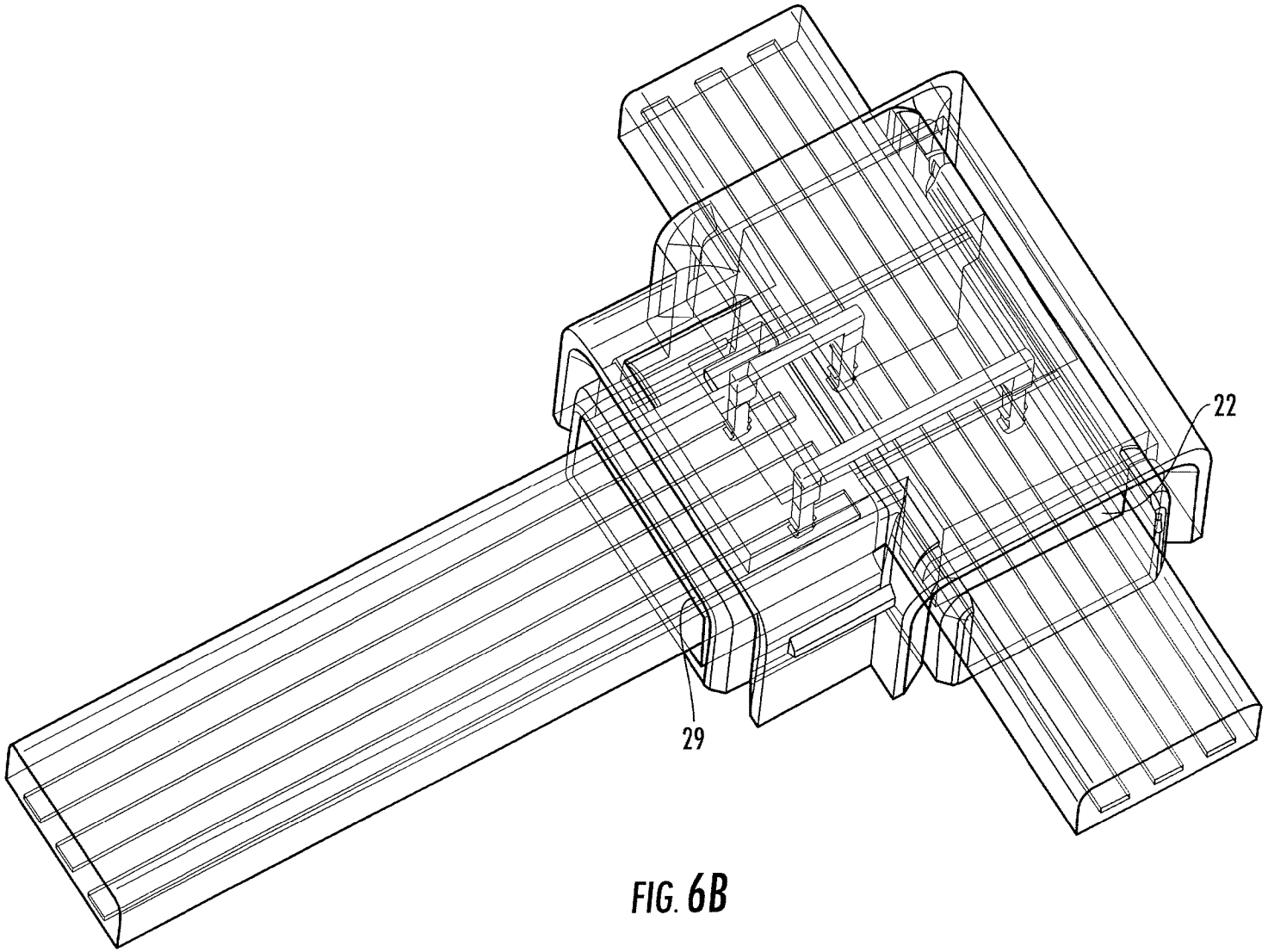
Figure 7:
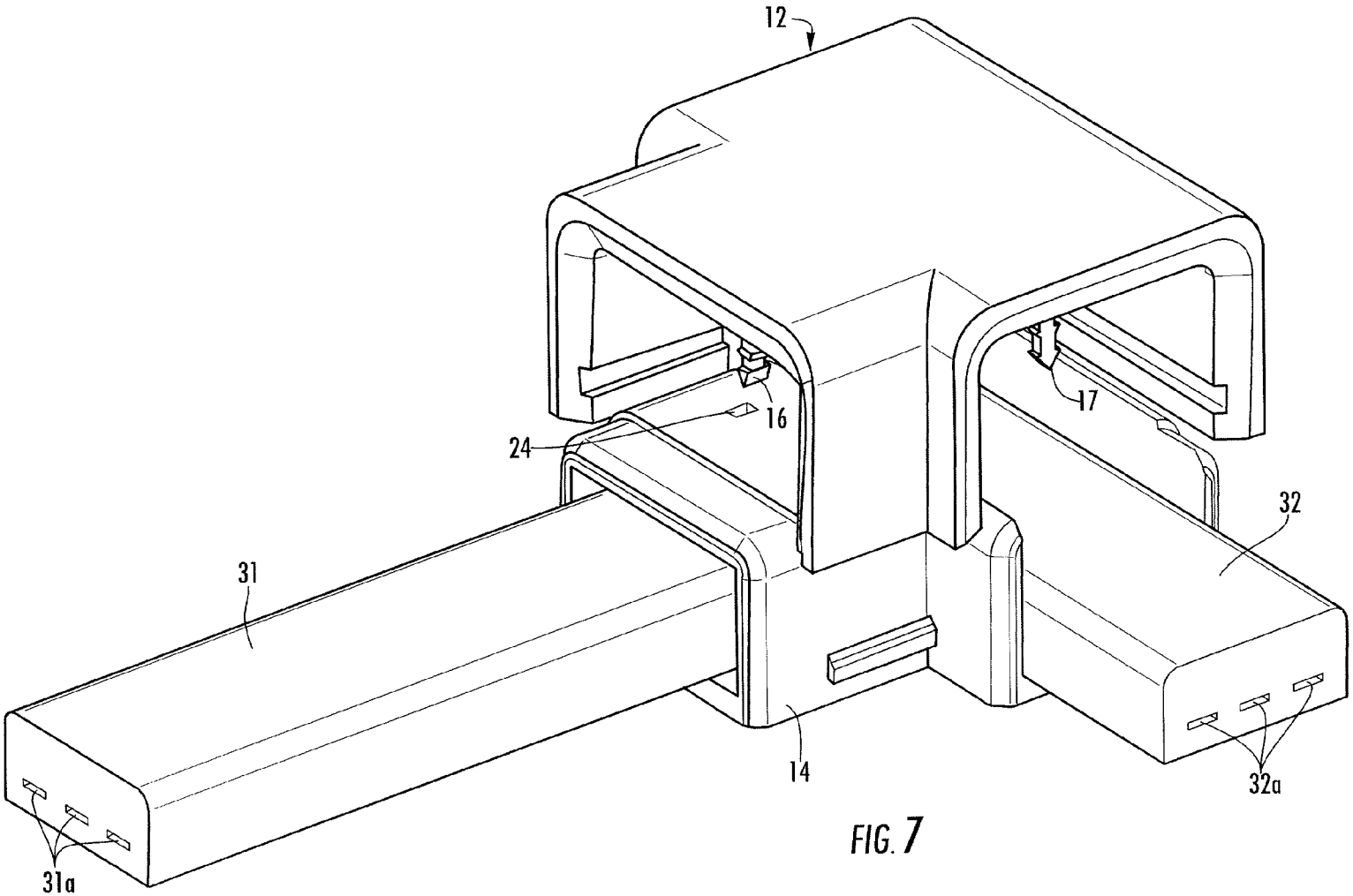
FIG. 7 is a perspective view of a disassembled T-branch lighting connector in accordance with a first embodiment of the present invention showing how lengths of lighting apparatus are connected to the lighting connector.
Figure 8:
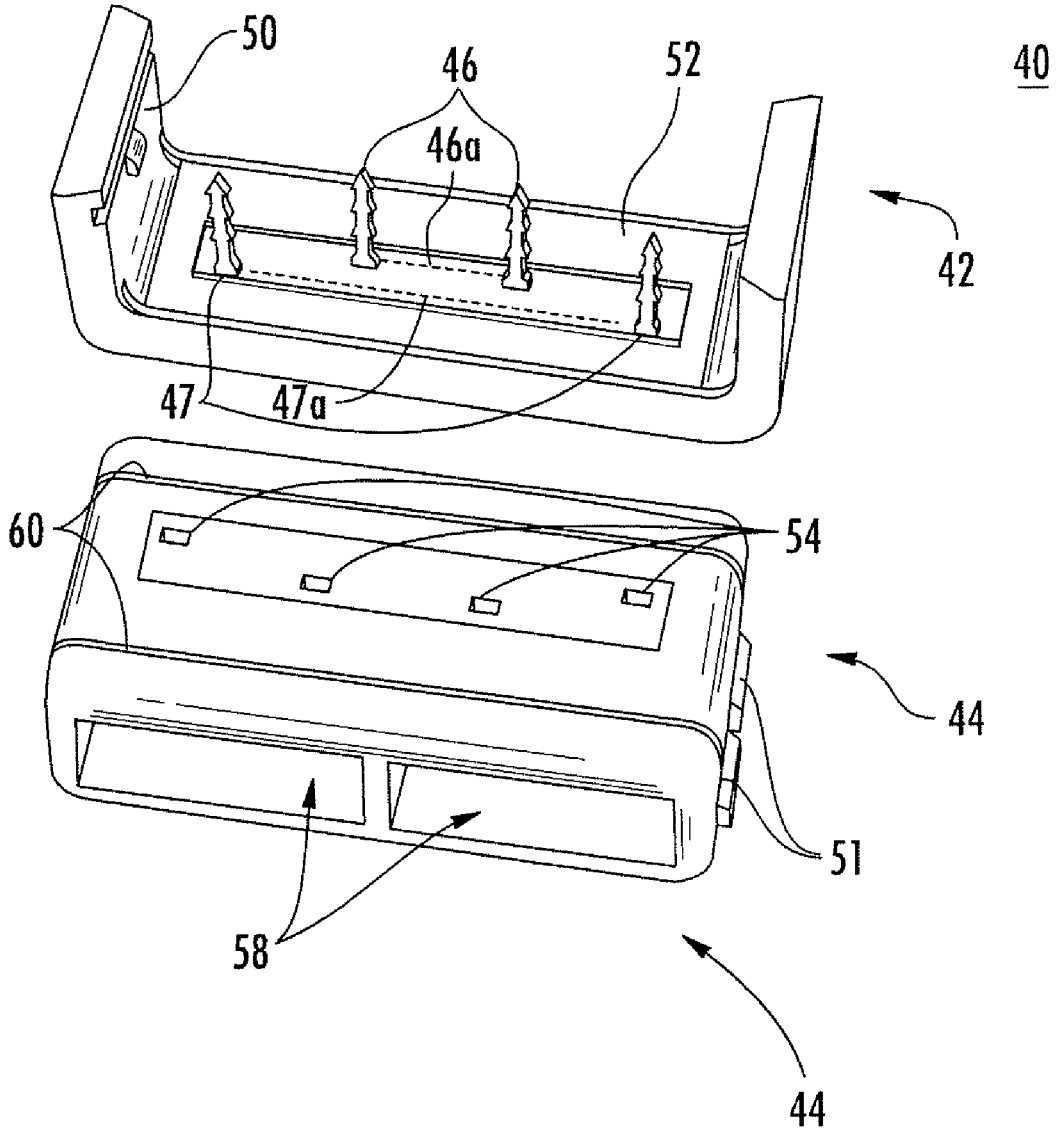
FIG. 8 is a view of a disassembled U-branch lighting connector in accordance with a second embodiment of the present invention.
Figure 9A:
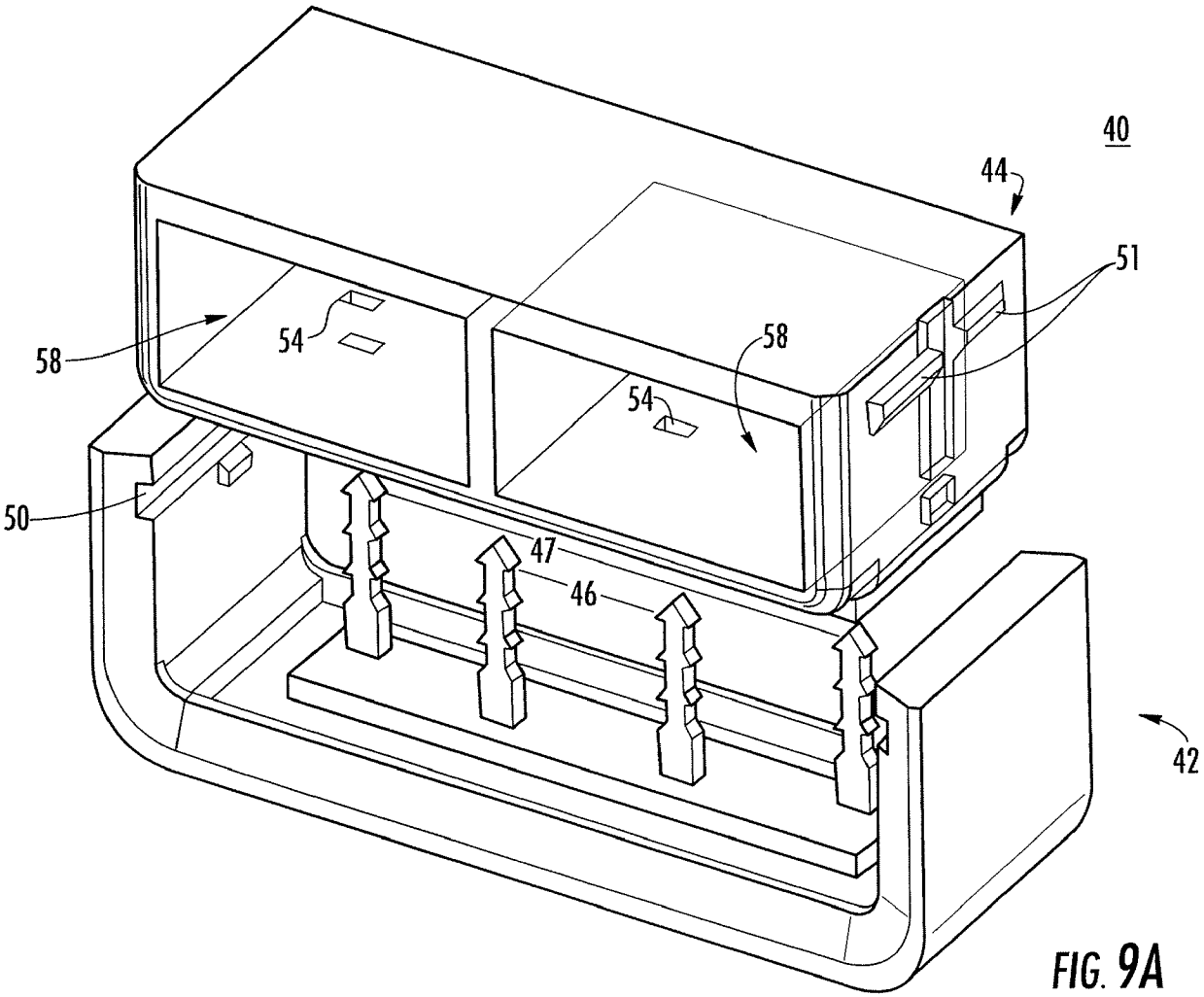
FIGS. 9A and 9B are additional views of a disassembled U-branch lighting connector in accordance with a second embodiment of the present invention.
Figure 9B:
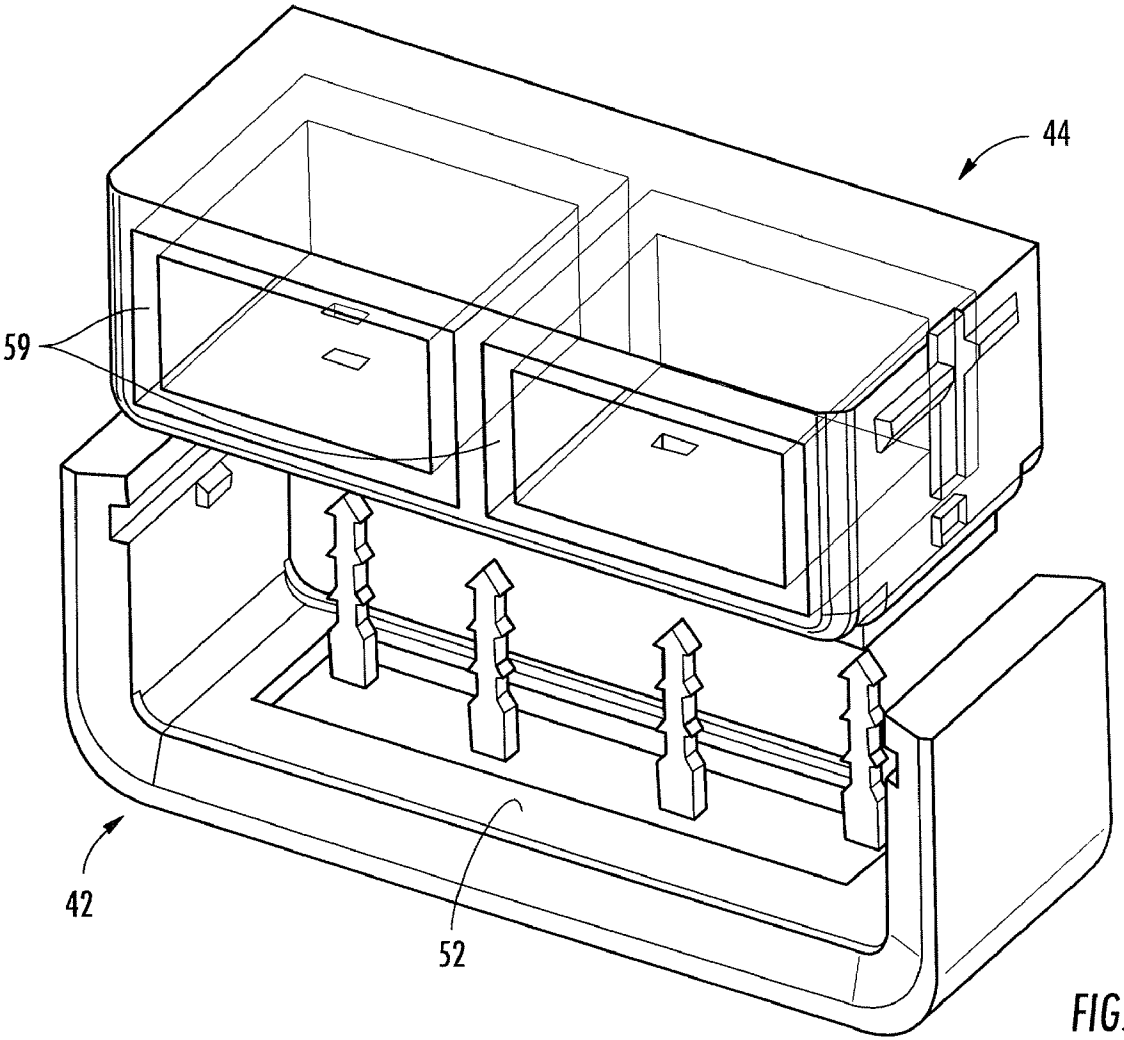
Figure 10:
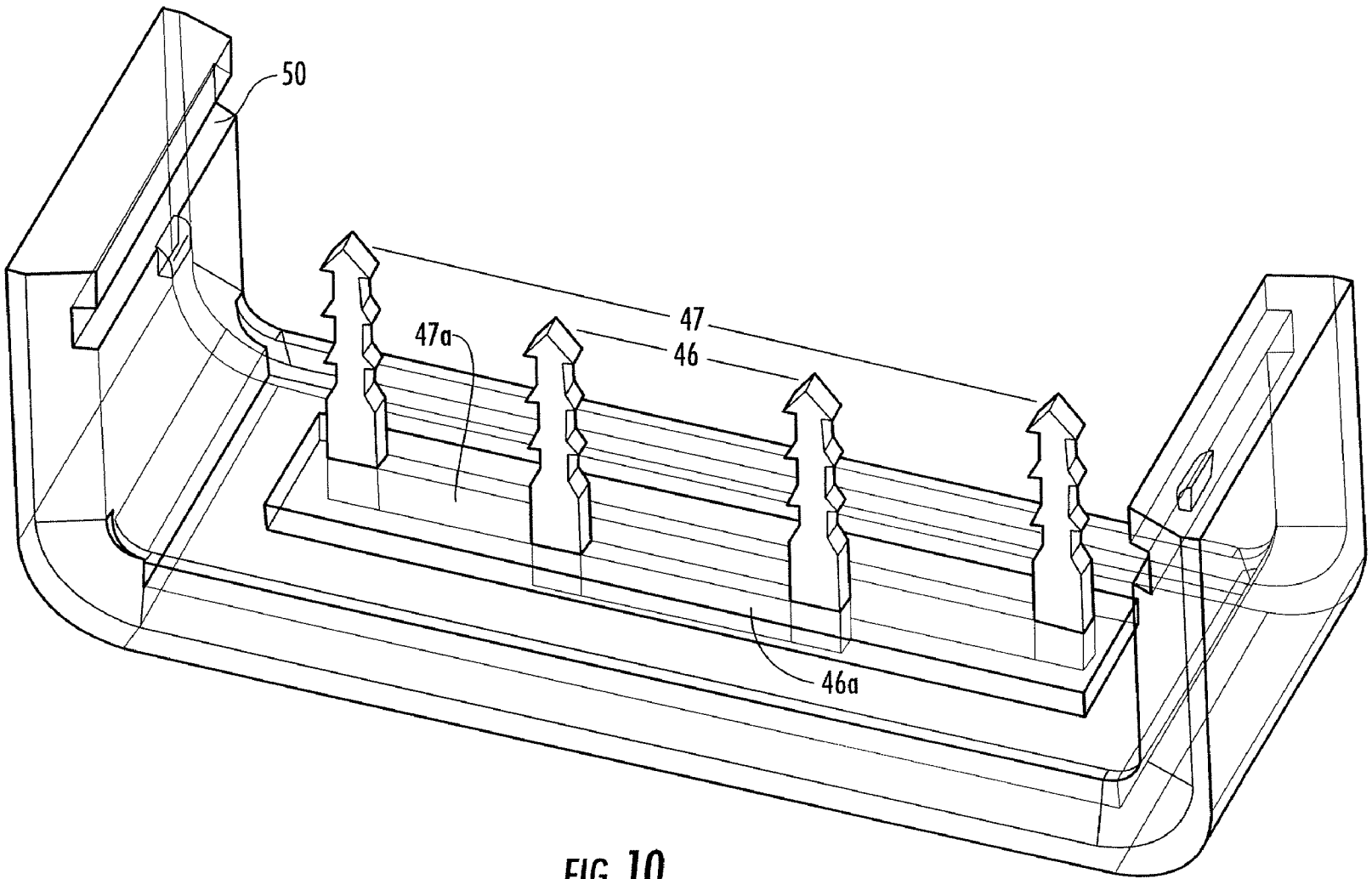
FIG. 10 is an X-ray view of an upper housing in accordance with a second embodiment of the present invention.
Figure 11A:
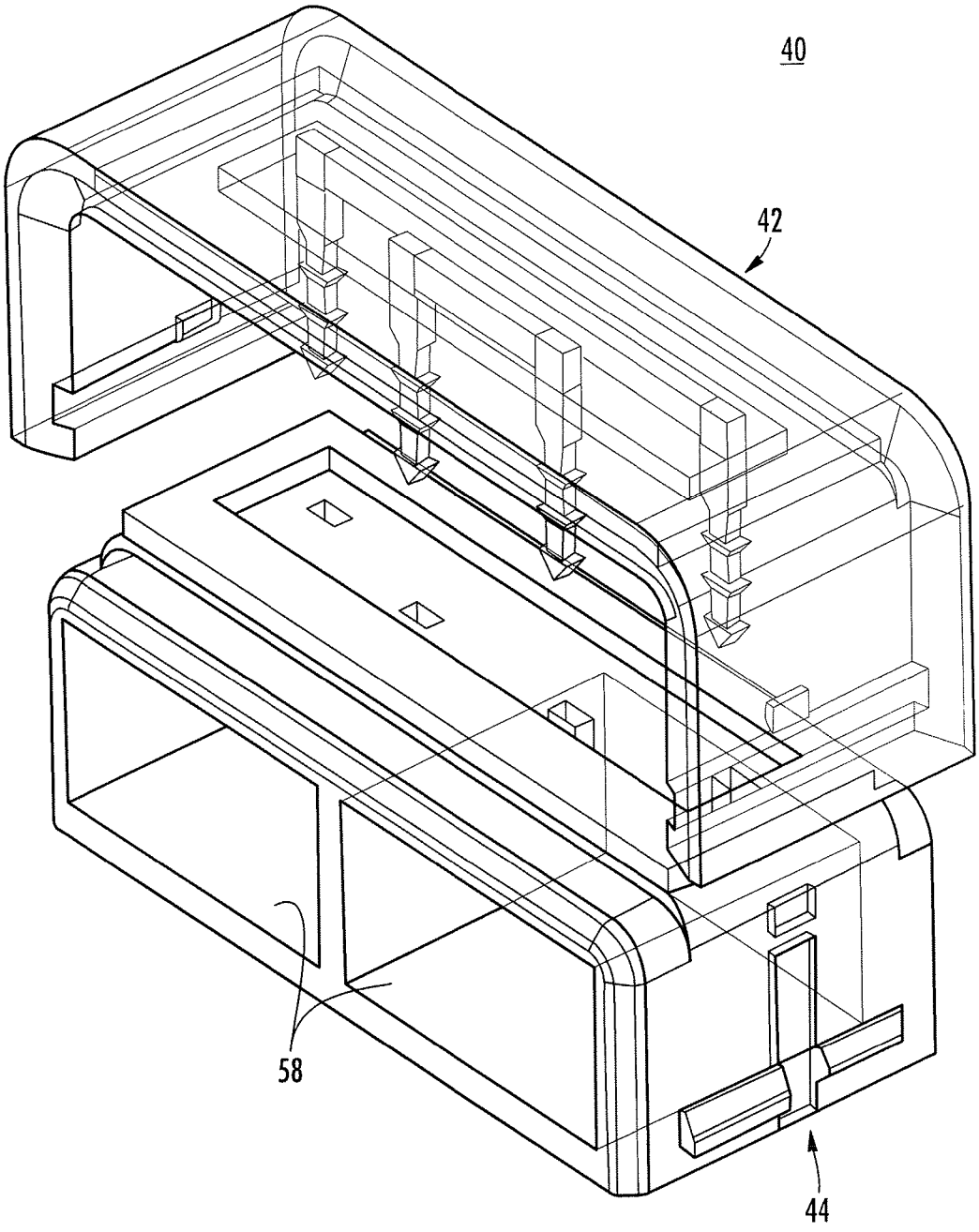
FIGS. 11A and 11B are X-ray views of a disassembled U-branch lighting connector in accordance with a second embodiment of the present invention.
Figure 11B:
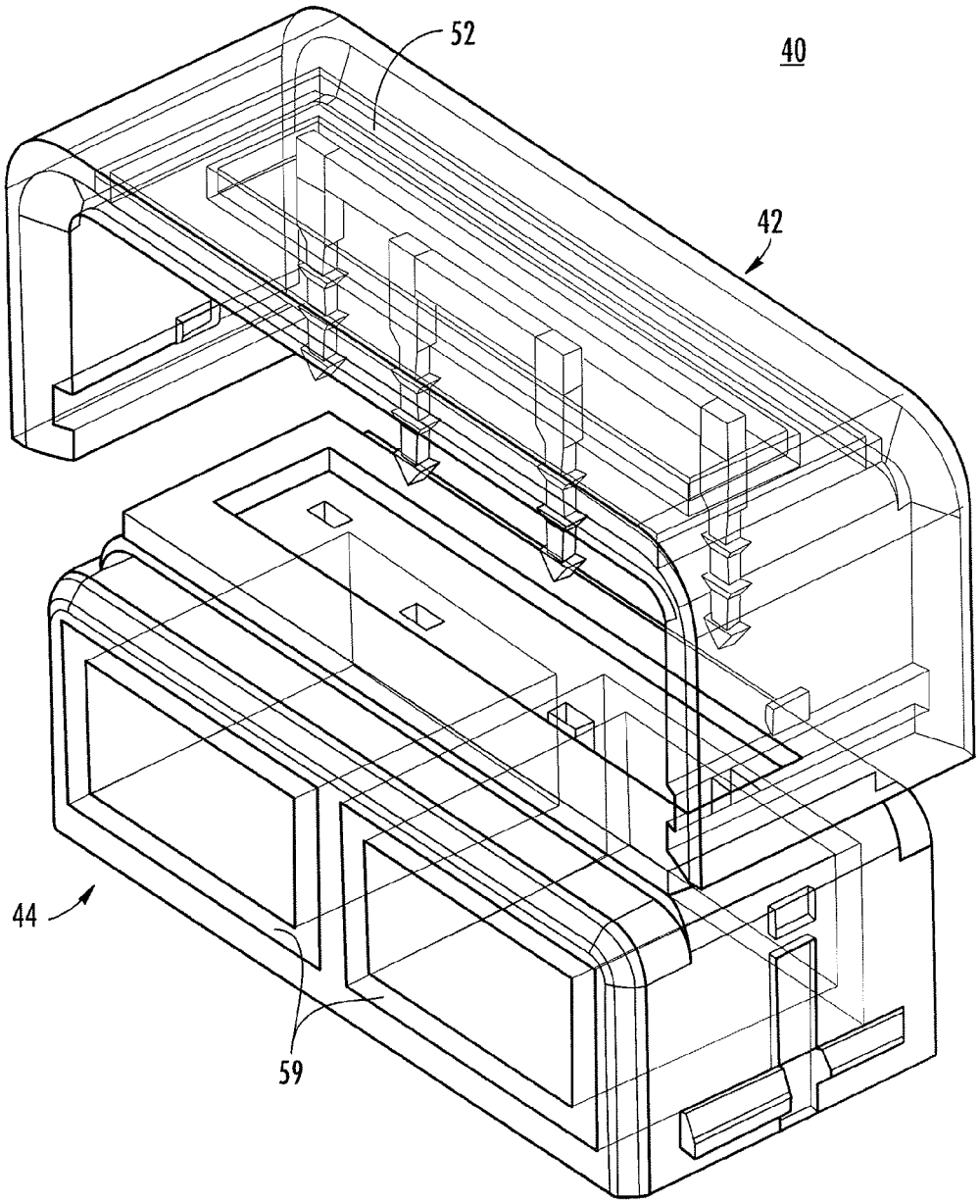

As can be seen in FIGS. 6A, 6B and 7, when the connector is assembled, the connector pins 16 and 17 penetrate through the encapsulant of the lighting apparatuses 31 and 32 to make contact with the conductor buses 31*a* and 32*a*, respectively, causing an electrical connection to be formed between the conductor buses 31*a* and 32*a* to permit an electrical signal and/or power to pass between lighting apparatuses 31 and 32 and securely connecting the lighting apparatuses together.

As shown in FIGS. 8-13, in accordance with a second preferred embodiment, a U-branch lighting connector 40 is formed from an upper housing 42 and a lower housing 44.

The U-branch connector in accordance with the second embodiment works in a substantially similar manner to the T-branch connector 10 described above, except that the U-branch connector is configured to electrically and mechanically connect the ends of a first length 61 and a second length 62 of lighting apparatus, to effectuate a U-turn. As in the first embodiment, connector pins 46 and 47 are provided in the upper housing 42. The pins 46 and 47 have embedded portions 46*a* and 47*a*, respectively formed in the upper housing.

The upper housing includes interlocking groove(s) 50 and a gasket 52. The interlocking groove(s) 50 mate with interlocking tongue(s) 51 in the lower housing 44 to achieve a secure connection, e.g., a snap fit, between the upper and lower housing when the connector is assembled. The gasket 52 is used to ensure a tight fit of the housings when the connector has been assembled. While shown in the figure as being associated with the upper housing 42, the gasket can be provided separately, and placed between the upper and lower housings during assembly of the connector.

The lower housing 44 includes plural connector pin guide holes 54, and openings 58. In the U-branch embodiment, an end portion of a first length of lighting apparatus 61 is inserted into one of the openings 58 and an end portion of a second length of lighting apparatus 62 is inserted into the other one of the openings 58, as can be seen particularly in FIGS. 12 and 13. An opening gasket 59 lines the openings 58 in the lower housing. The lower housing 44 also preferably includes a gasket groove 60. Opening gaskets 59 prevent water leaking between the lower housing 44 and the lighting apparatuses inserted into the openings 58.

To assemble the connector 40, the upper housing 42 is coupled with the lower housing 44 via the corresponding interlocking groove(s) 50 and tongue(s) 51. When pressing the upper housing 42 and the lower housing 44 together, the connector pins 46 and 47 on the upper housing are matched with their corresponding connector pin guide holes 54 on the lower housing. The connector pins/connector pin guide holes guides the upper housing and lower housing in a manner which permits easy coupling of the corresponding interlocking groove(s) and tongue(s).

Figure 13:
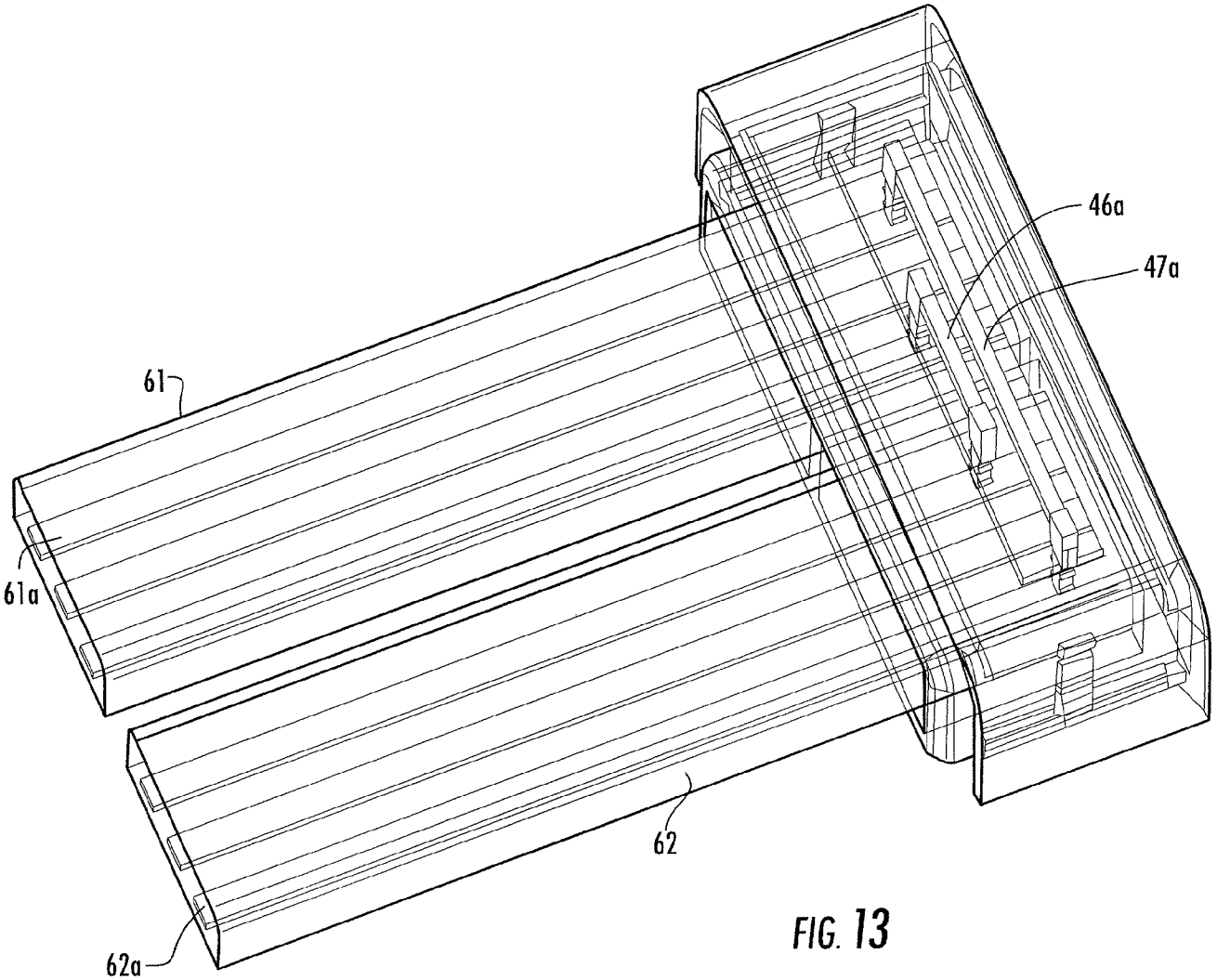
FIG. 13 is an X-ray view of an assembled U-branch lighting connector in accordance with a second embodiment of the present invention.
Figure 14A:
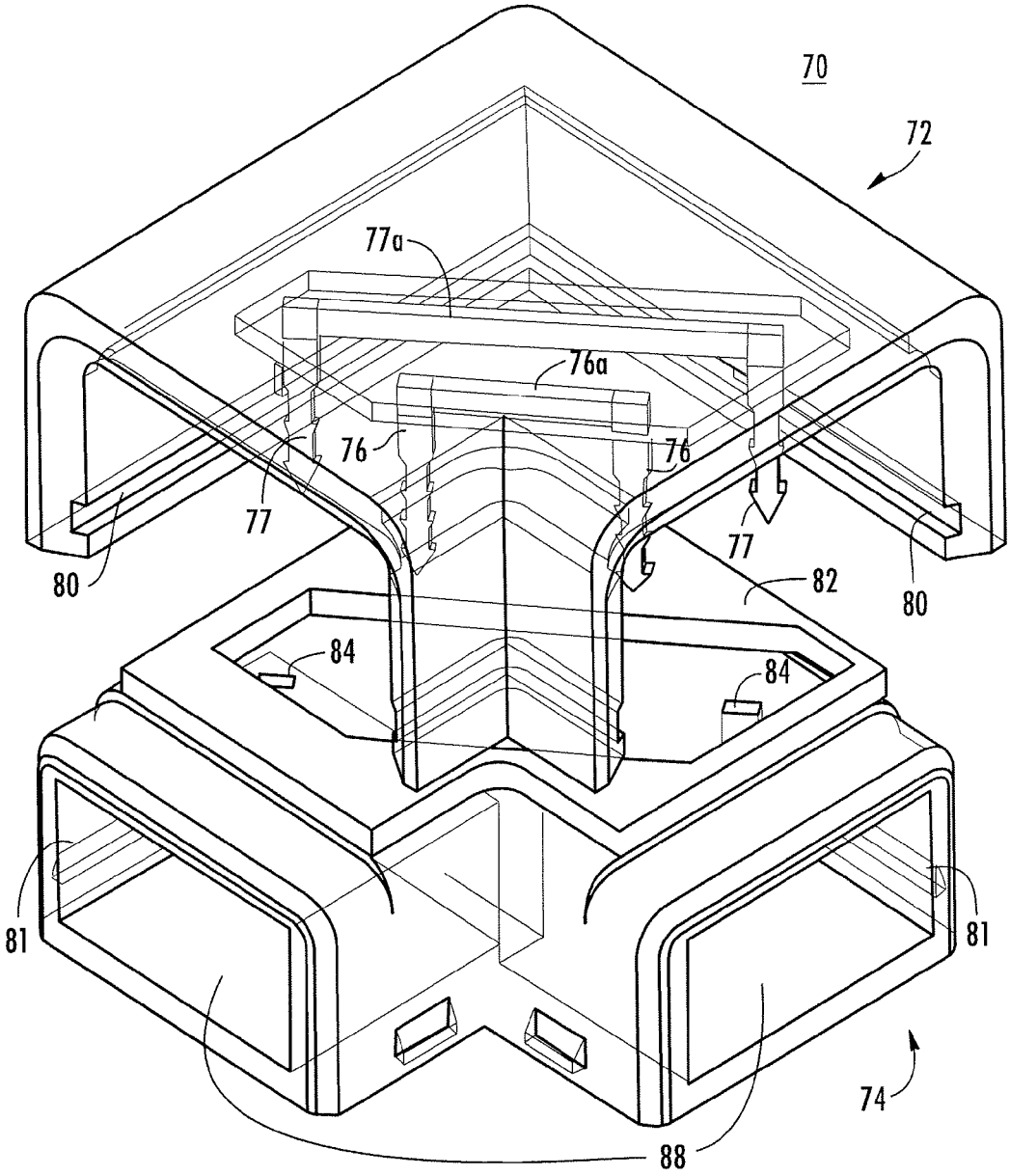
FIGS. 14A, 14B and 15 are X-ray views of a disassembled L-branch lighting connector in accordance with a third embodiment of the present invention.
Figure 14B:
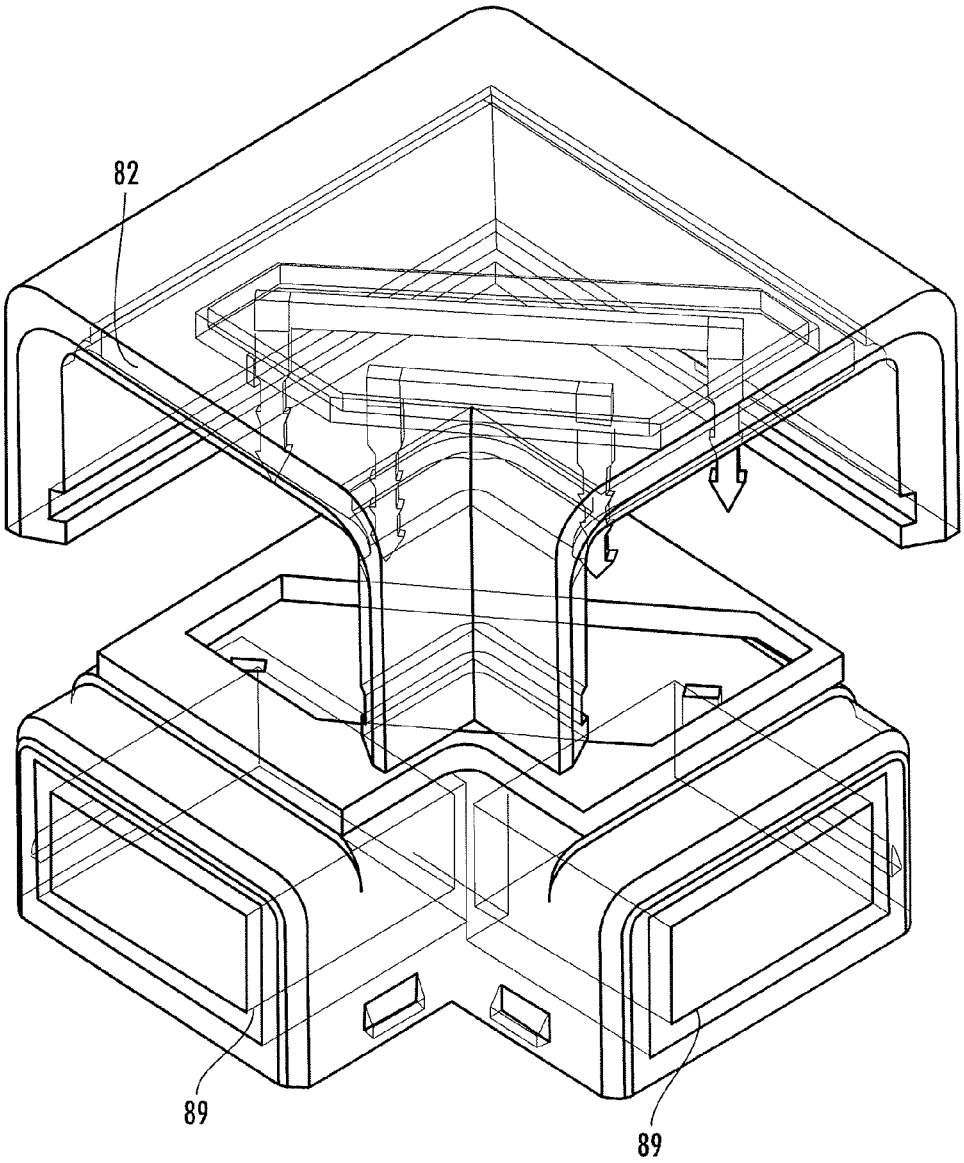
Figure 15:
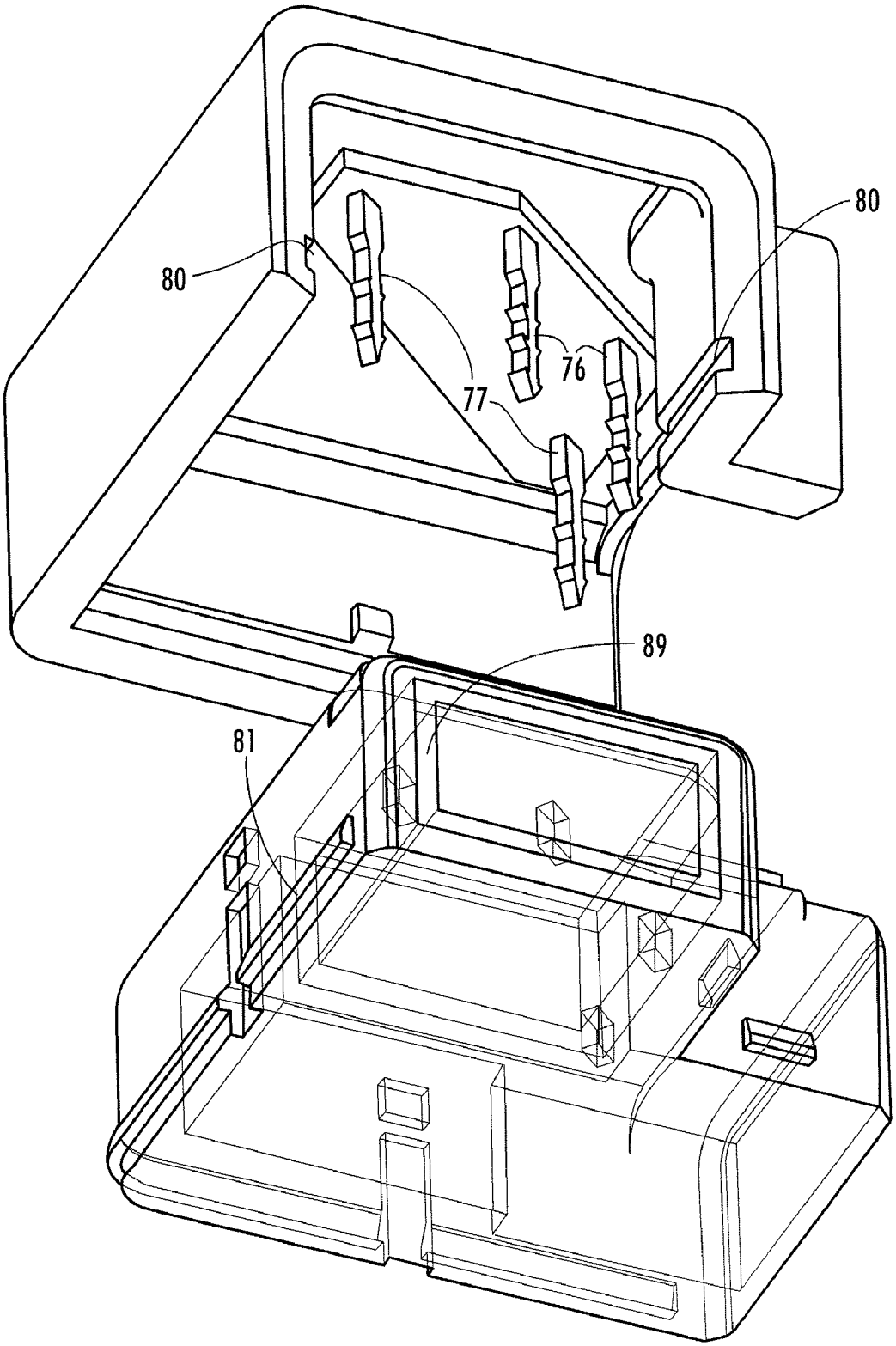
Figure 16:
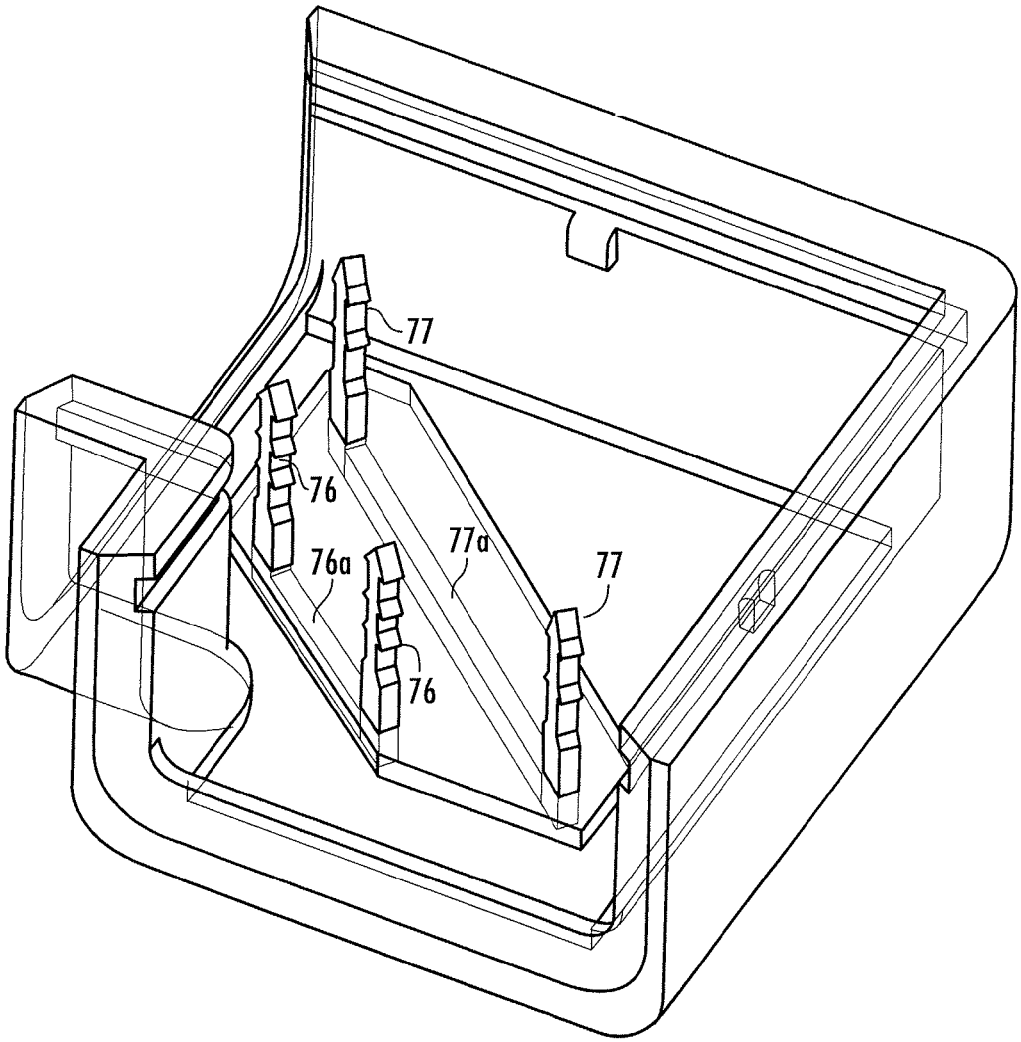
FIG. 16 is an X-ray view of an upper housing in accordance with a third embodiment of the present invention.
Figure 17:
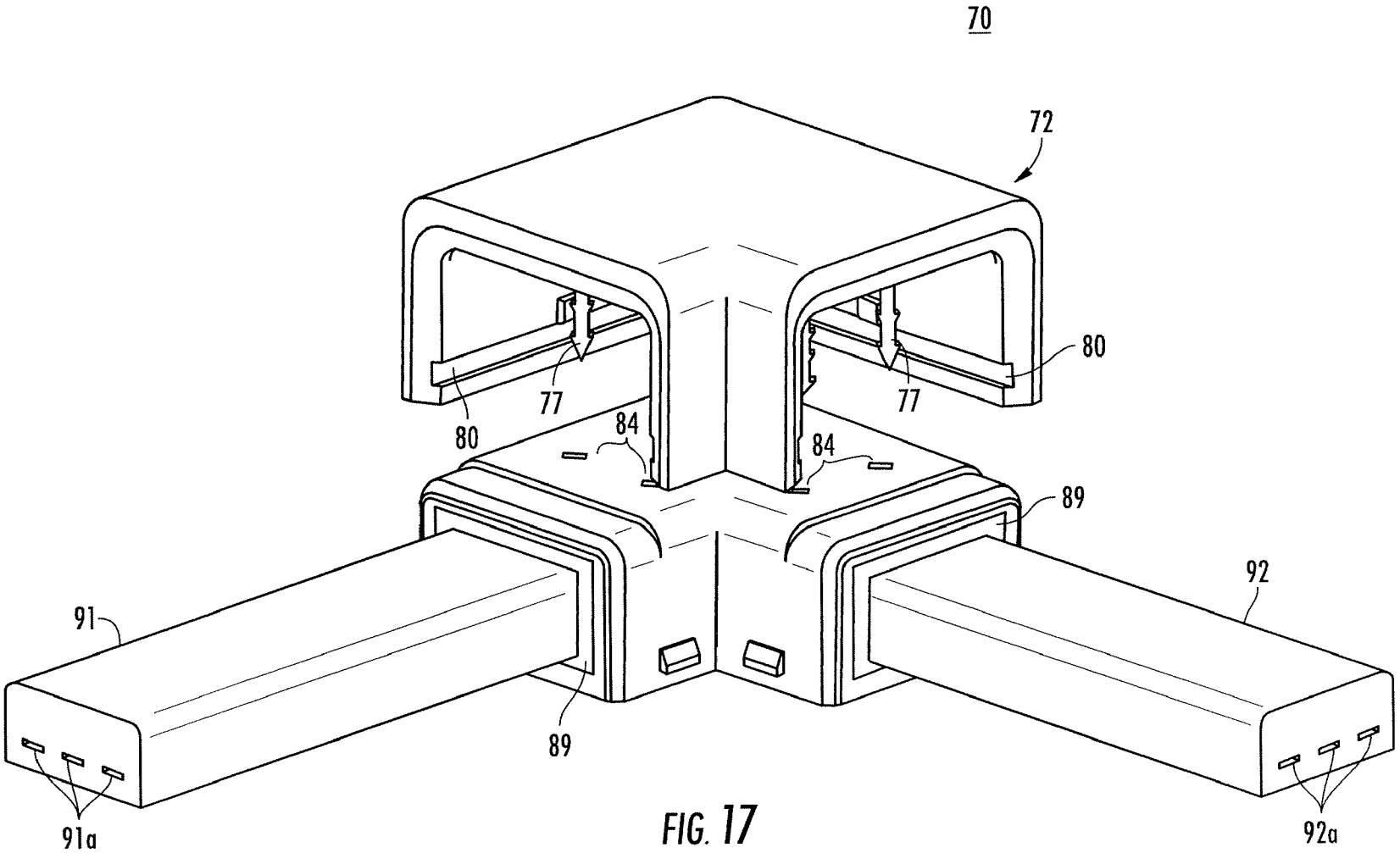
FIG. 17 is a perspective view of a disassembled L-branch lighting connector in accordance with a third embodiment of the present invention showing how lengths of lighting apparatus are connected to the lighting connector.

Preferably the tips of each connector pin are configured to increase the contact area between the connector pin and a conductive bus of the lighting apparatus, e.g., conductor bus 61*a* or conductor bus 62*a*, as shown in FIG. 13. To achieve this function, the tip can be in the shape of an inverted "V" or "U."

When assembling the connector 40, the pressure caused by the coupling of the interlocking groove(s) 50 and tongue(s) 51, as well as the penetration of the connector pins 46 and 47 through the opening gaskets 59 and into an encapsulant or protective sheath(es), cover(s) or layer(s) of a lighting apparatus (such as an LED light wire, cable, bar or tube), creates a waterproof seal between the upper housing 42 and lower housing 44, and between the opening gaskets 59 and the lighting apparatuses. Specifically, the upper housing gasket 52 tightly presses onto the corresponding gasket groove 60, thereby creating a tight pressure seal. Further, the opening gaskets 59 tightly press the lighting apparatuses via pressure insertion of the lighting apparatus into the openings 58, and the penetration of the connector pins 46 and 47 into the lighting apparatus.

Figure 12:
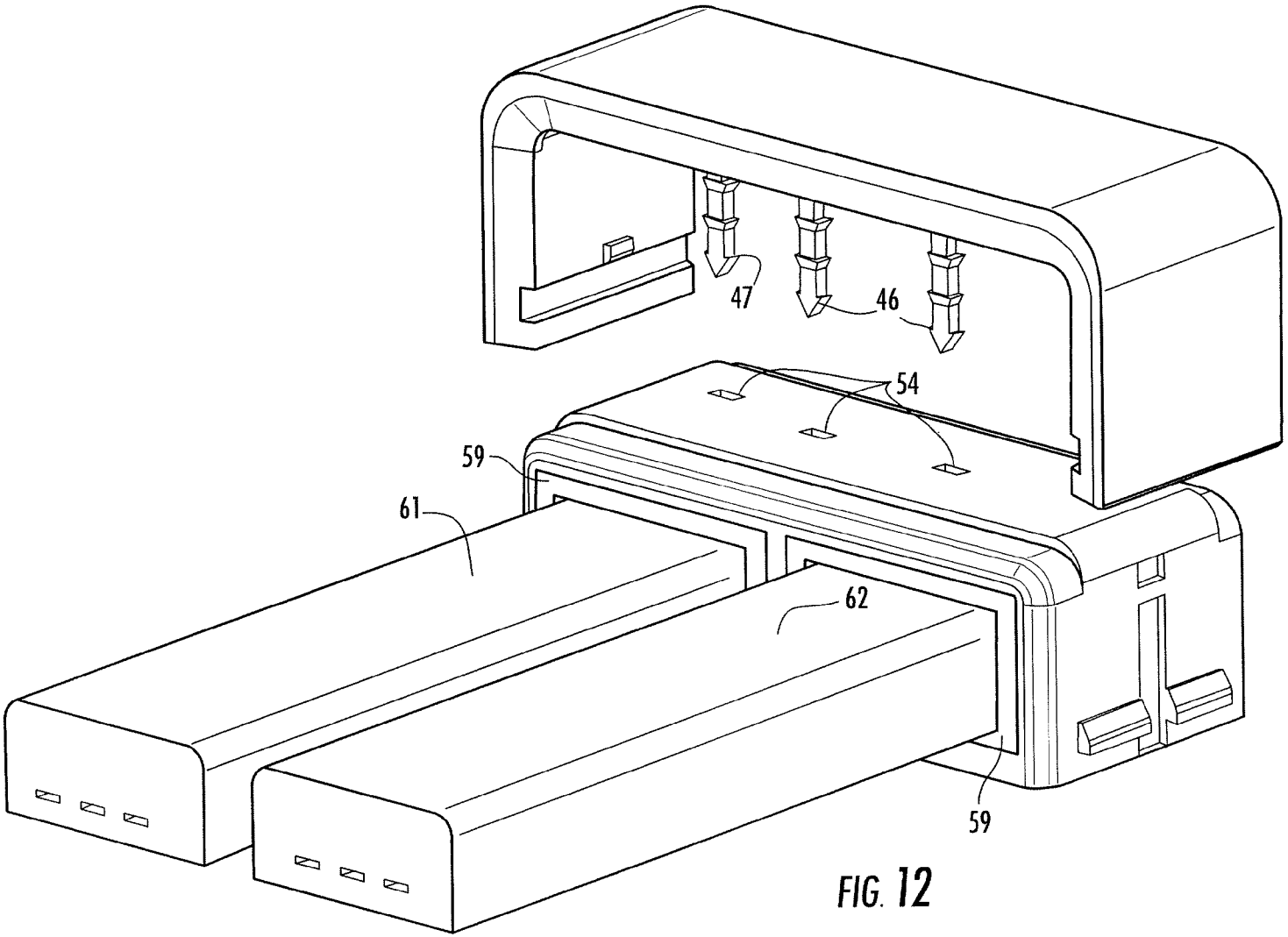
FIG. 12 is a perspective view of a disassembled U-branch lighting connector in accordance with a second embodiment of the present invention showing how lengths of lighting apparatus are connected to the lighting connector.

As can be seen in FIGS. 12 and 13, when the connector is assembled, the connector pins 46 and 47 penetrate through the encapsulant of the lighting apparatuses 61 and 62 to make contact with the conductor buses 61*a* and 62*a*, respectively, causing an electrical connection to be formed between the conductor buses 61*a* and 62*a* to permit an electrical signal and/or power to pass between lighting apparatuses 61 and 62 and securely connecting the lighting apparatuses together.

As shown in FIGS. 14-18B, in accordance with a third preferred embodiment, an L-branch lighting connector 70 is formed from an upper housing 72 and a lower housing 74.

The L-branch connector 70 in accordance with the third embodiment works in a substantially similar manner to the U-branch connector 40 described above, except that the L-branch connector 70 is configured to electrically and mechanically connect the ends of a first length 91 and a second length 92 of lighting apparatus, to effectuate a right angle connection. As in the first and second embodiments, connector pins 76 and 77 are provided in the upper housing 72. The pins 76 and 77 have embedded portions 76*a* and 77*a*, respectively formed in the upper housing.

The upper housing includes interlocking groove(s) 80. The interlocking groove(s) 80 mate with interlocking tongue(s) 81 in the lower housing 74 to achieve a secure connection, e.g., a snap fit, between the upper and lower housing when the connector is assembled. A gasket 82 is provided between the upper and lower housings and is used to ensure a tight fit of the housings when the connector has been assembled.

The lower housing 74 includes plural connector pin guide holes 84, and openings 88. In the L-branch embodiment, an end portion of a first length of lighting apparatus 91 is inserted into one of the openings 88 and an end portion of a second length of lighting apparatus 92 is inserted into the other one of the openings 88, as can be seen particularly in FIGS. 17, 18A and 18B. An opening gasket 89 lines the openings 88 in the lower housing. Opening gaskets 89 prevent water leaking between the lower housing 74 and the lighting apparatuses inserted into the openings 88.

To assemble the connector 70, the upper housing 72 is coupled with the lower housing 74 via the corresponding interlocking groove(s) 80 and tongue(s) 81. When pressing the upper housing 72 and the lower housing 74 together, the connector pins 76 and 77 on the upper housing are matched with their corresponding connector pin guide holes 84 on the lower housing. The connector pins/connector pin guide holes guides the upper housing and lower housing in a manner which permits easy coupling of the corresponding interlocking groove(s) and tongue(s).

Figure 18A:
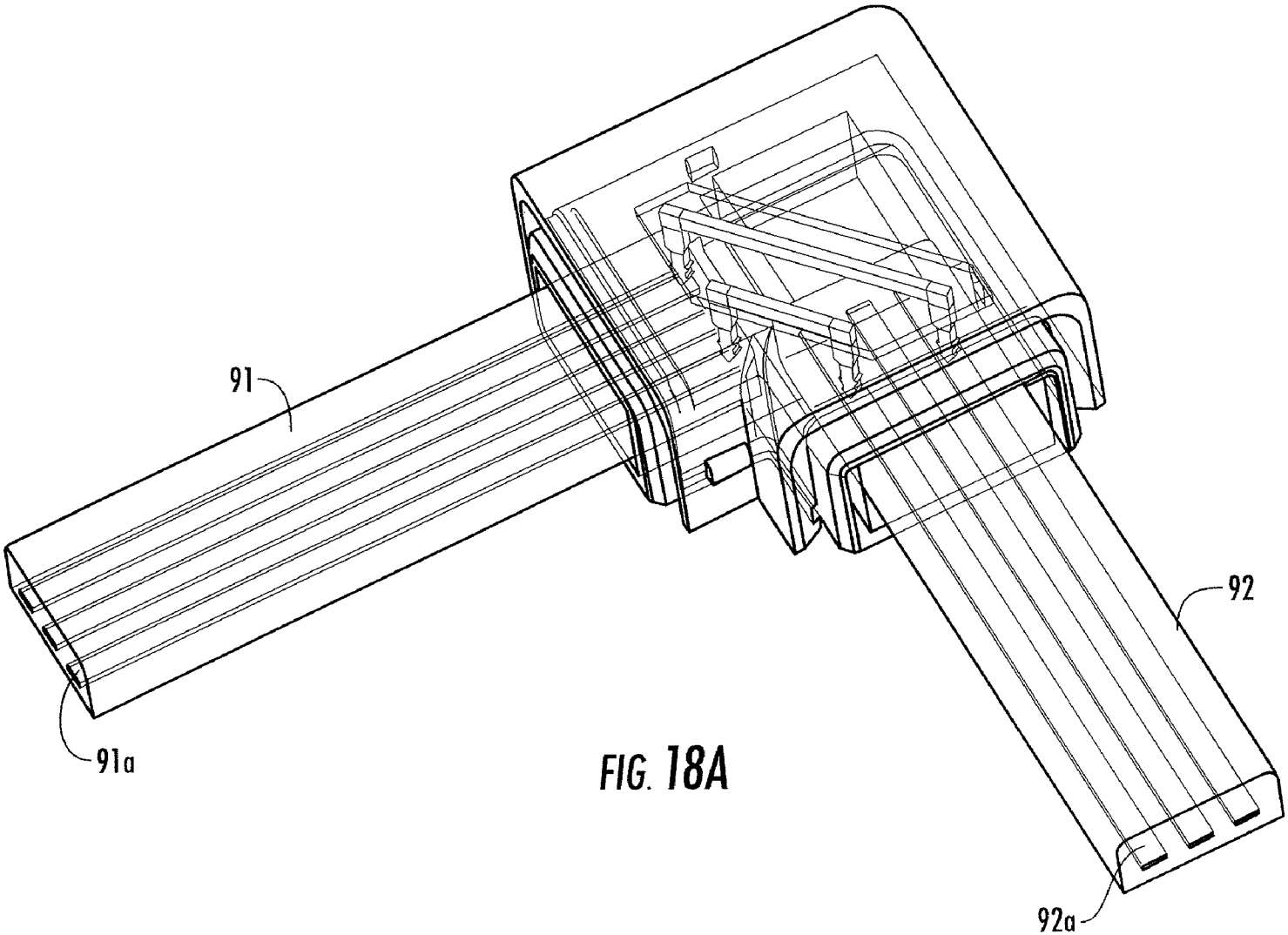
FIGS. 18A and 18B are X-ray views of an assembled L-branch lighting connector in accordance with a third embodiment of the present invention.
Figure 18B:
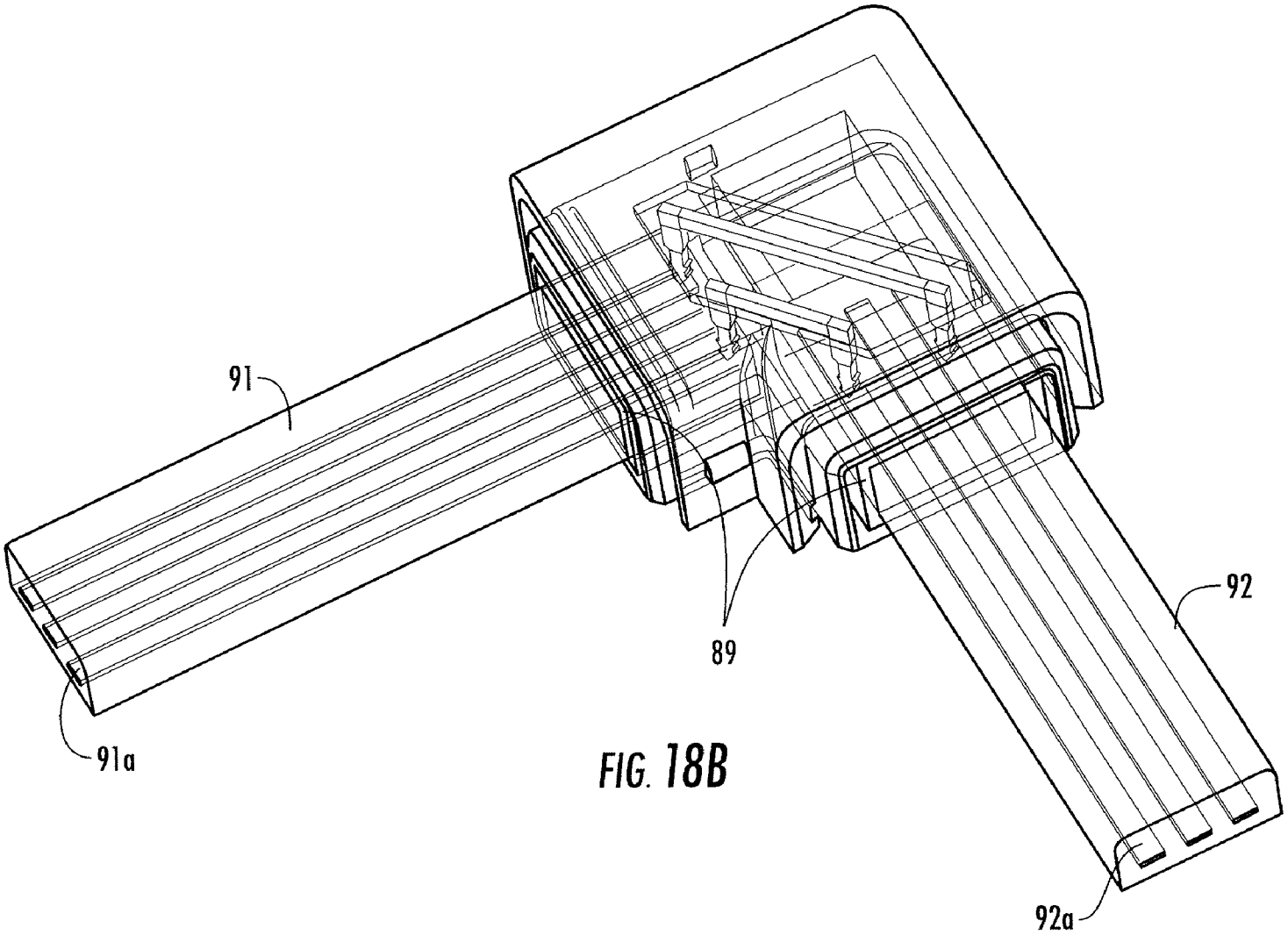
Figure 19A:
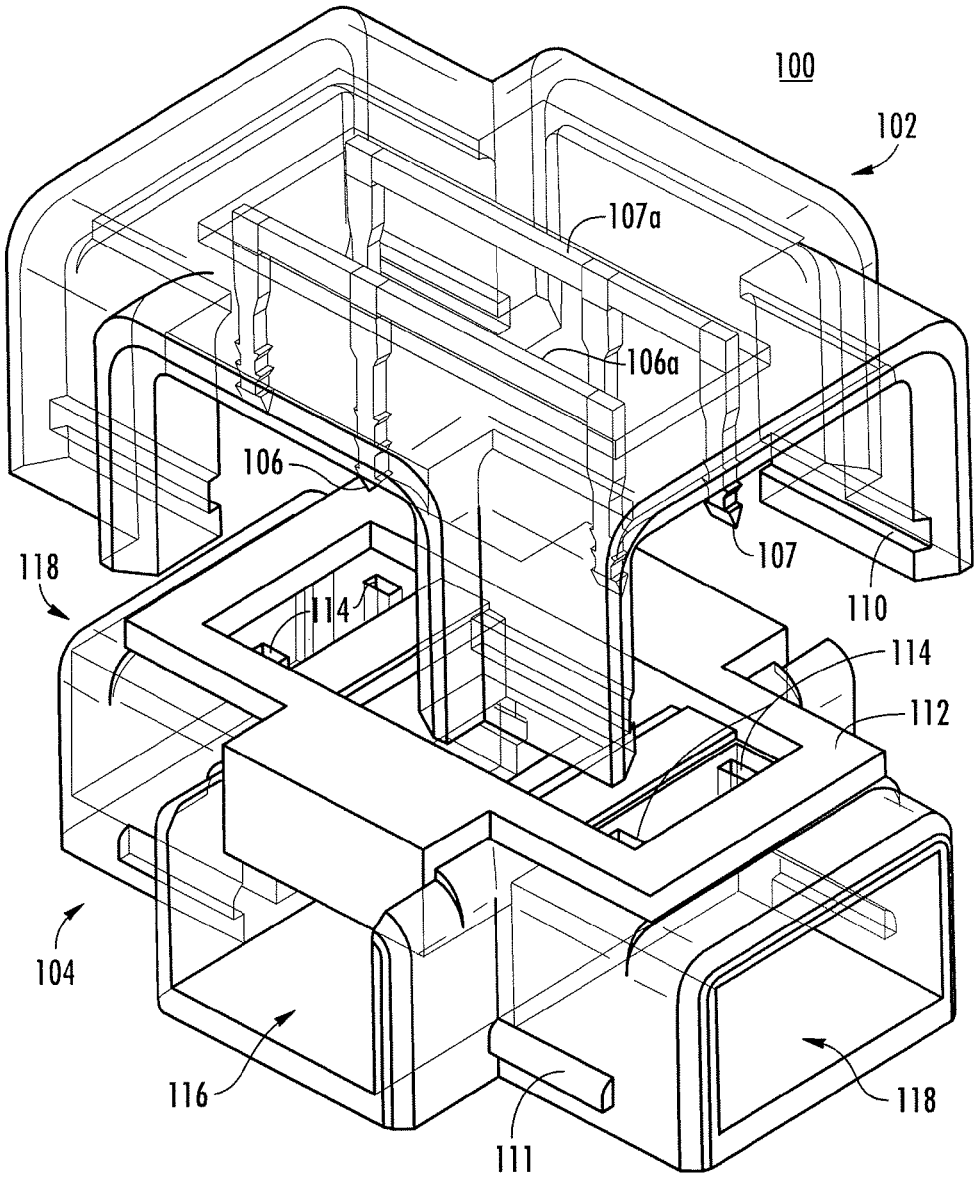
FIGS. 19A, 19B and 20 are X-ray views of a disassembled X-branch lighting connector in accordance with a fourth embodiment of the present invention.
Figure 19B:
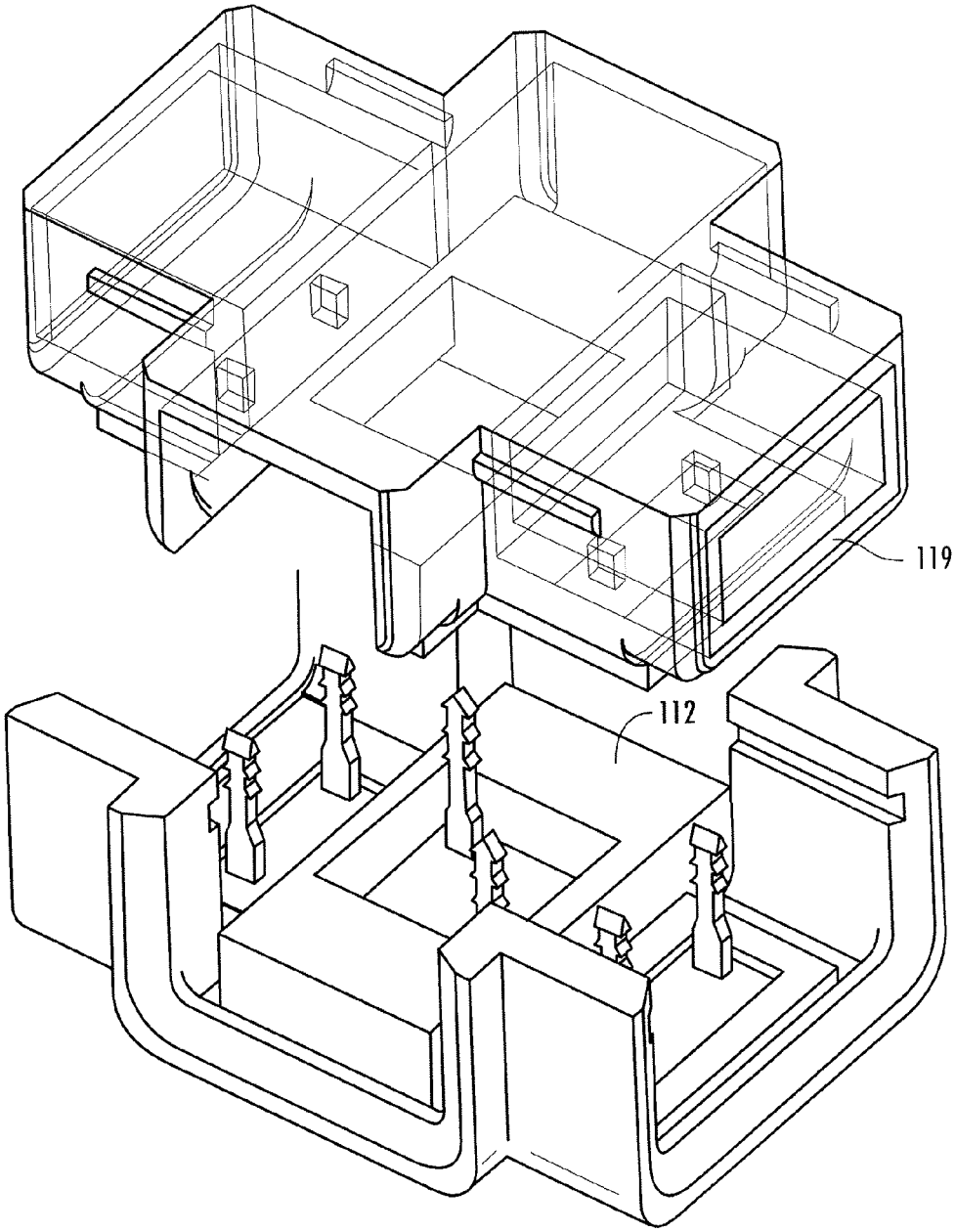
Figure 20:
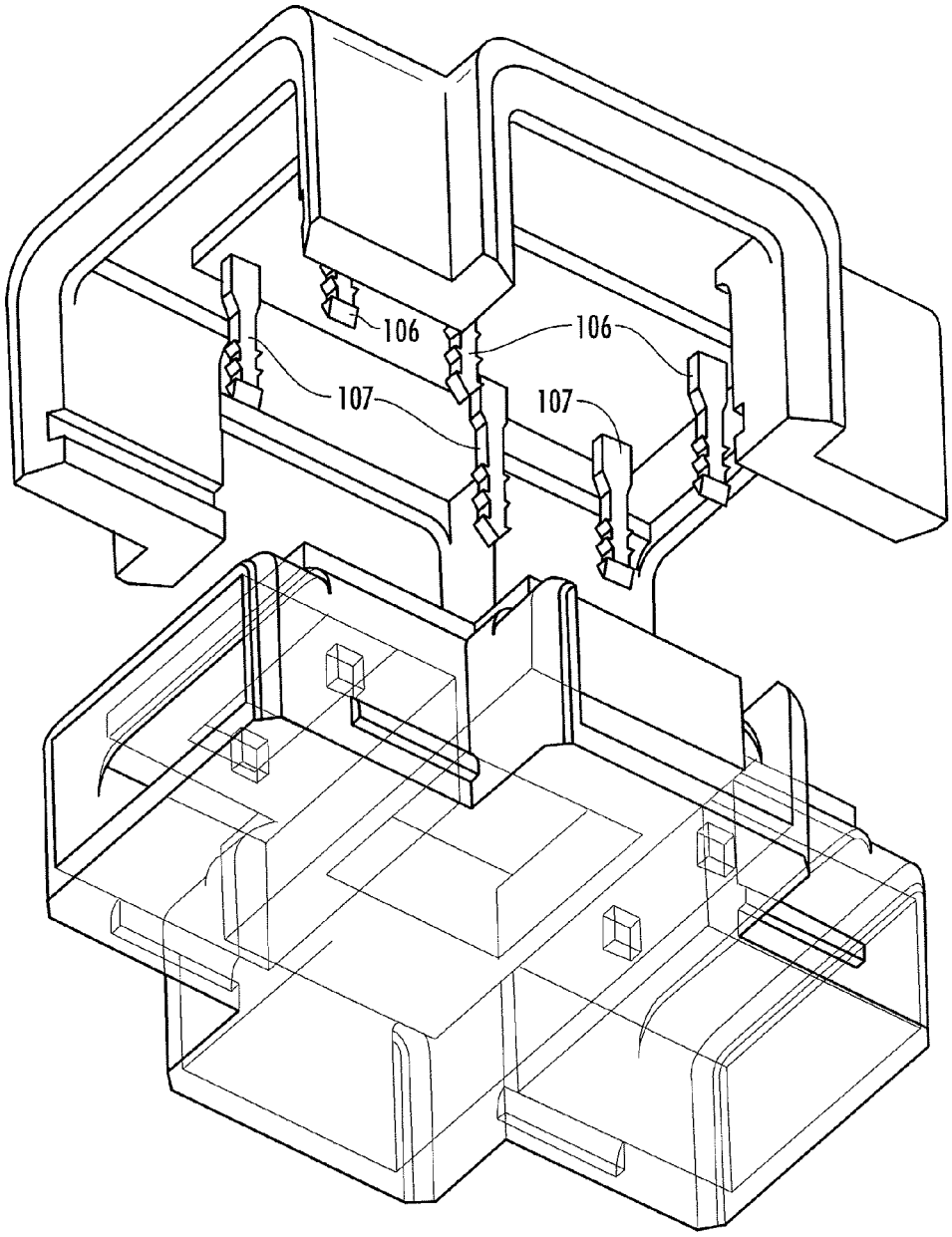
Figure 21:
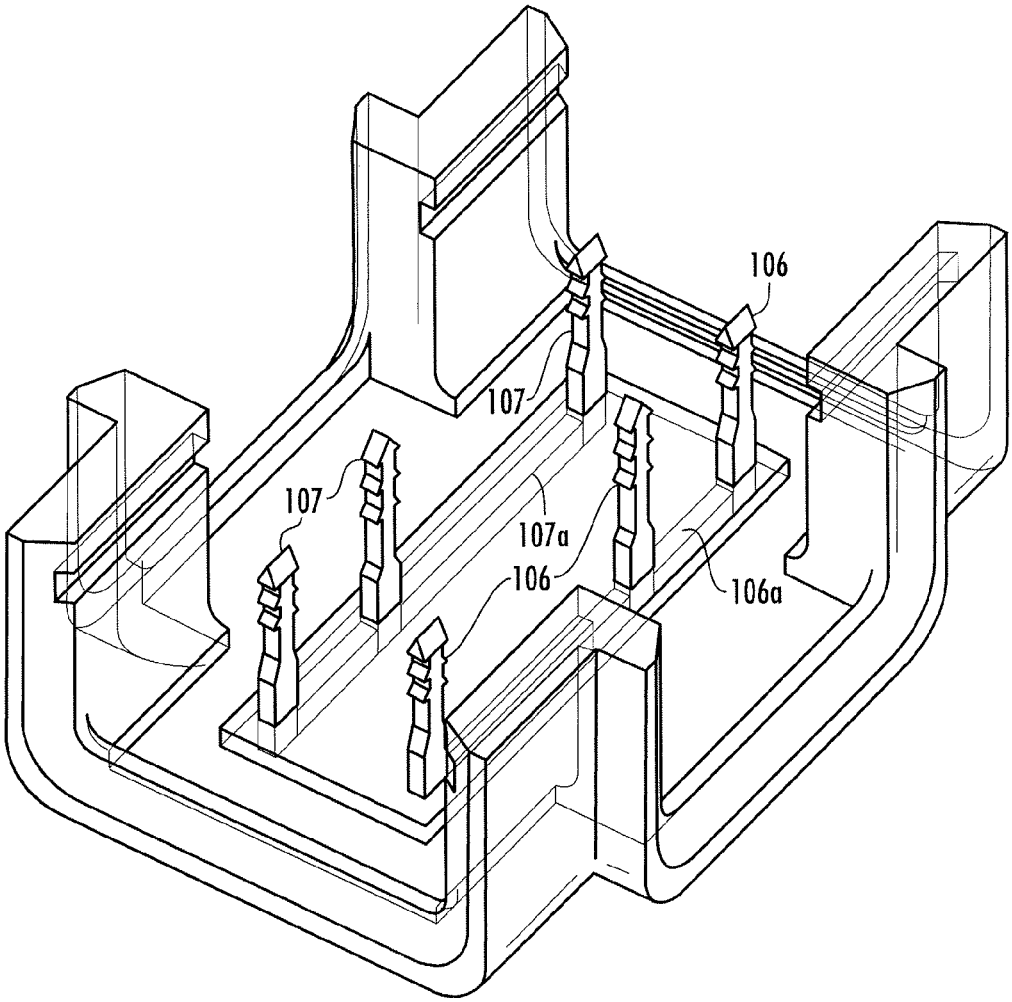
FIG. 21 is an X-ray view of an upper housing in accordance with a fourth embodiment of the present invention.
Figure 22A:
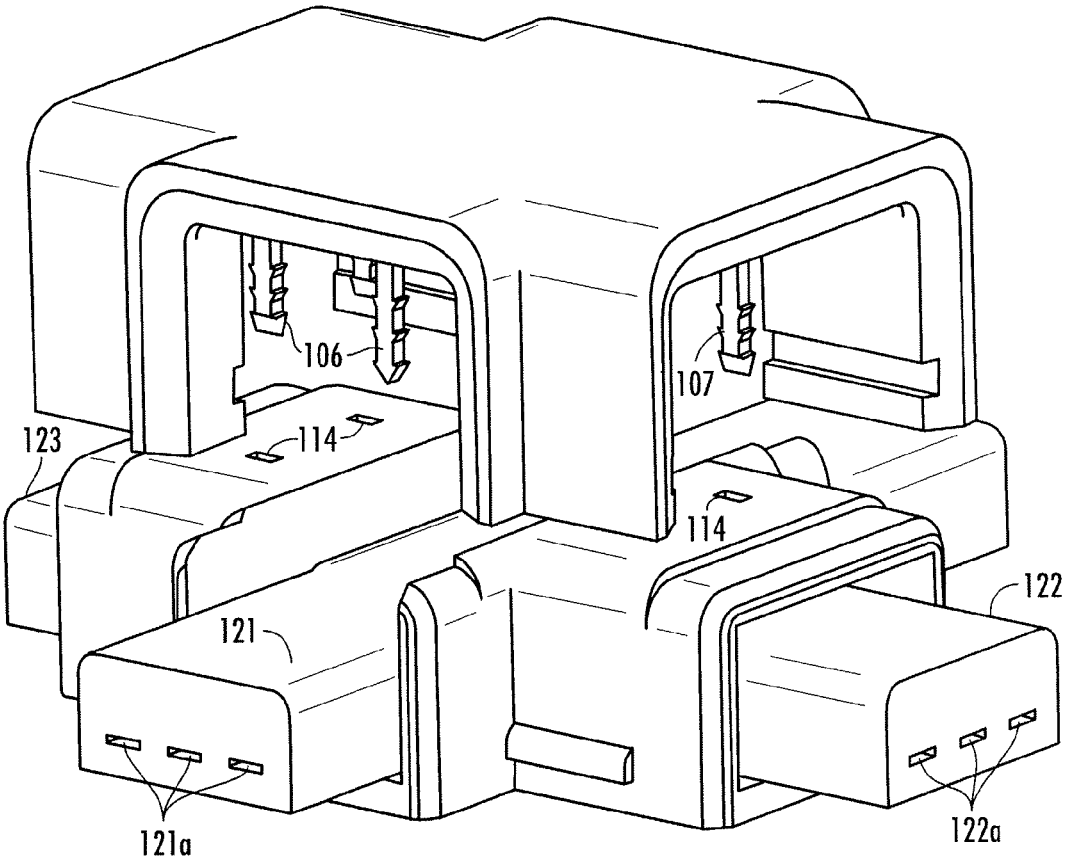
FIGS. 22A and 22B are perspective views of a disassembled X-branch lighting connector in accordance with a fourth embodiment of the present invention showing how lengths of lighting apparatus are connected to the lighting connector.
Figure 22B:
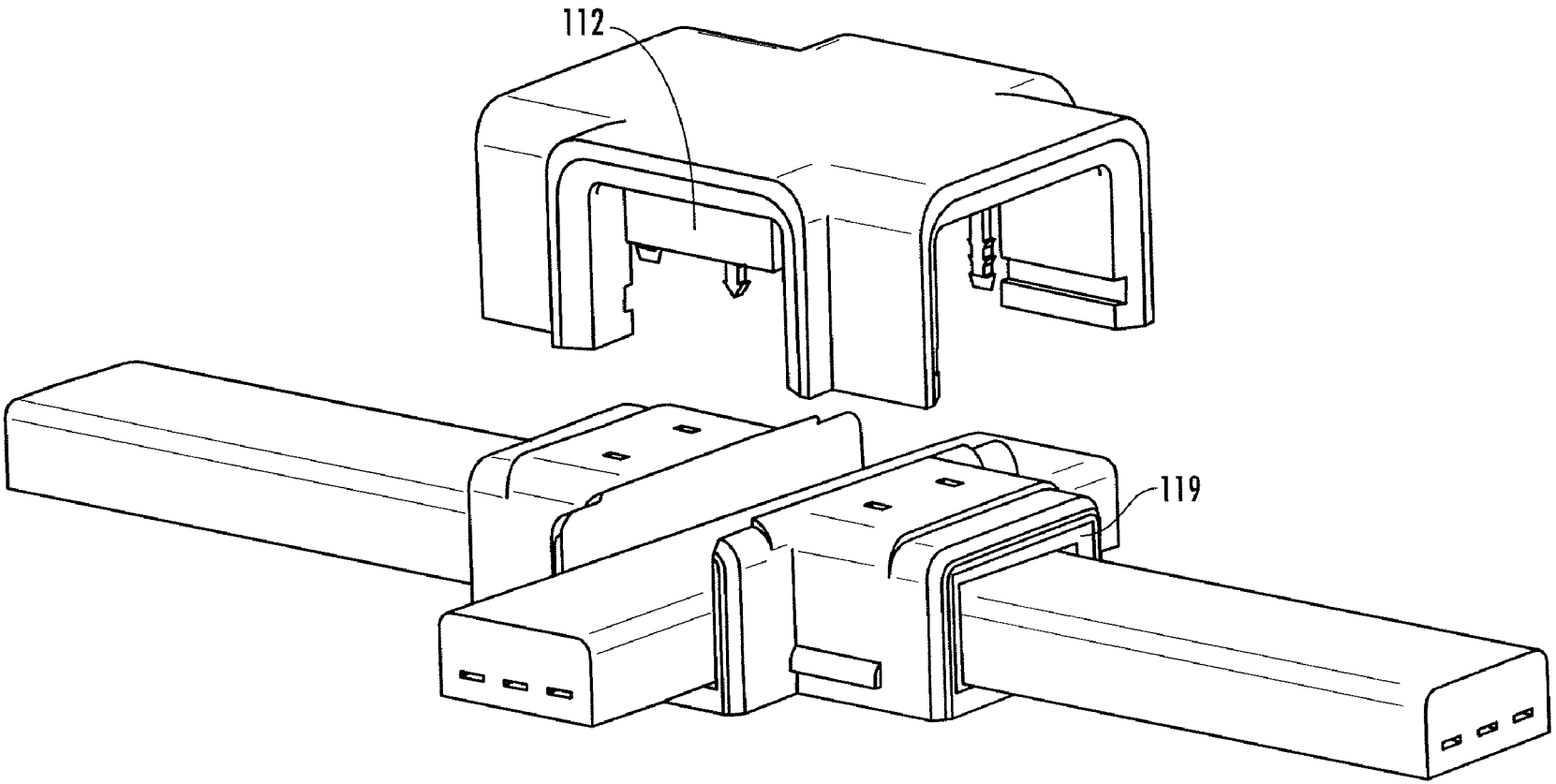

Preferably the tips of each connector pin are configured to increase the contact area between the connector pin and a conductive bus of the lighting apparatus, e.g., conductor bus 91*a* or conductor bus 92*a*, as shown in FIGS. 18A and 18B. To achieve this function, the tip can be in the shape of an inverted "V" or "U."

When assembling the connector 70, the pressure caused by the coupling of the interlocking groove(s) 80 and tongue(s) 81, as well as the penetration of the connector pins 76 and 77 through the opening gaskets 89 and into an encapsulant or protective sheath(es), cover(s) or layer(s) of a lighting apparatus (such as an LED light wire, cable, bar or tube), creates a waterproof seal between the upper housing 72 and lower housing 74, between the opening gaskets 89 and the lighting apparatuses. Specifically, the upper housing gasket 82 tightly presses onto the lower housing thereby creating a tight pressure seal. Further, the opening gaskets 89 tightly press the lighting apparatuses via pressure insertion of the lighting apparatus into the openings 88, and the penetration of the connector pins 76 and 77 into the lighting apparatus.

As can be seen in FIGS. 18A and 18B, when the connector is assembled, the connector pins 76 and 77 penetrate through the encapsulant of the lighting apparatuses 91 and 92 to make contact with the conductor buses 91*a* and 92*a*, respectively, causing an electrical connection to be formed between the conductor buses 91*a* and 92*a* to permit an electrical signal and/or power to pass between lighting apparatuses 91 and 92 and securely connecting the lighting apparatuses together.

As shown in FIGS. 19A-23B, in accordance with a fourth preferred embodiment, an X-branch lighting connector 100 is formed from an upper housing 102 and a lower housing 104.

The X-branch connector 100 in accordance with the fourth embodiment works in a substantially similar manner to the L-branch connector 70 described above, except that the X-branch connector 100 is configured to electrically and mechanically connect a first length 121 of lighting apparatus with the end of a second length 122 and the end of a third length 123 of lighting apparatus, to effectuate a X connection. As in the first and second embodiments, connector pins 106 and 107 are provided in the upper housing 102. The connector pins 106 and 107 have embedded portions 106*a* and 107*a*, respectively formed in the upper housing.

The upper housing includes interlocking groove(s) 110. The interlocking groove(s) 110 mate with interlocking tongue(s) 111 in the lower housing 104 to achieve a secure connection, e.g., a snap fit, between the upper and lower housing when the connector is assembled. A gasket 112 is provided between the upper and lower housings and is used to ensure a tight fit of the housings when the connector has been assembled.

The lower housing 104 includes plural connector pin guide holes 114, and openings 118 as well as a slot 116. In the X-branch embodiment, a first length of lighting apparatus 121 lies in the slot 116, passing completely through the connector 100. An end portion of a second length of lighting apparatus 122 is inserted into one of the openings 118 and an end portion of a third length of lighting apparatus 123 is inserted into the other one of the openings 118, as can be seen particularly in FIGS. 22 and 23. An opening gasket 119 lines the openings 118 in the lower housing. Opening gaskets 119 prevent water leaking between the lower housing 104 and the lighting apparatuses inserted into the openings 118.

To assemble the connector 100, the upper housing 102 is coupled with the lower housing 104 via the corresponding interlocking groove(s) 110 and tongue(s) 111. When pressing the upper housing 102 and the lower housing 104 together, the outer ones of the connector pins 106 and 107 on the upper housing are matched with their corresponding connector pin guide holes 114 on the lower housing. The inner ones of the pins are positioned above lighting apparatus 121 for penetration into that lighting apparatus upon assembly. The connector pins/connector pin guide holes guides the upper housing and lower housing in a manner which permits easy coupling of the corresponding interlocking groove(s) and tongue(s).

Figure 23A:
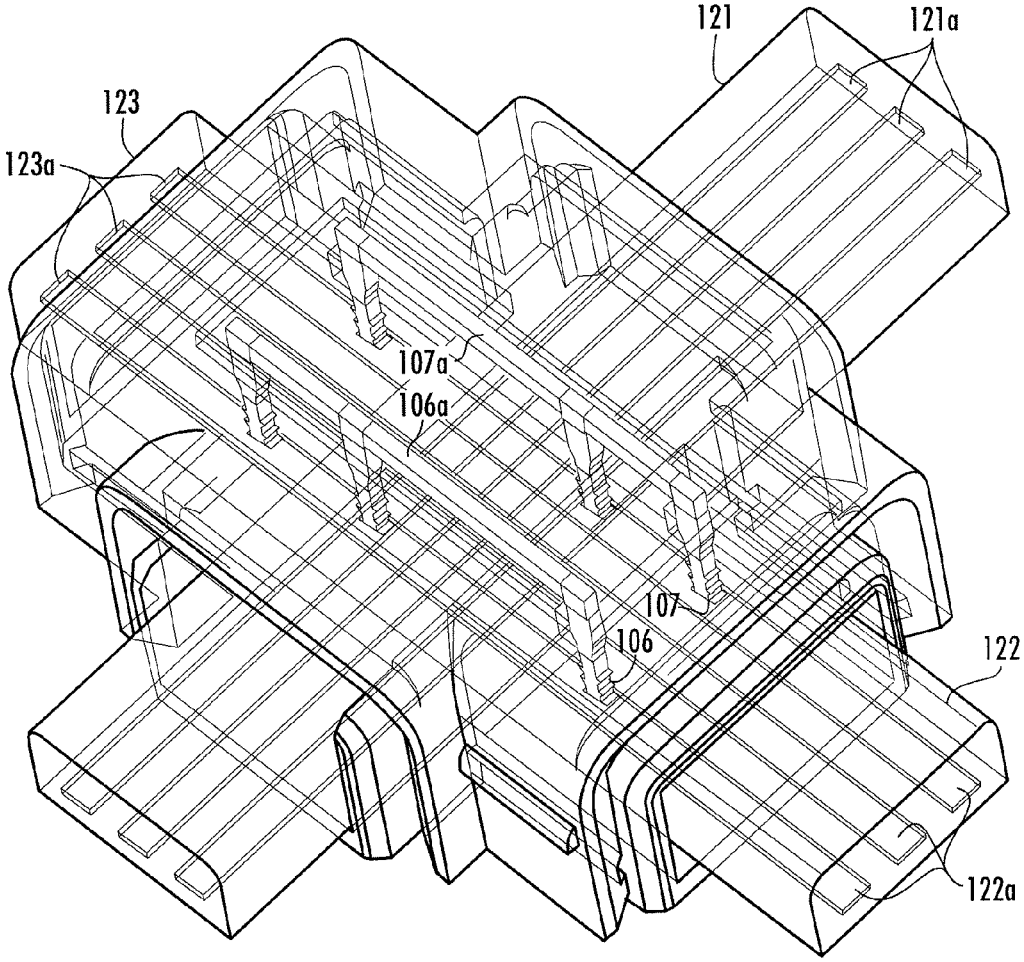
FIGS. 23A and 23B are X-ray views of an assembled X-branch lighting connector in accordance with a fourth embodiment of the present invention.
Figure 23B:
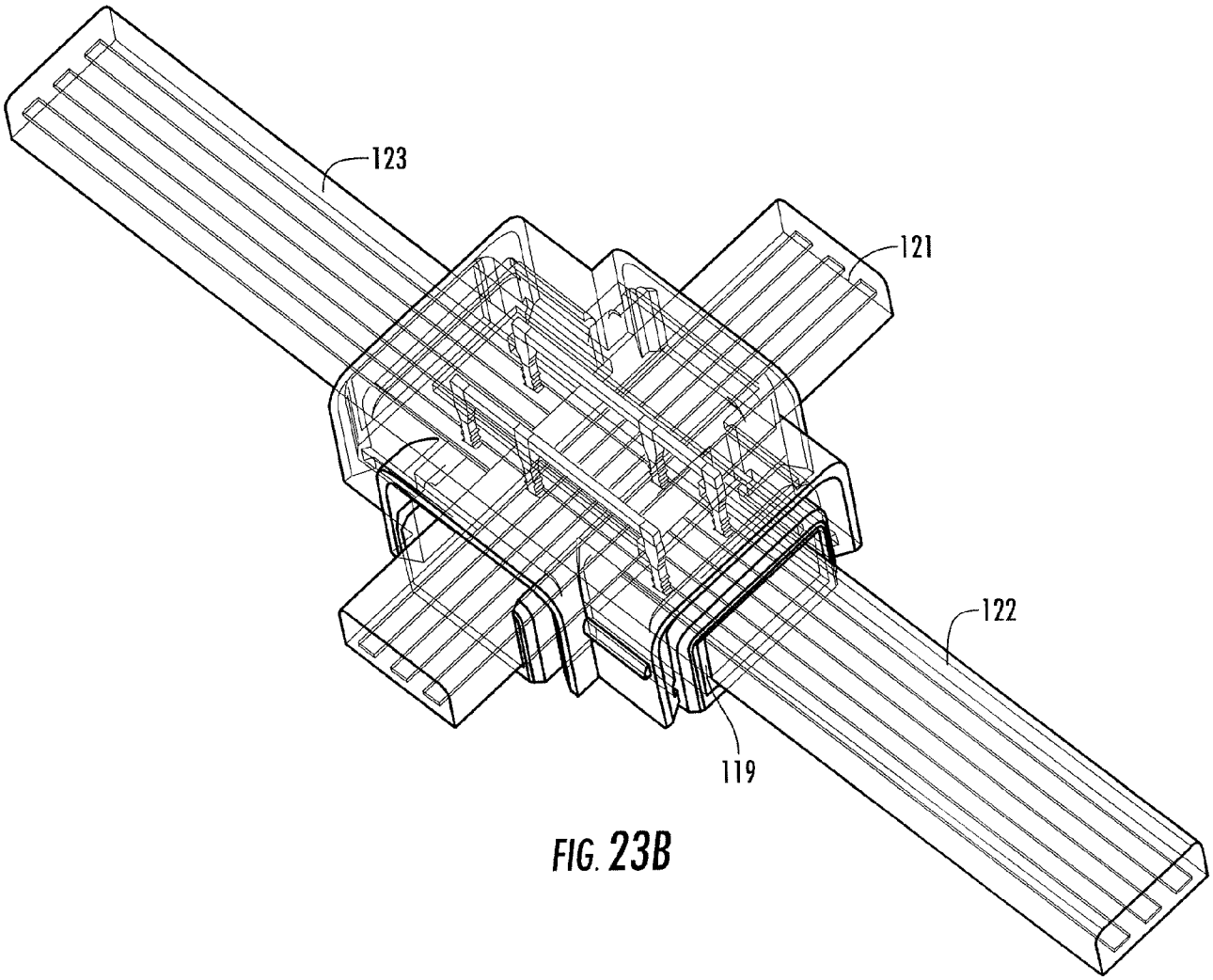
Figure 24A:
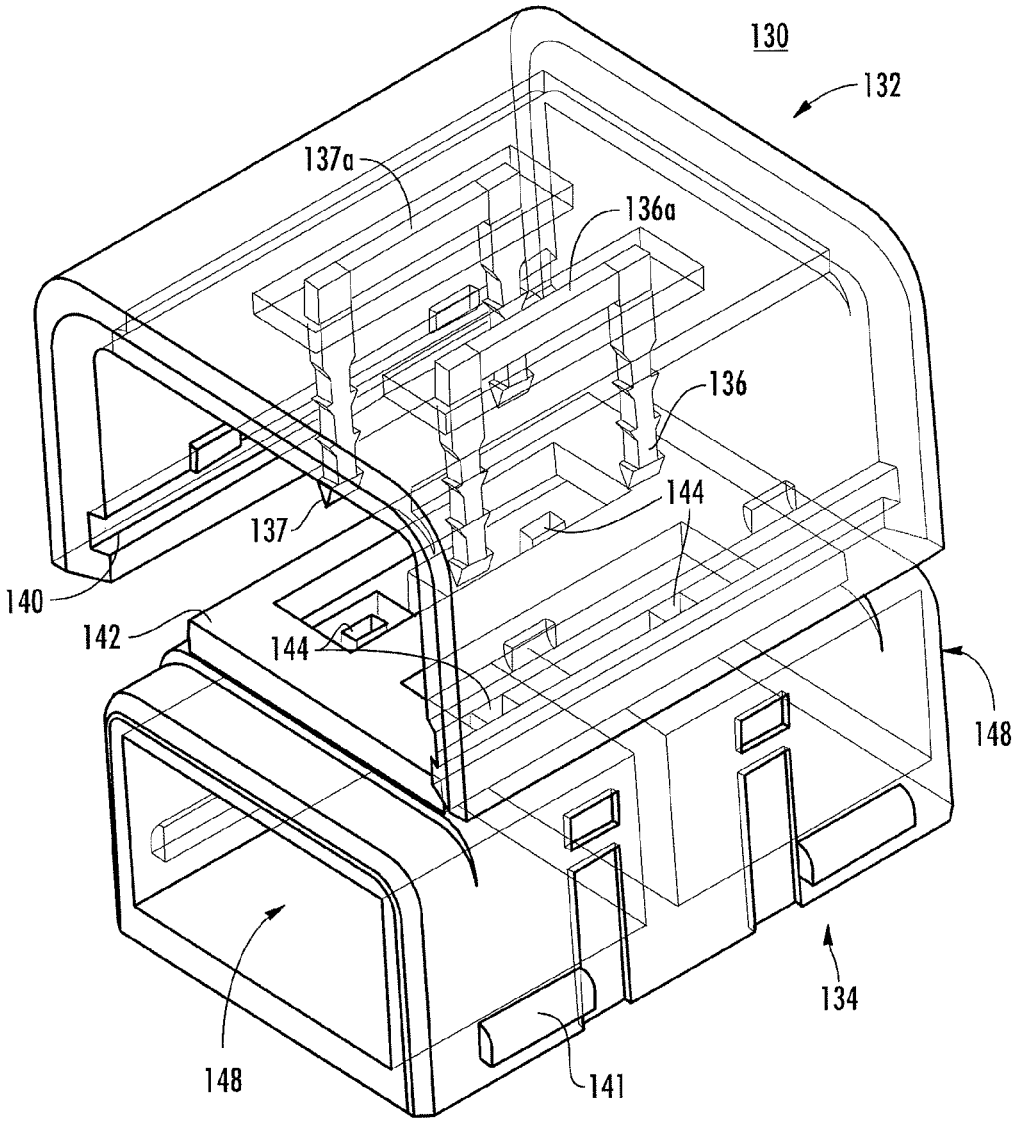
FIGS. 24A, 24B, 25A and 25B are X-ray views of a disassembled I-branch lighting connector in accordance with a fifth embodiment of the present invention.
Figure 24B:
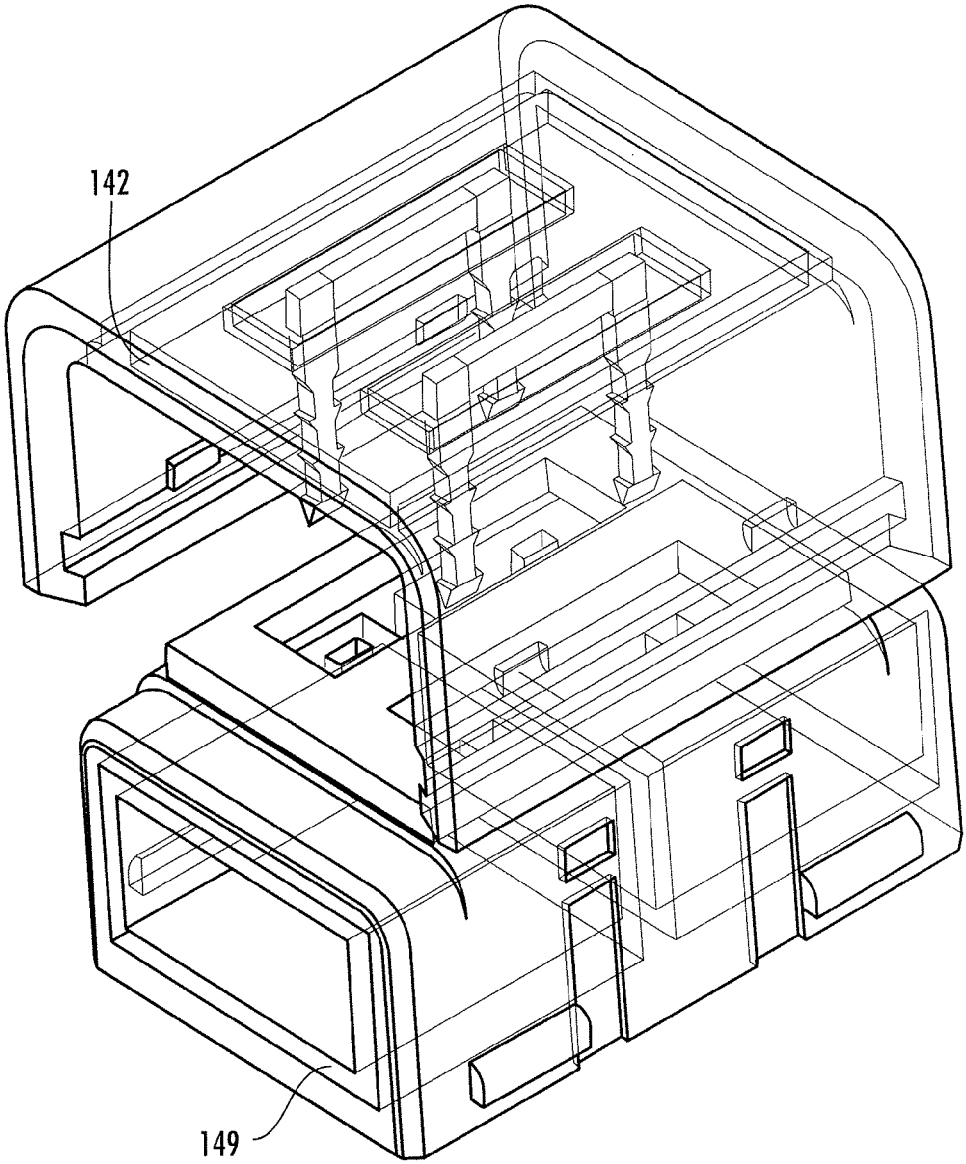
Figure 25A:
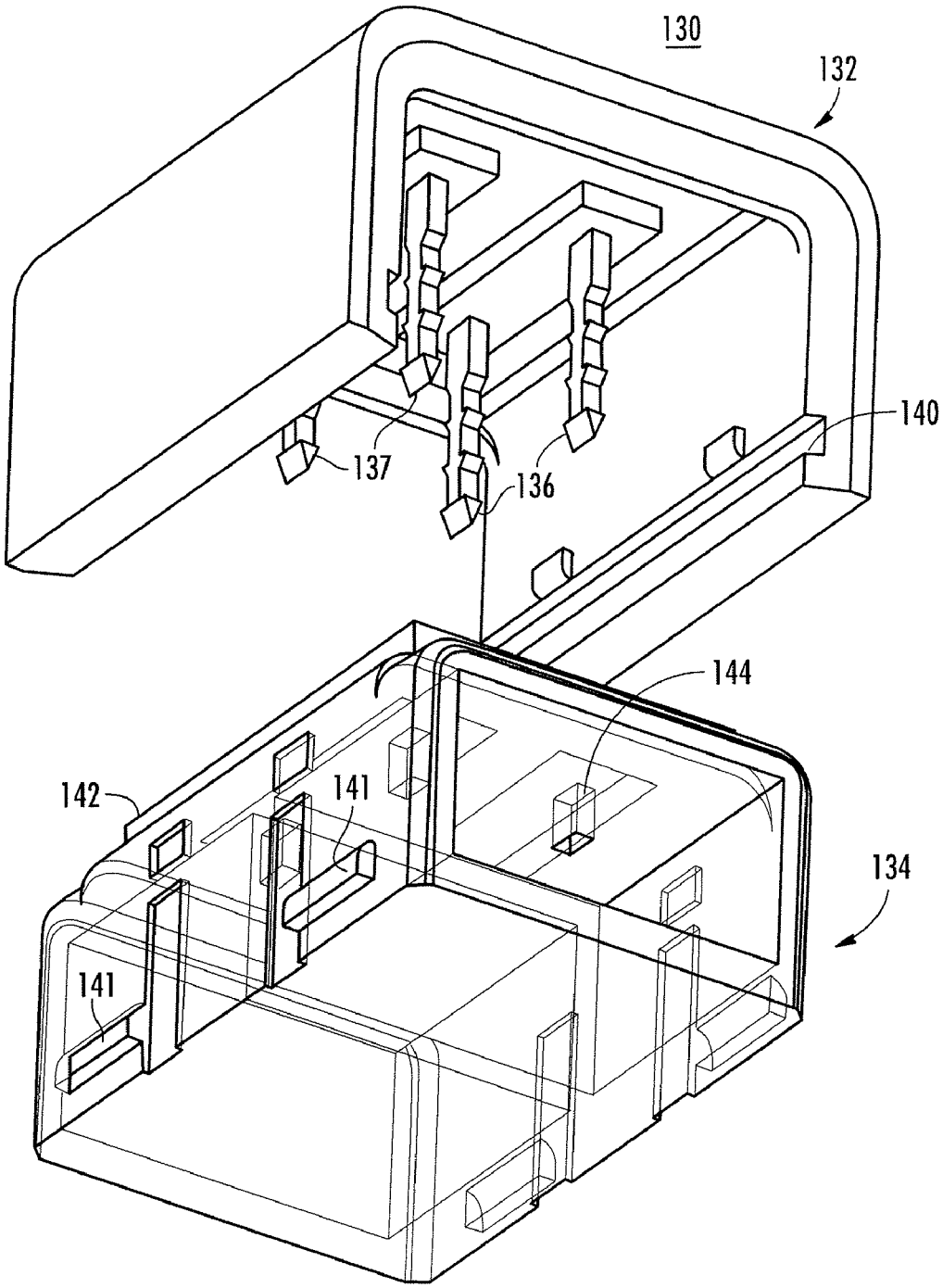
Figure 25B:
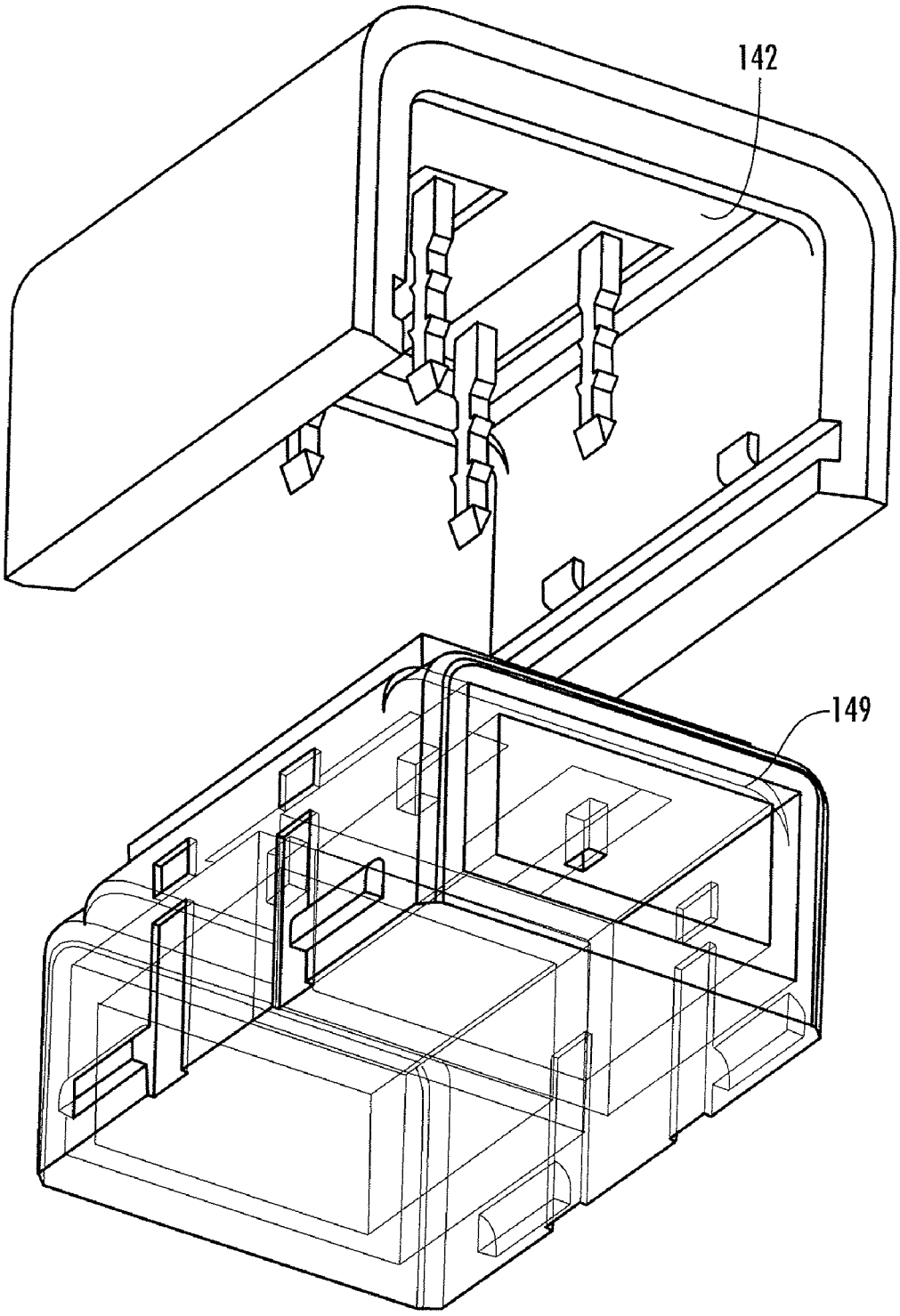
Figure 26:
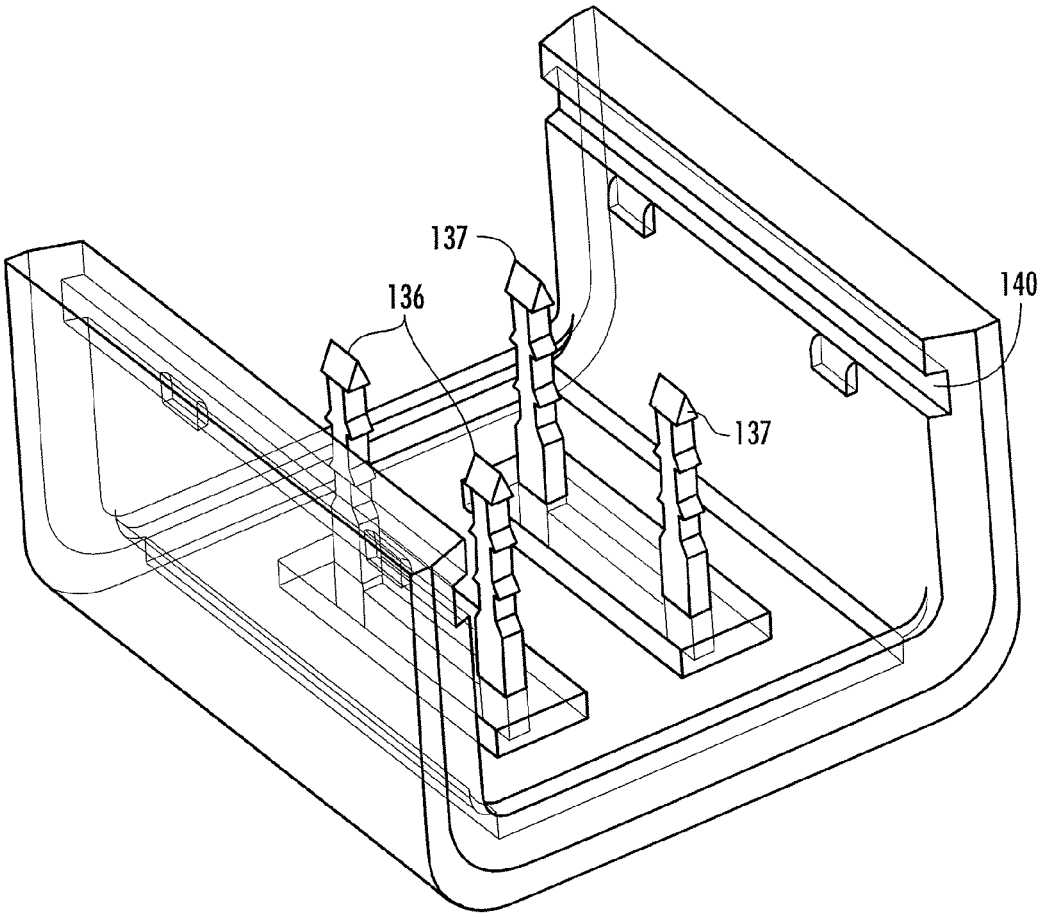
FIG. 26 is an X-ray view of an upper housing in accordance with a fifth embodiment of the present invention.
Figure 27:
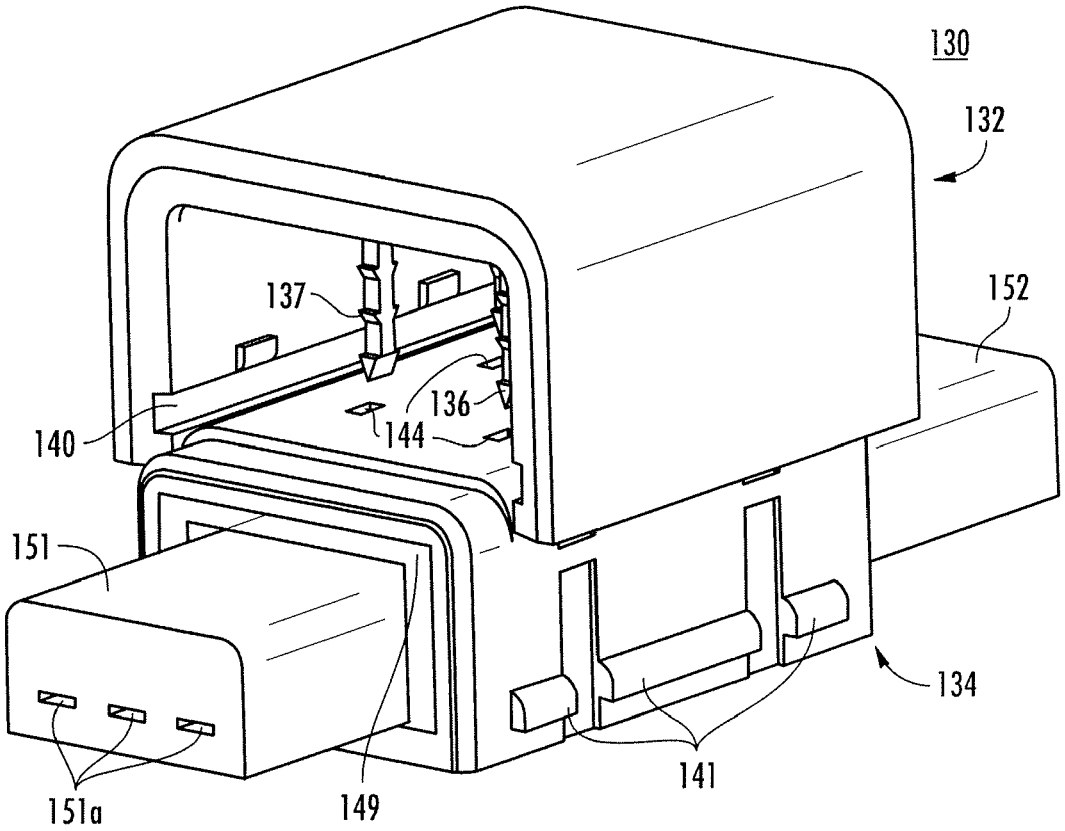
FIG. 27 is a perspective view of a disassembled I-branch lighting connector in accordance with a fifth embodiment of the present invention showing how lengths of lighting apparatus are connected to the lighting connector.

Preferably the tips of each connector pin are configured to increase the contact area between the connector pin and conductive buses of the lighting apparatuses, e.g., conductor buses 121*a*, 122*a* and 123*a*, as shown in FIGS. 23A and 23B. To achieve this function, the tip can be in the shape of an inverted "V" or "U."

When assembling the connector 100, the pressure caused by the coupling of the interlocking groove(s) 110 and tongue(s) 111, as well as the penetration of the connector pins 106 and 107 through the opening gaskets 119 and into an encapsulant or protective sheath(es), cover(s) or layer(s) of a lighting apparatus (such as an LED light wire, cable, bar or tube), creates a waterproof seal between the upper housing 102 and lower housing 104, between the opening gaskets 119 and the lighting apparatuses. Specifically, the gasket 112 tightly presses onto the lower housing and lighting apparatus 121, thereby creating a tight pressure seal. Further, the opening gaskets 119 tightly press the lighting apparatuses via pressure insertion of the lighting apparatus into the openings 118, and the penetration of the outer ones of connector pins 106 and 107 into the lighting apparatuses 122 and 123. The inner ones of the connector pins will penetrate the lighting apparatus 121.

As can be seen in FIGS. 23A and 23B, when the connector is assembled, the connector pins 106 and 107 penetrate through the encapsulant of the lighting apparatuses 121, 122 and 123 to make contact with the conductor buses 121*a*, 122*a*, and 123*a*, respectively, causing an electrical connection to be formed between the conductor buses 121*a*, 122*a*, and 123*a* (e.g., as shown in FIG. 23A, the two outer conductor buses in lighting apparatuses 121, 122 and 123), to permit an electrical signal and/or power to pass between lighting apparatuses 121, 122 and 123 and securely connecting the lighting apparatuses together.

As shown in FIGS. 24A-28, in accordance with a fifth preferred embodiment, an I-branch lighting connector 130 is formed from an upper housing 132 and a lower housing 134.

The I-branch connector 130 in accordance with the fifth embodiment works in a substantially similar manner to the L-branch connector 70 described above, except that the I-branch connector is configured to electrically and mechanically connect the ends of a first length 151 and a second length 152 of lighting apparatus, to effectuate a straight connection. As in the first through fourth embodiments, connector pins 136 and 137 are provided in the upper housing 132. The connector pins 136 and 137 have embedded portions 136*a* and 137*a*, respectively formed in the upper housing.

The upper housing includes interlocking groove(s) 140. The interlocking groove(s) 140 mate with interlocking tongue(s) 141 in the lower housing 134 to achieve a secure connection, e.g., a snap fit, between the upper and lower housing when the connector is assembled. A gasket 142 is provided between the upper and lower housings and is used to ensure a tight fit of the housings when the connector has been assembled.

The lower housing 134 includes plural connector pin guide holes 144, and openings 148. In the I-branch embodiment, an end portion of a first length of lighting apparatus 151 is inserted into one of the openings 148 and an end portion of a second length of lighting apparatus 152 is inserted into the other one of the openings 148, as can be seen particularly in FIGS. 27 and 28. An opening gasket 149 lines the openings 148 in the lower housing. Opening gaskets 149 prevent water leaking between the lower housing 134 and the lighting apparatuses inserted into the openings 148.

To assemble the connector 130, the upper housing 132 is coupled with the lower housing 134 via the corresponding interlocking groove(s) 140 and tongue(s) 141. When pressing the upper housing 132 and the lower housing 134 together, the connector pins 136 and 137 on the upper housing are matched with their corresponding connector pin guide holes 144 on the lower housing. The connector pins/connector pin guide holes guides the upper housing and lower housing in a manner which permits easy coupling of the corresponding interlocking groove(s) and tongue(s).

Figure 28:
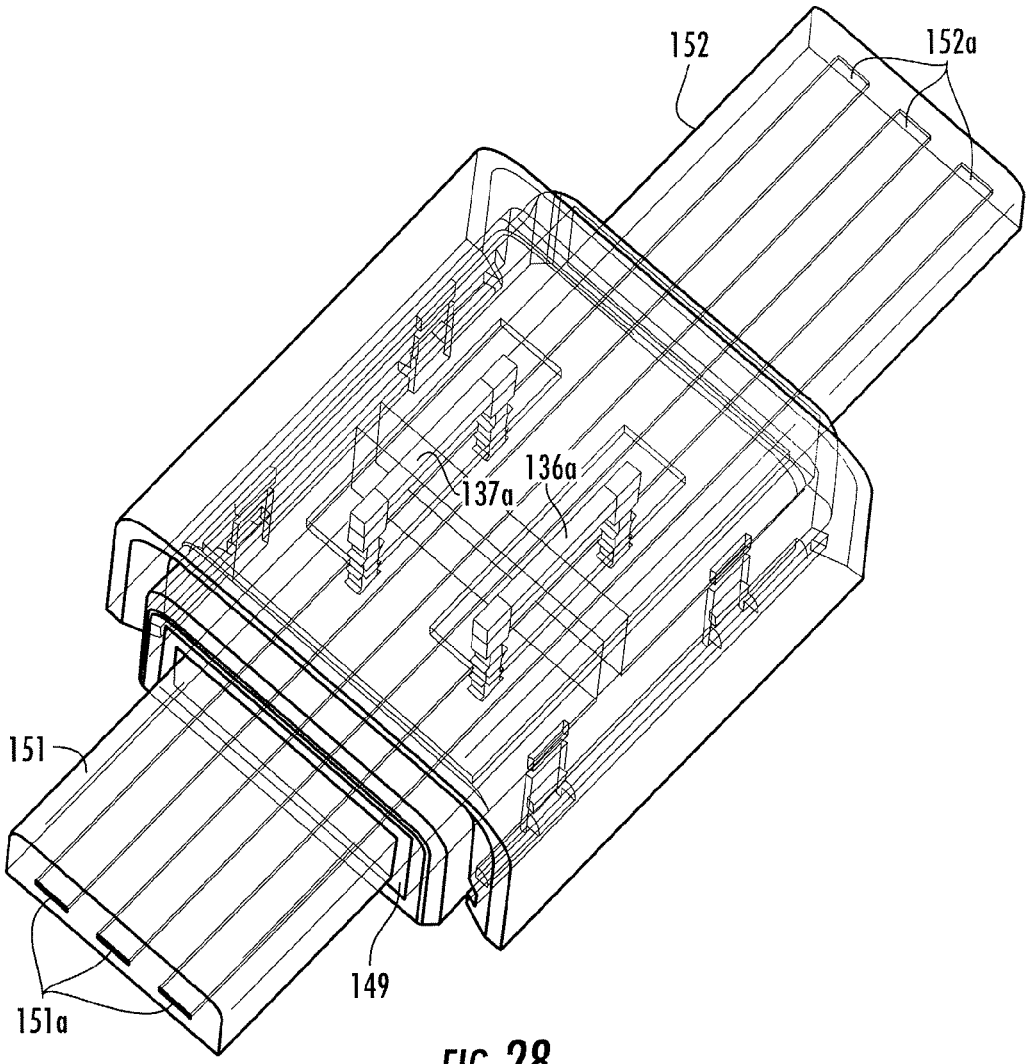
FIG. 28 is an X-ray view of an assembled I-branch lighting connector in accordance with a fifth embodiment of the present invention.
Figure 29:
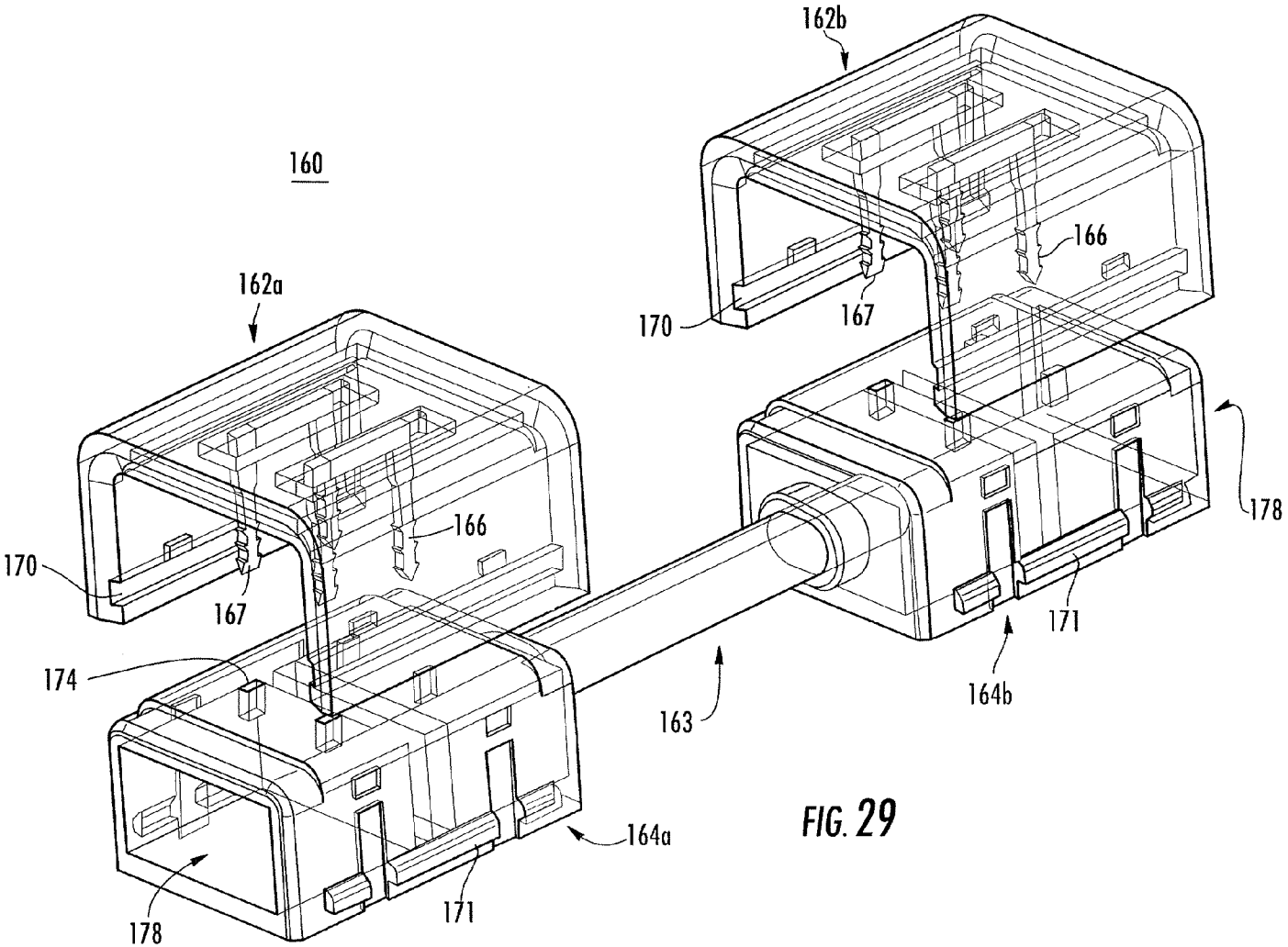
FIGS. 29, 30A and 30B are X-ray views of a disassembled I-extending lighting connector in accordance with a sixth embodiment of the present invention.

Preferably the tips of each connector pin are configured to increase the contact area between the connector pin and a conductive bus of the lighting apparatus, e.g., conductor bus 151*a* or conductor bus 152*a*, as shown in FIG. 28. To achieve this function, the tip can be in the shape of an inverted "V" or "U."

When assembling the connector 130, the pressure caused by the coupling of the interlocking groove(s) 140 and tongue(s) 141, as well as the penetration of the connector pins 136 and 137 through the opening gaskets 149 and into an encapsulant or protective sheath(es), cover(s) or layer(s) of a lighting apparatus (such as an LED light wire, cable, bar or tube), creates a waterproof seal between the upper housing 132 and lower housing 134, between the opening gaskets 149 and the lighting apparatuses. Specifically, the gasket 142 tightly presses onto the lower housing, thereby creating a tight pressure seal. Further, the opening gaskets 149 tightly press the lighting apparatuses via pressure insertion of the lighting apparatus into the openings 148, and the penetration of the connector pins 136 and 137 into the lighting apparatus.

As can be seen in FIG. 28, when the connector is assembled, the connector pins 136 and 137 penetrate through the encapsulant of the lighting apparatuses 151 and 152 to make contact with the conductor buses 151*a* and 152*a*, respectively, causing an electrical connection to be formed between the conductor buses 151*a* and 152*a* (e.g., as shown in FIG. 28, the two outer conductive buses 151*a* and 152*a*) to permit an electrical signal and/or power to pass between lighting apparatuses 151 and 152 and securely connecting the lighting apparatuses together.

As shown in FIGS. 29-33, in accordance with a sixth preferred embodiment, an I-extender lighting connector 160 is formed from upper housings 162*a* and 162*b* and lower housings 164*a* and 164*b*, and a preferably flexible connector extension 163 formed so as to electrically connect the lower housings together.

The I-extender connector in accordance with the sixth embodiment works in a substantially similar manner to the I-branch connector 130 described above, in that the I-extender connector is configured to electrically and mechanically connect the ends of a first length 181 and a second length 182 of lighting apparatus. However, by providing the flexible connector extension 163 between the lower housings 164*a* and 164*b*, a flexible connection may be achieved, which is not limited to a straight connection. As in the first through fifth embodiments, each upper housing has connector pins 166 and 167 provided therein. However, the I-extended connector 160 includes two upper housings, 162*a* and 162*b*, each connecting to a respective one of the lower housings 164*a* and 164*b*. The connector pins 166 and 167 have embedded portions 166*a* and 167*a*, respectively formed in the upper housing.

Figure 30A:
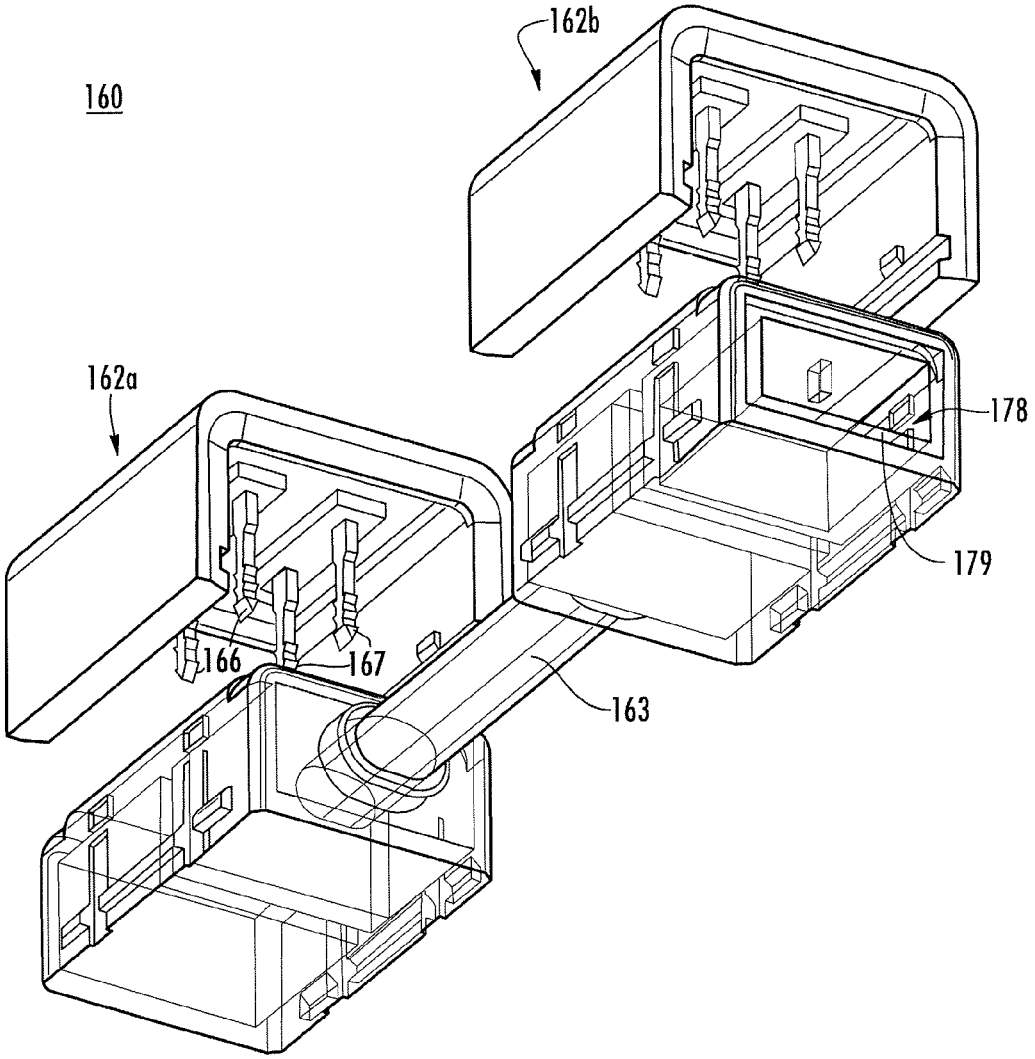
Figure 30B:
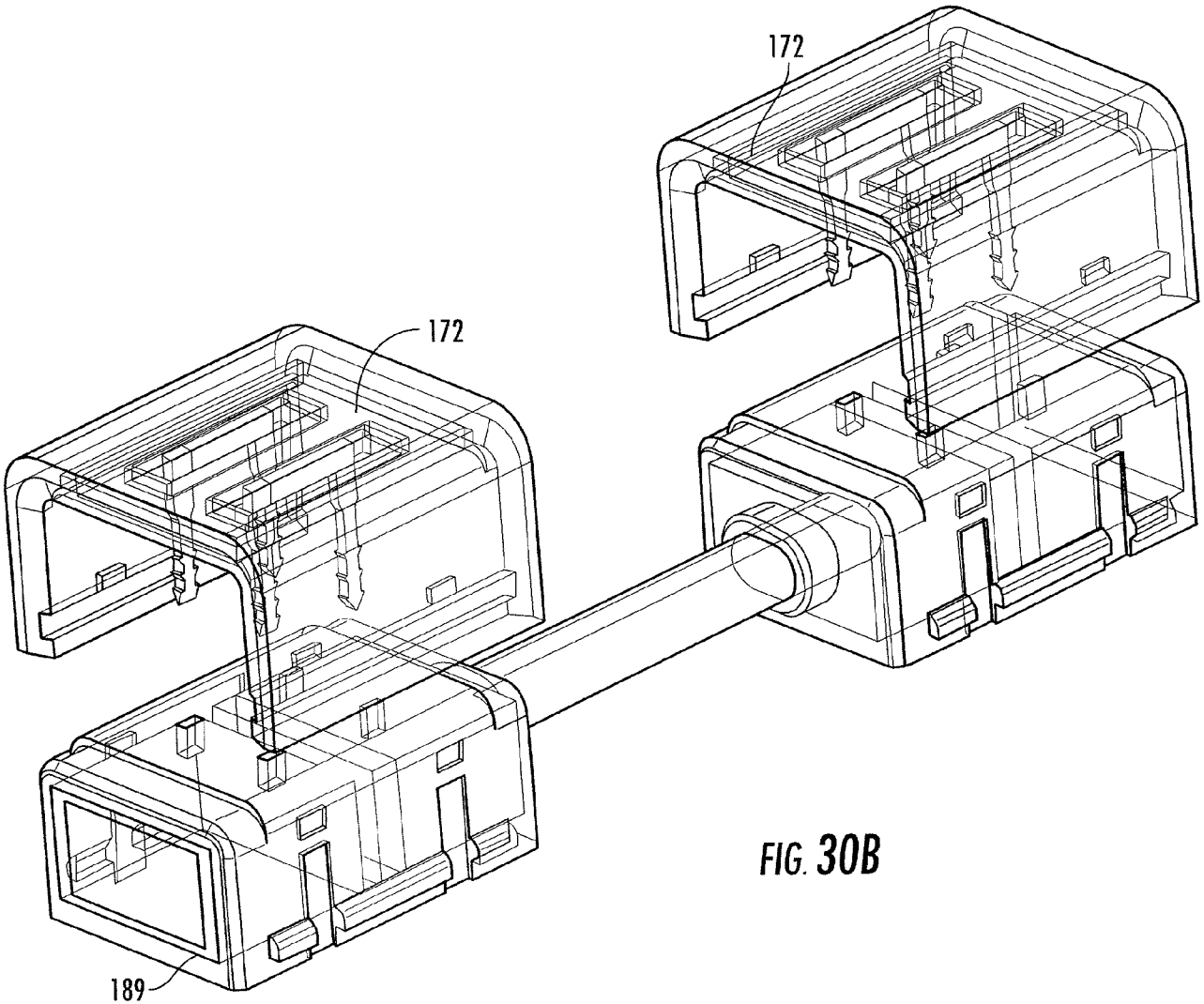
Figure 31:
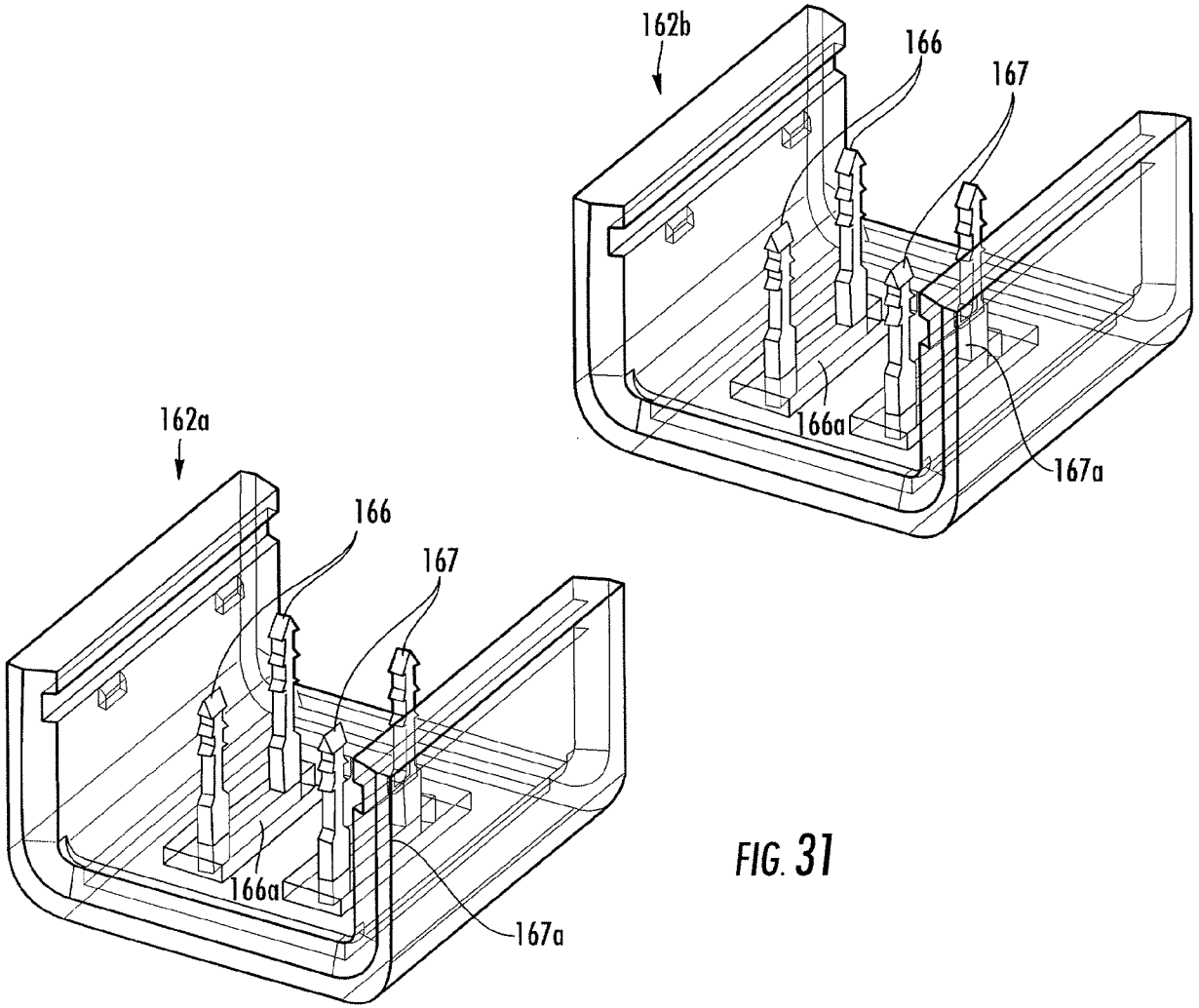
FIG. 31 are X-ray views of upper housings in accordance with the sixth embodiment of the present invention.

Each upper housing includes interlocking groove(s) 170. The interlocking groove(s) 170 mate with interlocking tongue(s) 171 in the corresponding lower housing 174*a* or 174*b* to achieve a secure connection, e.g., a snap fit, between the upper and corresponding lower housing when the connector is assembled. As shown in FIG. 30B, a gasket 172 may be provided between the upper and lower housings, in a manner similar to that shown with regard to the other embodiments, to ensure a tight fit of the housings when the connector 160 has been assembled.

The lower housings 164*a* and 164*b* each includes plural connector pin guide holes 174, and openings 178. In the I-extender embodiment, an end portion of a first length of lighting apparatus 181 is inserted into one of the openings 178 and an end portion of a second length of lighting apparatus 182 is inserted into the other one of the openings 178, as can be seen particularly in FIGS. 32 and 33. An opening gasket 179 may be used to line the openings 188 in the lower housings. Opening gaskets 179 prevent water leaking between the lower housings 164*a* and 164*b* and the lighting apparatuses inserted into the openings 178.

To assemble the connector 160, the upper housings 162*a* and 162*b* are coupled with the corresponding lower housings 164*a* and 164*b*, via the corresponding interlocking groove(s) 170 and tongue(s) 171. When pressing the upper housings 162*a* and 162*b* and the lower housings 164*a* and 164*b* together, the connector pins 166 and 167 on the upper housings are matched with their corresponding connector pin guide holes 174 on the lower housings. The connector pins/connector pin guide holes guide the upper housings and lower housings in a manner which permits easy coupling of the corresponding interlocking groove(s) and tongue(s).

Figure 33:
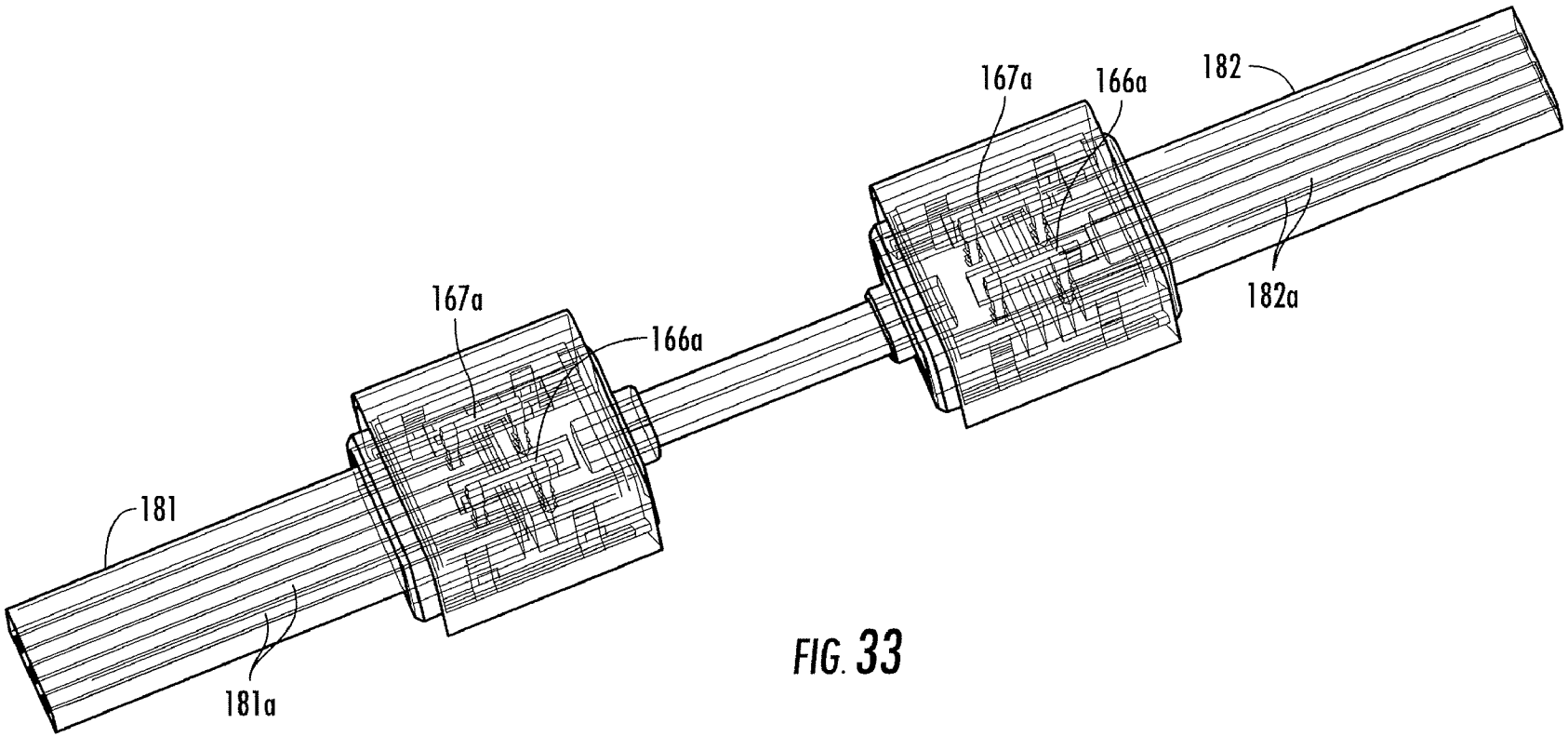
FIG. 33 is an X-ray view of an assembled I-extending lighting connector in accordance with a sixth embodiment of the present invention.
Figure 34:
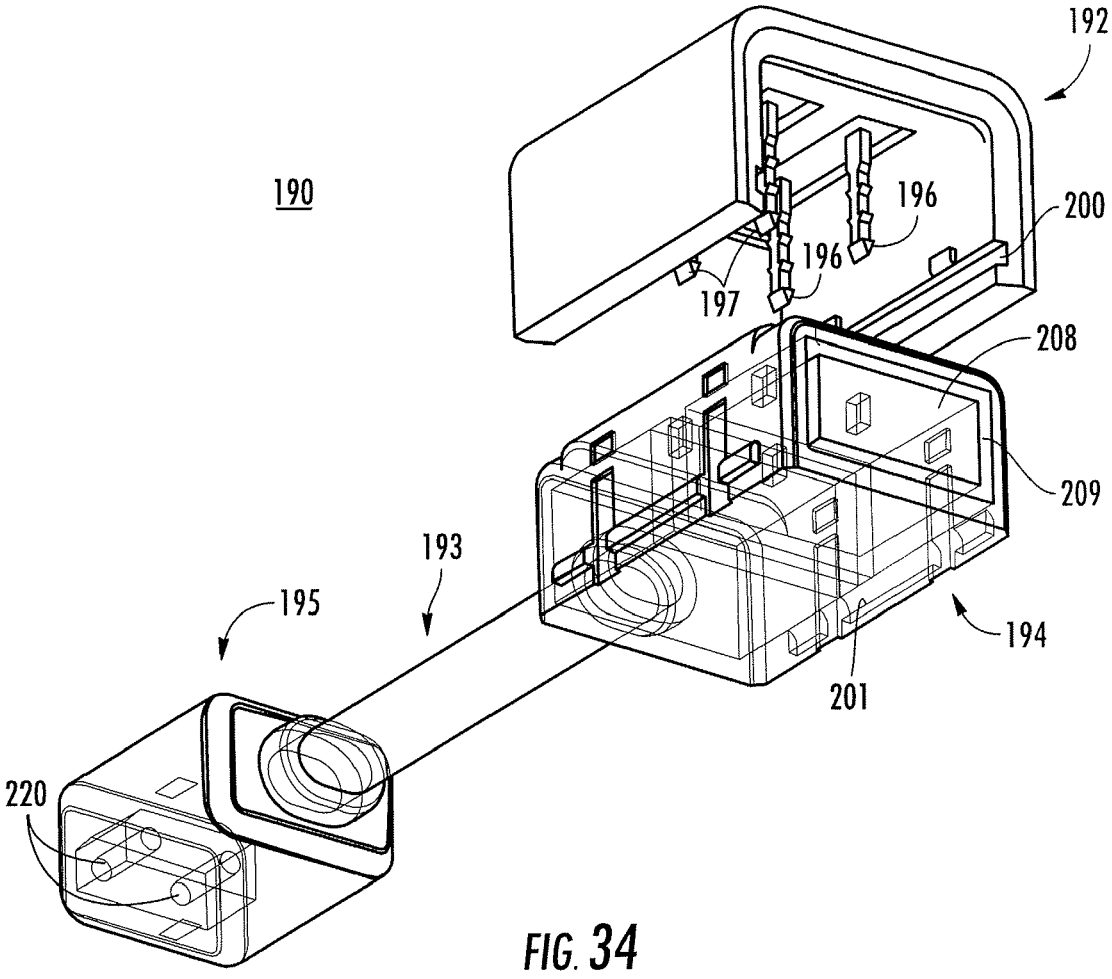
FIGS. 34 and 35 are X-ray views of a disassembled power source-extender connector in accordance with a seventh embodiment of the present invention.
Figure 35:
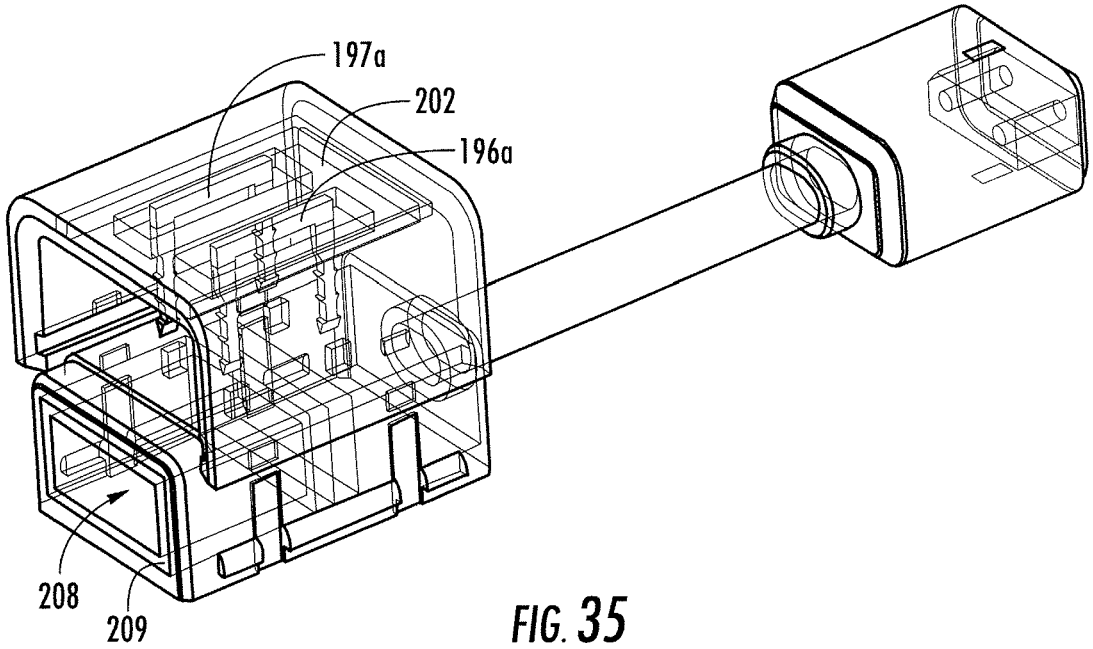

Preferably the tips of each connector pin are configured to increase the contact area between the connector pin and a conductive bus of the lighting apparatus, e.g., conductor bus 151*a* or conductor bus 152*a*, as shown in FIG. 33. To achieve this function, the tip can be in the shape of an inverted "V" or "U."

When assembling the connector 160, the pressure caused by the coupling of the interlocking groove(s) 170 and tongue(s) 171, as well as the penetration of the connector pins 166 and 167 through the opening gaskets 189, and into an encapsulant or protective sheath(es), cover(s) or layer(s) of a lighting apparatus (such as an LED light wire, cable, bar or tube), creates a waterproof seal between the upper housings 162*a* and 162*b* and lower housings 164*a* and 164*b*, and between the opening gaskets 179 and the lighting apparatuses. The gasket 172 provided between the upper and lower housings provides a tighter pressure seal. Further, opening gaskets 179 tightly press the lighting apparatuses via pressure insertion of the lighting apparatus into the openings 178, and the penetration of the connector pins 166 and 167 into the lighting apparatus.

Figure 32:
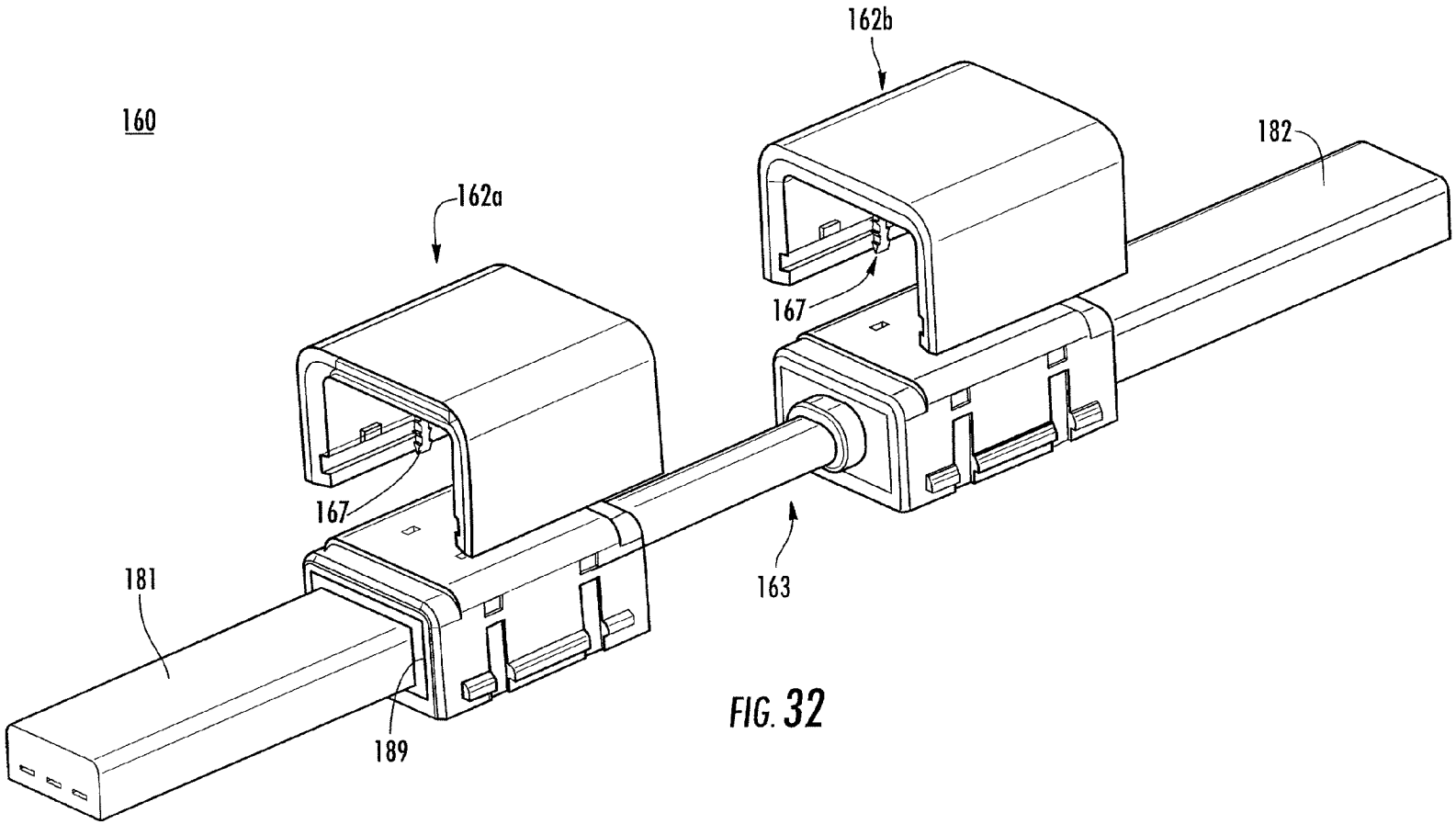
FIG. 32 is a perspective view of a disassembled I-extending lighting connector in accordance with a sixth embodiment of the present invention showing how lengths of lighting apparatus are connected to the lighting connector.

As can be seen in FIGS. 32 and 33, when the connector is assembled, the outermost ones of the connector pins 166 and 167 penetrate through the encapsulant of the lighting apparatuses 181 and 182. The innermost ones of the connector pins 166 and 167 penetrate into the inner portions of the lower housings to make contact with (a) conductive leads that electrically couple with wires in the flexible connector extension 163, (b) the wires from the flexible connector extension 163, or (c) the wires within the flexible connector extension 163 by penetrating through the flexible connector extension 163 and contacting the wires within the flexible connector extension 163. Flexible connector extension 163 can have one or more wires electrically coupled to the conductive leads in the inner portion of each lower housing. Each of the possible connections described above causes an electrical connection to be formed between the conductor buses 181*a* and 182*a*, by the electrical coupling of the lower housings to one another, to permit an electrical signal and/or power to pass between lighting apparatuses 181 and 182 and securely connecting the lighting apparatuses together. In one alternative embodiment, the connector pins that couple directly or indirectly with the wires in flexible connector extension 163 are U-shaped at the tip.

As shown in FIGS. 34-37, in accordance with a seventh preferred embodiment, power source-extender connector 190 is formed from upper housings 192, lower housing 194, a power supply plug 195, and a preferably flexible connector extension 193 formed so as to electrically connect the lower housing with the power supply plug 195.

As in the first through sixth embodiments, connector pins 196 and 197 are provided in the upper housing 192. The connector pins 196 and 197 have embedded portions 196*a* and 197*a*, respectively formed in the upper housing.

The upper housing 192 and the lower housing 194 are substantially the same as one of the upper and lower housings 162*b* and 164*b* described above with reference to the I-extender embodiment. The difference between the power source-extender connector 190 and the I-extender embodiment is that instead of the flexible connector extension 193 terminating in another set of upper and lower housings to connect with another length of lighting apparatus, in the seventh embodiment, the flexible connector extension 193 terminates in a power supply plug 195, which supplies power to the lighting apparatus connected to the power source-extender connector 190. Thus, in the seventh embodiment, there is only a single upper and lower housing pair, instead of two, as was the case in the sixth embodiment. Power supply plug 195 preferably includes a female power connector 220, which can mate with any conventional power source for powering lighting apparatuses. Of course the connector is not limited to a female connector, and any known manner of electrical connection may be employed, e.g., depending on the configuration of the power source supply cable.

The upper housing includes interlocking groove(s) 200. The interlocking groove(s) 200 mate with interlocking tongue(s) 201 in the lower housing 194 to achieve a secure connection, e.g., a snap fit, between the upper and lower housing when the connector is assembled. A gasket 202 is provided between the upper and lower housings and is used to ensure a tight fit of the housings when the connector has been assembled.

The lower housing 194 includes plural connector pin guide holes 204, and openings 208. An end portion of a length of lighting apparatus 211 is inserted into the opening 208, as can be seen particularly in FIGS. 36 and 37. An opening gasket 209 lines the opening 208 in the lower housing. The opening gasket 209 prevents water leaking between the lower housing 194 and the lighting apparatus inserted into the opening 208.

To assemble the connector 190, the upper housing 192 is coupled with the lower housing 194 via the corresponding interlocking groove(s) 200 and tongue(s) 201. When pressing the upper housing 192 and the lower housing 194 together, the connector pins 196 and 197 on the upper housing are matched with their corresponding connector pin guide holes 204 on the lower housing. The connector pins/connector pin guide holes guides the upper housing and lower housing in a manner which permits easy coupling of the corresponding interlocking groove(s) and tongue(s).

Figure 36:
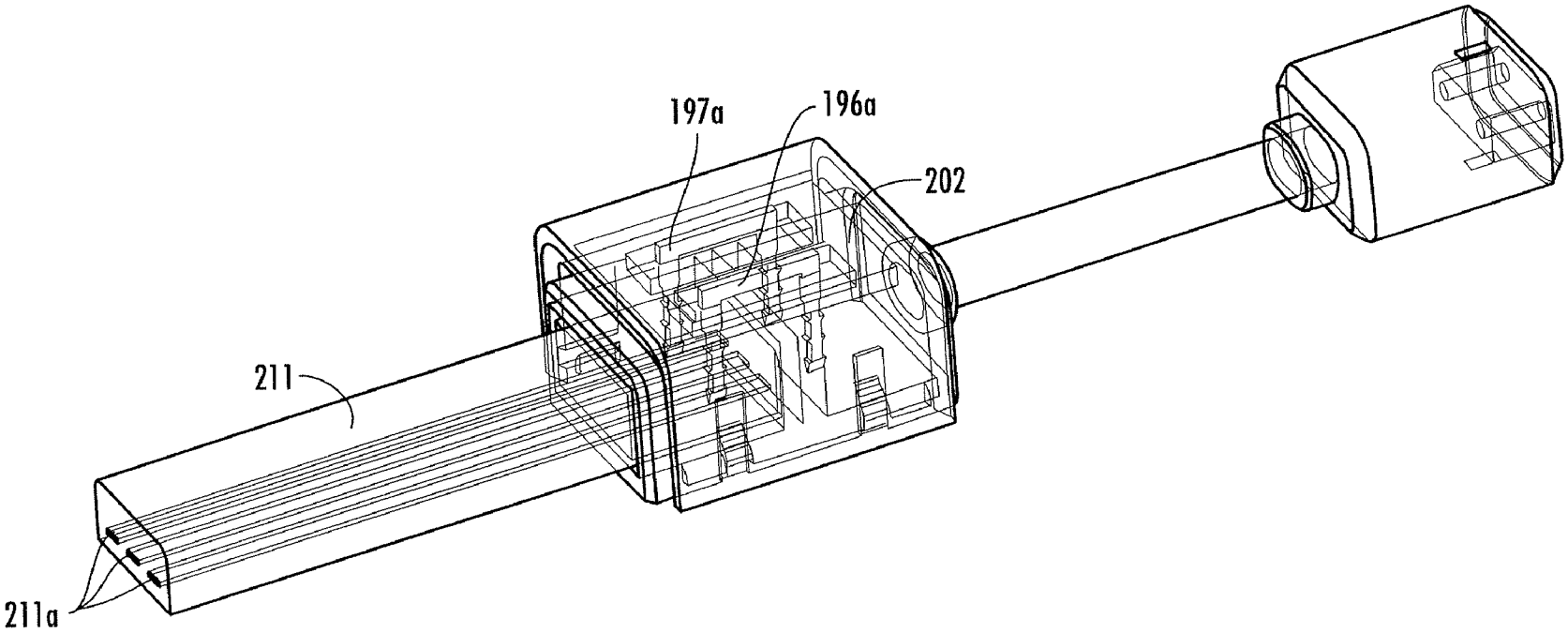
FIG. 36 is an X-ray view of an assembled power source-extender connector in accordance with the seventh embodiment of the present invention.
Figure 37:
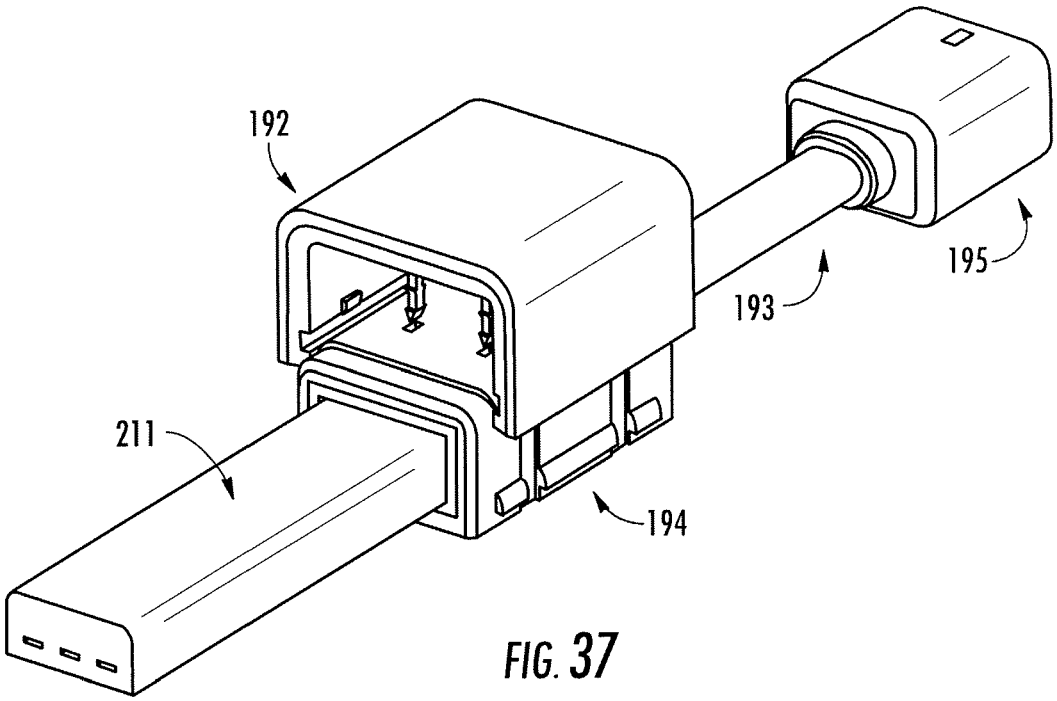
FIG. 37 is a perspective view of a disassembled power source-extender connector in accordance with a seventh embodiment of the present invention.

Preferably the tips of each connector pin are configured to increase the contact area between the connector pin and a conductive bus of the lighting apparatus, e.g., conductor bus 211*a*, as shown in FIG. 36. To achieve this function, the tip can be in the shape of an inverted "V" or "U."

As in the I-extender embodiment, for example, when assembling the connector 190, and in particular, the upper and lower housings, the pressure caused by the coupling of the interlocking groove(s) 200 and tongue(s) 201, as well as the penetration of the connector pins 196 and 197 through the opening gasket 209, and into an encapsulant or protective sheath(es), cover(s) or layer(s) of a lighting apparatus (such as an LED light wire, cable, bar or tube), creates a waterproof seal between the upper housing 192 and the lower housing 194, and between the opening gasket 209 and the lighting apparatus. The gasket 202 provided between the upper and lower housing provides a tighter pressure seal. Further, opening gasket 209 tightly presses the lighting apparatuses via pressure insertion of the lighting apparatus into the openings 208, and the penetration of the connector pins 196 and 197 into the lighting apparatus.

As can be seen in FIG. 36, when the connector is assembled, one end of each of the connector pins 196 and 197 (the leftmost ends in FIG. 36) penetrate through the encapsulant of the lighting apparatus 211 to make contact with the conductor buses 211*a*. The innermost ones of the connector pins 196 and 197 penetrate into the inner portion of the lower housing to make contact with (a) conductive leads that electrically couple with wires in the flexible connector extension 193, (b) the wires from the flexible connector extension 193, or (c) the wires within the flexible connector extension 193 by penetrating through the flexible connector extension 193 and contacting the wires within the flexible connector extension 193. Flexible connector extension 163 can have one or more wires electrically coupled to the conductive leads in the inner portion of the lower housing. Flexible connector extension 193 can have one or more wires electrically coupled to the conductive leads in the inner portion of the lower housing. Each of the possible connections described above causes an electrical connection to be formed between the conductor bus 211*a* and the power supply to permit an electrical signal and/or power to pass to the lighting apparatus 211 from the power supply plug 195. In one alternative embodiment, the connector pins that couple directly or indirectly with the wires in flexible connector extension 193 are U-shaped at the tip.

When creating a lighting system with one or more lighting connector devices, at least two segments of a lighting apparatus (such as an LED light wire, cable, bar or tube) are inserted into their respective opening or slot in the lower housing, and then the upper housing is pressed onto the lower housing. The connector pins will penetrate the encapsulant, protective sheath(es), cover(s) or layer(s) of the segments of the lighting apparatus, and will electrically connect with the conductive buses of the lighting apparatus; thereby, electrically connecting the segments.

Figure 38:
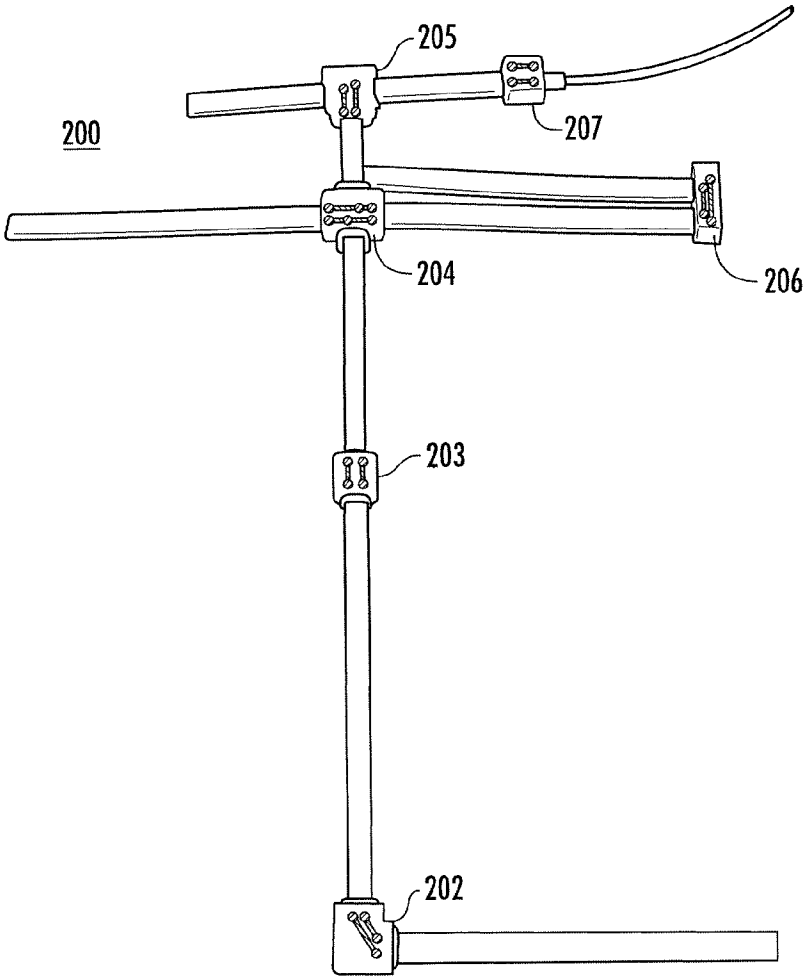
FIG. 38 is a plan view of a lighting system using lighting connectors in accordance with disclosed embodiments of the present invention.

Thus, as would be understood by those skilled in the art, a lighting system can be formed by connecting a number of lengths of lighting apparatus using one or more of the connectors of the above-described embodiments. For example, FIG. 38 shows a number of lengths of lighting apparatus connected to one another using an L-branch connector 202, an I-branch connector 203, an X-branch connector 204, a T-branch connector 205 and a U-branch connector 206 in accordance with the above-described embodiments, to form a light system. The power source for the entire fixture can be provided by a power supply connector device 207, for example, one in accordance with the seventh embodiment.

Figure 39:
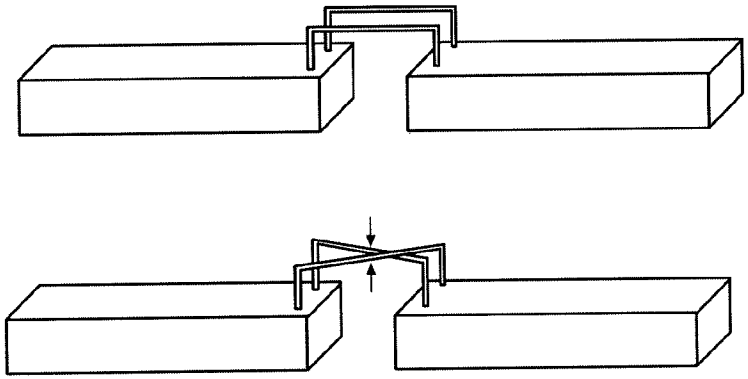
FIG. 39 is a diagram showing orientation of connector pins to connect lengths of lighting apparatus in accordance with the present invention.

While the connector pins of the above described embodiments are each arranged in parallel with one another in any given upper housing, the connector pins may instead be formed within the upper housings so as to cross one another, as long as clearance is provided between the pins to prevent, e.g., a shorting of the connection. Preferably in such a crossing configuration, a clearance of about 1-2 mm should be provided between the embedded portions of the pins within the upper housing, as shown in FIG. 39.

An objective of the present invention in accordance with the above exemplary embodiments is to provide easy-to-assemble connector devices which electrically and mechanically connect segments of a hard and/or flexible lighting apparatus, such as an LED light wire, cable, bar or tube. The connector devices are for indoor and outdoor use.

The present invention relates to a lighting connector device which has a housing, the housing comprising an upper housing, the upper housing having a plurality of connector pins, an upper housing gasket and at least one receiving interlocking groove; a lower housing coupled to the upper housing by at least one interlocking groove on the upper housing coupled to at least one interlocking tongue on the lower housing, the lower housing comprising a plurality of connector pin guide holes, at least one gasket groove, at least one opening, at least one opening gasket within the at least one opening, and at least one interlocking tongue. The location of the interlocking grooves and tongues are interchangeable—for example, the interlocking grooves and tongues can be located on the lower housing and upper housing, respectively, or a combination thereof.

Preferably, the upper and lower housings of the above-described embodiments are made of a thermoplastic, such as polypropylene ("PP"), polyethylene ("PE"), acrylonitrile butadiene styrene ("ABS")) or the like.

The gaskets provided between the housing, and opening gaskets are preferably made of water-resistant rubber (such as silicone or the like), plastic, foam or any other water-resistant material known in the art. The preferred water-resistant material for the upper housing gasket and opening gasket is a silicone. The upper housing gasket or opening gasket can be a stand-alone part or molded with the upper housing or the opening using methods known in the art, e.g., double injection with the upper housing or lower housing. With respect to the opening gasket, it may cover all or part of the interior of the opening. The upper housing can have a groove which houses an upper housing gasket.

Opening gaskets may be optional since the openings (e.g., opening 28, 58, 88, 118, 148, 178, 208) of the present invention can be made to create a tight fit with a lighting apparatus.

The connector pins are made of electrically conductive material (such as copper, steel, or copper clad steel). The electrically conductive material can be electroplated with tin to improve conductivity and prevent oxidation. The connector pins may, for example, be barbed in order to better penetrate any encapsulant or protective sheath(es), cover(s) or layer(s) of a lighting apparatus (such as an LED light wire, cable, bar or tube), and to prevent the connector pins from sliding out from their respective penetration points, hence allowing the connector pins to maintain electrical contact with the conductive buses of the lighting apparatus, while securing the coupling of the upper housing and lower housing. The connector pins can be insert-molded to the upper housing for maximum durability.

The lighting apparatuses connected together by the connectors of the disclosed embodiments may be, for example, light wire, cable, bar or tube, such as, but not limited to:

CabLED™ from OptiLED Lighting International Ltd. (http://cabled.optiled.com/; http://cabled.optiled.com/MyImage/image/Web/CabLED%20brochure%20final.pdf);

Rigid Light Strip™ from Light Engine Ltd. (http://www.lightengine-tech.com/en/generallighting3_detail.asp?ID=38&CATID=38; http://www.lightengine-tech.com/upload/PRODUCTG_PL38.pdf); and Flexible Light Strip™ from Light Engine Ltd. (http://www.lightengine-tech.com/en/generallighting3_detail.asp?ID=40&CATID=40; http://www.lightengine-tech.com/upload/PRODUCTG_PL40.pdf).

The lighting apparatuses can be solid-state lighting apparatuses, including, but not limited to LED lighting apparatuses.

Although specific preferred embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that the present invention be limited only by the claims and the equivalents thereof.

What is claimed is:

1. A lighting connector comprising:

(a) an upper housing having:
plural connector pins, and
one or more interlocking grooves;

(b) a lower housing, the lower housing having a plurality of connector pin guide holes, and one or more interlocking tongue portions;

(c) a power supply plug; and (d) a flexible connector electrically connecting an inner side of the lower housing with an inner side of the power supply plug, the lower housing being connectable with the upper housing to form the lighting connector by coupling at least one of the one or more interlocking grooves with at least one of the one or more interlocking tongue portions, and by coupling at least one of the plural connector pins with at least one of the connector pin guide holes.

2. The lighting connector according to claim 1, wherein each of the plural connector pins comprises an embedded portion situated within the upper housing, and plural protruding portions, at least one of the protruding portions being configured to couple with a respective corresponding one of the at least one connector pin guide holes.

3. The lighting connector according to claim 2, the upper and lower housings being shaped so as to interface with and end portion of a length of lighting apparatus, so as to mechanically and electrically connect at least two lengths of lighting apparatus to one another upon coupling of the upper and lower housings to form the lighting connector.

4. The lighting connector according to claim 3, wherein each of the length of lighting apparatus interfacing with the connector comprises an encapsulant and at least one conductive bus embedded within the encapsulant, and, upon coupling of the upper and lower housings, the protruding portions of each connector pin penetrate the encapsulant of at least one of the lengths of lighting apparatus so as to contact the at least one conductive bus and to effect an electrical coupling between the at least two lengths of lighting apparatus.

5. The lighting connector according to claim 4, the lower housing further comprising at least one opening for receiving an end portion of a length of lighting apparatus.

6. The lighting connector according to claim 5, further comprising a gasket in a lining of the at least one opening.

7. The lighting connector according to claim 4, wherein each of the connector pins are made of an electrically conductive material.

8. The lighting connector according to claim 4, wherein the embedded portion of each of the connector pins is insert-molded into the upper housing.

9. The lighting connector according to claim 4, wherein the protruding portions of each of the connector pins comprise a barbed tip, inverted "V" tip, or a "U" tip.

10. The lighting connector according to claim 4, wherein the upper and lower housings are made of a thermoplastic.

11. A lighting system comprising at least one lighting connector of claim 1.

12. A method of electrically and mechanically connecting a length of lighting apparatus to a power source, the lighting apparatus having at least one conductive bus, using a connector having: an upper housing having one or more interlocking grooves, a lower housing having one or more interlocking tongue portions, connector pins embedded in the upper housing, one or more openings and/or slots formed in the lower housing, a power supply plug, and a flexible connector electrically connecting an inner side of the lower housing with an inner side of the power supply plug, the method comprising:

coupling an end portion of a lighting apparatus into at least one of the one or more openings and/or slots, and pressing the upper housing and the lower housing so as to couple corresponding ones of the interlocking grooves of the upper housing with interlocking tongue portions of the lower housing, so as to penetrate the connector pins into the length of lighting apparatus so as to contact at least one conductive bus of the lighting apparatus.

13. The method according to claim 12, wherein the length of lighting apparatus comprise an encapsulant, and the connector pins penetrate to the encapsulant in the pressing step.

14. The method according to claim 12, wherein the penetration of the length of lighting apparatus effects an electrical connection between the at least one conductor bus of the length of lighting apparatus and a power source.

* * * * *